US005524427A

United States Patent [19]

Sekiya et al.

[11] Patent Number: 5,524,427

[45] Date of Patent: Jun. 11, 1996

[54] METHOD AND APPARATUS FOR PIECING SLIVERS IN A SPINNING MACHINE BY THROTTLING IN A NOZZLE

[75] Inventors: Shigeki Sekiya, Kuwana; Takashi Kogiso, Mizunami; Yoshio Kurachi, Nishikasugai; Toshiyuki Kuzutani, Inazawa, all of Japan

[73] Assignee: Howa Machinery, Ltd., Aichi, Japan

[21] Appl. No.: 141,877

[22] Filed: Oct. 27, 1993

[30] Foreign Application Priority Data

Nov. 10, 1992 [JP] Japan ..... 4-299895
Dec. 15, 1992 [JP] Japan ..... 4-334667

[51] Int. Cl.[6] ..... D01H 9/00; D01H 9/10

[52] U.S. Cl. ..... 57/261; 19/159 A; 57/90; 57/281; 57/269; 57/315

[58] Field of Search ..... 57/90, 281, 261, 57/263, 269, 268, 22, 315; 19/159 A, 260

[56] References Cited

U.S. PATENT DOCUMENTS

| | | | |
|---|---|---|---|
| 3,716,979 | 2/1973 | Handschuh et al. | 57/281 |
| 4,939,895 | 7/1990 | Raasch et al. | 57/90 X |
| 4,977,738 | 12/1990 | Stahlecker | 57/90 X |
| 4,987,645 | 1/1991 | Kawasaki et al. | 19/25 |
| 5,067,204 | 11/1991 | Shinkai et al. | 19/159 A |
| 5,138,828 | 8/1992 | Stahlecker | 57/90 X |
| 5,140,722 | 8/1992 | Akiyama | 19/150 |
| 5,177,835 | 1/1993 | Ogawa et al. | 19/260 |
| 5,311,645 | 5/1994 | Schwalm et al. | 57/90 |
| 5,343,689 | 9/1994 | Sasaki et al. | 57/90 |

FOREIGN PATENT DOCUMENTS

| | | |
|---|---|---|
| 0361306 | 4/1990 | European Pat. Off. . |
| 0481922 | 4/1992 | European Pat. Off. . |
| 4038982 | 6/1991 | Germany . |
| 1-55183 | 11/1989 | Japan . |
| 291233 | 3/1990 | Japan . |
| 2251626 | 10/1990 | Japan . |
| 3232669 | 10/1991 | Japan . |
| 449176 | 2/1992 | Japan . |

*Primary Examiner*—William Stryjewski
*Attorney, Agent, or Firm*—Stevens, Davis, Miller & Mosher

[57] ABSTRACT

A sliver piecing unit 80 includes three sets of separable rollers 804 and 844, 806 and 846, and 808 and 848 for nipping a sliver S1 fed from a consumed can to a spinning machine. A throttling nozzle 870 is arranged between the second and third sets of rollers 806 and 846, and 808 and 848. The draft ratio between the first and second sets of rollers 804 and 844, and 806 and 846 can be varied between 1.0 and 2.0. A sliver feed unit 70 includes a separable first and second roller **702*a* and 702*b* for feeding a sliver S2 from a full can to the piecing unit 80 so that the slivers S1 and S2 are combined. The draft ratio between the first and second sets of rollers 804 and 844, and 806 and 846 is controlled to obtain combined slivers of a thickness corresponding to that of a single sliver. A nipping belt 884 and nipping roller 886 are provided at the outlet from the third set of the rollers 808 and 804 for obtaining a rubbing movement in the combined slivers. A breaking element 802 is provided at the inlet to the first set of the rollers 804 and 844 to break the first sliver S1** after the completion of the piecing operation.

23 Claims, 40 Drawing Sheets

(1)

(2)

(3)

(4)

(5)

(6)

METHOD AND APPARATUS FOR PIECING SLIVERS IN A SPINNING MACHINE BY THROTTLING IN A NOZZLE

BACKGROUND OF THE INVENTION

1. Field of the Invention

The present invention relates to a method and apparatus for piecing slivers in a textile machine such as a roving frame.

2. Description of Related Art

Japanese Un-Examined Patent Publication (Kokai) No. 2-91233 discloses an automatic apparatus for piecing a sliver from a full can to a sliver which is fed from a consumed can to a roving frame. In this prior art apparatus, the piecing of slivers is executed when the spinning operation of the sliver is stopped. Namely, first, the sliver from the consumed can to the corresponding drafting unit of the roving frame is broken. Then, the broken end from the drafting unit is, at a piecing unit, superimposed with an end of a sliver from the full can. The piecing unit is, then, operated for piecing the superimposed ends of the sliver. Such a piecing operation is repeated for all of the cans of the roving unit. After the completion of the piecing operation for all of the cans of the roving frame, a spinning operation by the roving frame is re-started.

Japanese Un-Examined Patent Publication (Kokai) No. 4-49176 discloses an automatic piecing unit wherein the end from the drafting unit of a roving frame and the end from a full can are nipped by a nipping means, so that the superimposed ends are interwound by imparting air flows. In Japanese Un-Examined Patent Publication (Kokai) No. 3-232669, spikes are provided for causing the fibers between the combined slivers to be interwound. Furthermore, the Japanese Un-Examiner Patent Publication (kokai) No. 4-163328 (corresponding to U.S. Pat No. 5,177,835) discloses a system for an automatic piecing of slivers in a textile machine, such as a roving frame, wherein it has a sliver piecing assembly having a plurality of sets of opposite, separable draft rollers and a set of separable rubbing rollers at an outlet side of the draft rollers for holding a first old sliver between the opposite rollers. The system is further provided with a sliver feed assembly having an opposite, separable set of feed rollers for holding a second sliver therebetween. The first sliver from a can which is emptied or nearly emptied is held by the opposite rollers of the piecing assembly, and the first sliver is cut between the piecing assembly and the can, in such a manner that a sufficient length of the sliver exists on the inlet side of the piecing assembly to obtain a desired piecing operation. Then, a feeding operation of the first sliver is commenced by rotating the rollers, while a feeding operation of the second sliver from a full can by means of the feeding assembly is also commenced so that a front end of the second assembly is introduced into the inlet side of the piecing assembly so that the second sliver from the can is combined with the first sliver from the can which is nearly emptied. When the combined first and second slivers reach the drafting rollers of the piecing assembly, a draft ratio by the drafting rollers, which is a ratio of the rotational speed of the outlet side draft rollers to those of the inlet side draft roller, is changed from a value of 1.0 to 2.0, so that the thickness of the combined sliver is reduced to the thickness corresponding to that for a single sliver, when the combined sliver is moved out of the outlet side drafting rollers. Furthermore, at the outlet side of the draft rollers, the combined slivers are subjected to a rubbing movement by the rubbing rollers which are rotated in opposite directions for feeding the sliver while being oppositely axially reciprocated, which allows the combined slivers to be interwound with each other to provide a complete single sliver.

In the prior arts, the piecing operation of the slivers are done when a feeding of a sliver to the roving frame is interrupted, which makes it impossible to execute the piecing operation when the roving frame is operated. Thus, in order to execute the sliver piecing operation, the spinning operation is interrupted, which reduces the production efficiency of a spinning factory. In the prior arts, fibers are only insufficiently interwound between the combined slivers, which causes a defect to be created at the pieced portion of the sliver, which frequently causes the sliver to be broken at a following spinning process. Furthermore, in the prior arts, the thickness of the pieced portion of the sliver is apt to be rapidly increased from a thickness of a single sliver, which causes the combined sliver to become uneven, which causes the quality of the pieced portion to be worsened, thereby sliver to be easily broken at a subsequent process.

SUMMARY OF THE INVENTION

An object of the present invention is to provide a method and apparatus for piecing slivers in which the sliver piecing is executed without stoppage of a spinning machine.

Another object of the present invention is to provide a method and apparatus for piecing slivers, capable of obtaining an improved quality at the pieced portion of the slivers.

A further object of the present invention is to provide a method and apparatus for piecing slivers capable of obtaining an improved interwound condition of fibers between combined ends of the slivers.

According one aspect of the present invention, a method is provided for piecing, to a first sliver to a spinning machine, a second sliver, said method comprising the steps of:

providing spaced sets of opposite rollers;

making the first sliver to be nipped by the sets of the rollers, so that the first sliver is moved by the rollers;

supplying the second sliver to the sets of the rollers so that the second sliver is, from its leading end, combined with the first sliver being moved;

interwinding the fibers between the combined slivers while they are moved, and;

breaking, on an inlet side of the sets of the rollers, the first sliver. According to another aspect of the present invention, an apparatus is provided for piecing, to a first sliver to a spinning machine, a second sliver, said apparatus comprising:

spaced sets of opposite, separable rollers;

the first sliver being nipped between the opposite rollers when they are contacted with each other, so that the first sliver is moved by the rollers;

means for supplying the second sliver to one of the sets of the rollers so that the second sliver is, from its leading end, introduced into the sets of the rollers and combined with the first sliver;

means for interwinding the fibers between the combined slivers, and;

means for breaking, on an inlet side of the sets of the rollers, the first sliver.

BRIEF DESCRIPTION OF ATTACHED DRAWINGS

FIGS. 1-(*a*) to (*h*) are schematic views of a piecing apparatus according to the present invention at series of phases during the execution of a piecing operation of slivers.

FIG. 2 is a schematic plan view of a system for conveying cans for slivers from a roving frame to a flyer frame.

FIGS. 3-(*a*) to (*f*) are schematic views illustrating a series of phases of a can exchanging operation in the first embodiment of the present invention.

Figure 17:
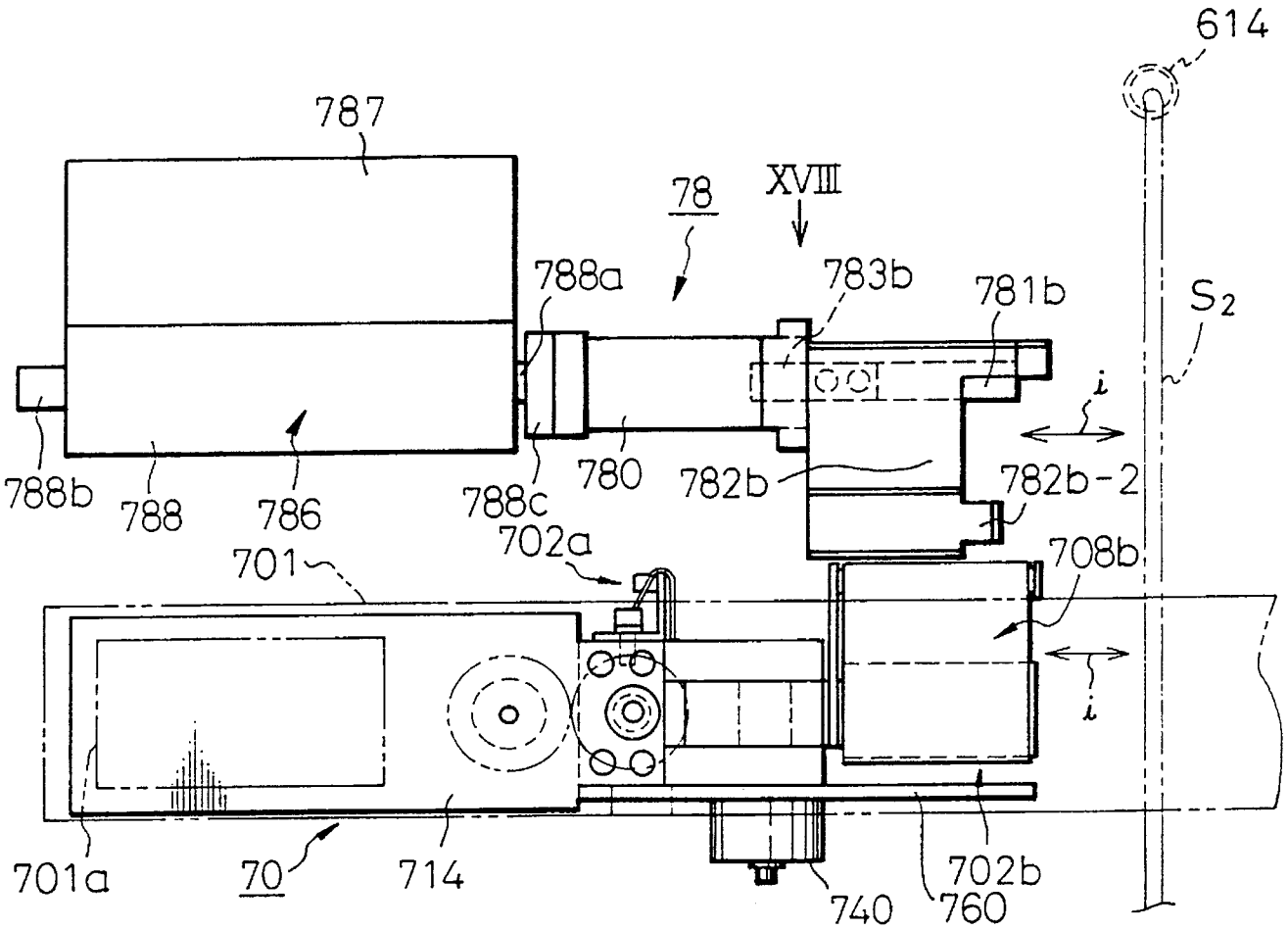

FIG. 17 a side view of a sliver end formation unit together with the sliver feed unit.

Figure 18:
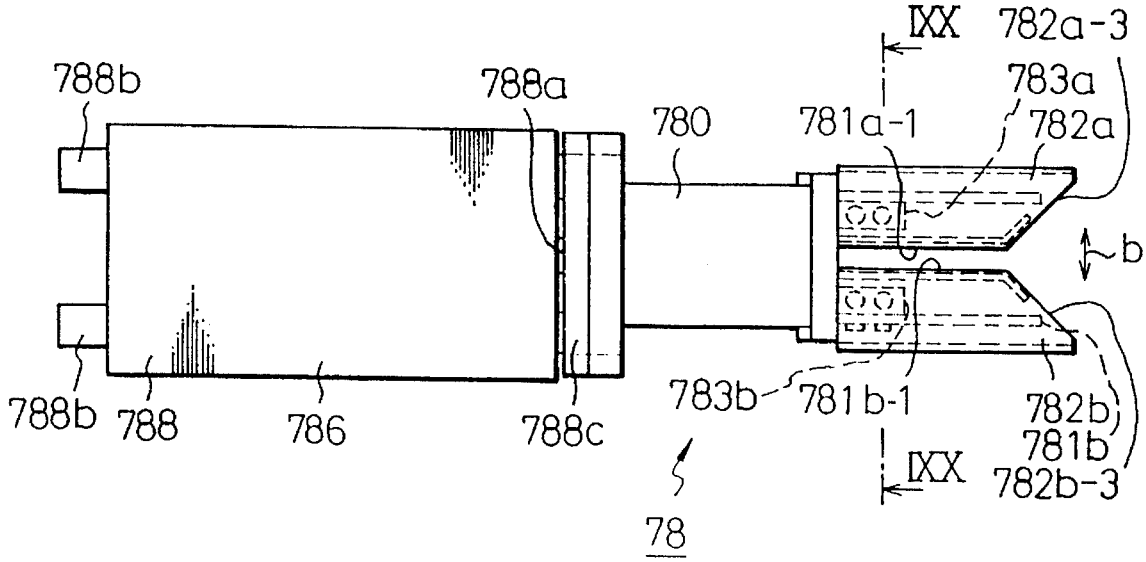

FIG. 18 is a view seen along an arrow XVIII in FIG. 17.

Figure 19:
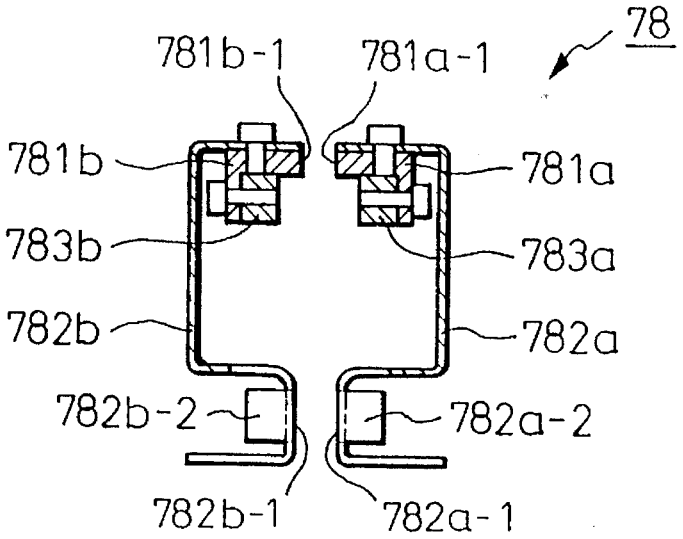

FIG. 19 is a cross-sectional view taken along lines IXX—IXX in FIG. 18.

Figure 20:
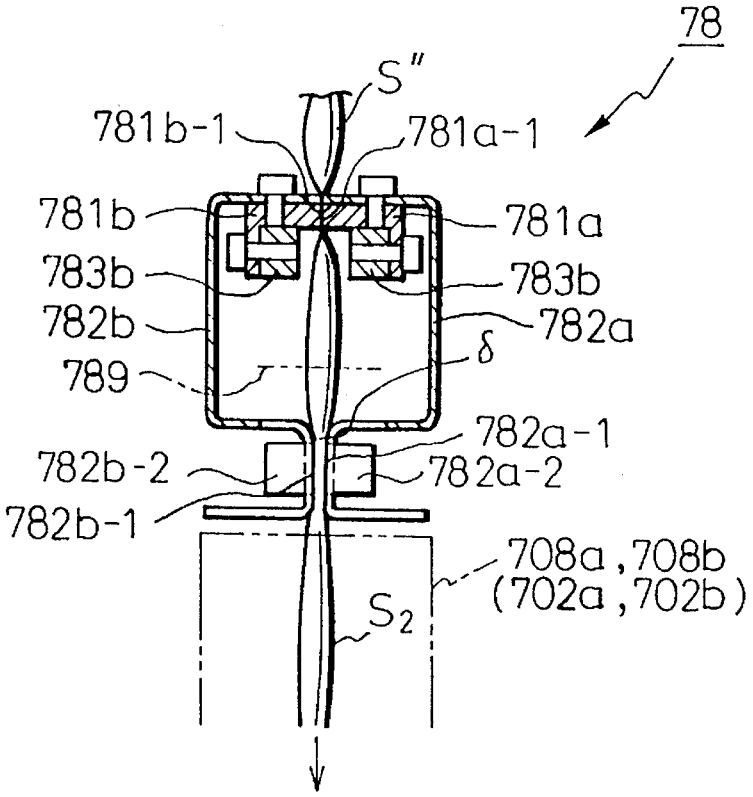

FIG. 20 is same as FIG. 19, but shows a condition when nipping elements are closed.

Figure 7:
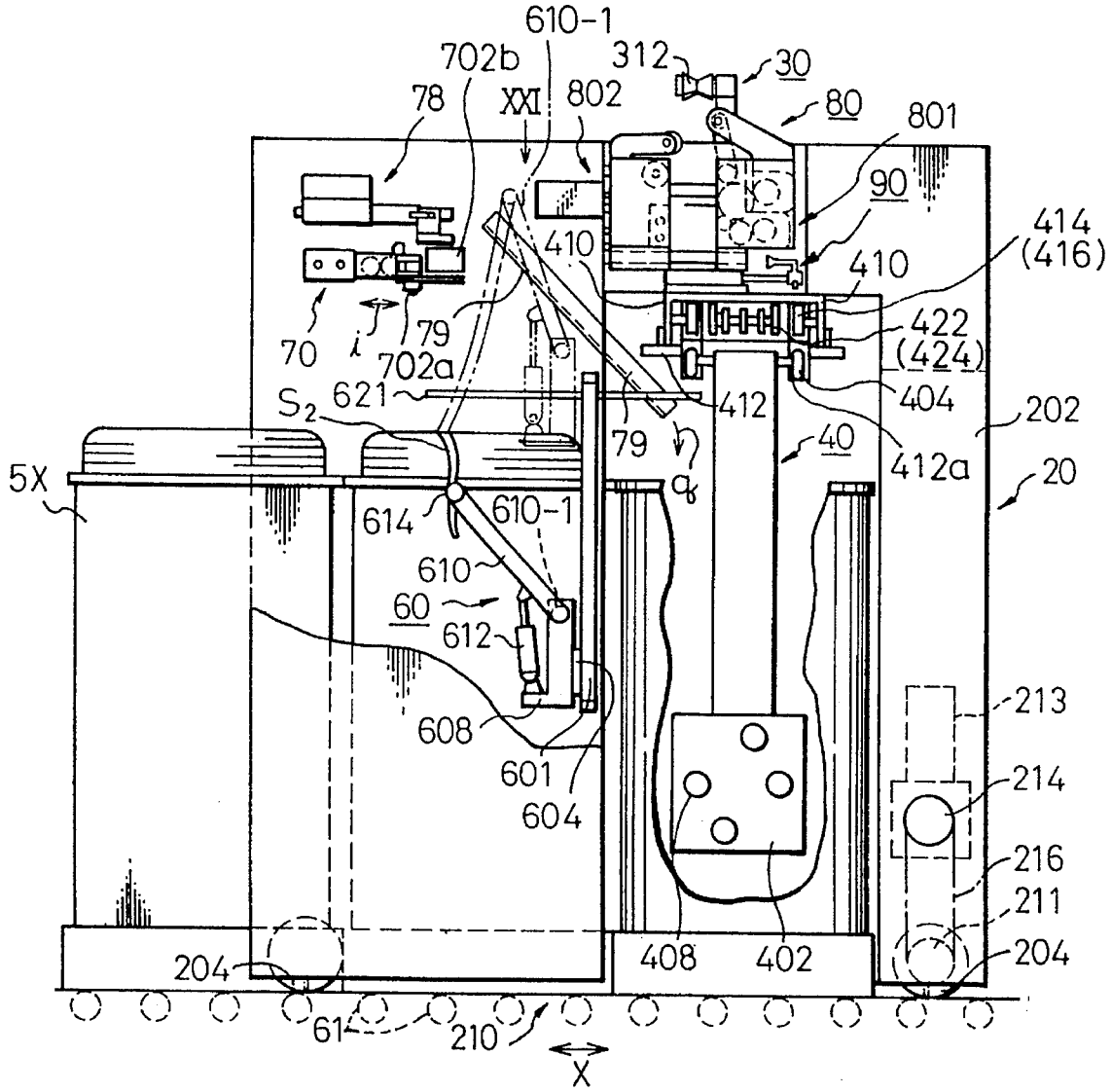
FIG. 7 is a view seen along an arrow VII in FIG. 6.
Figure 21:
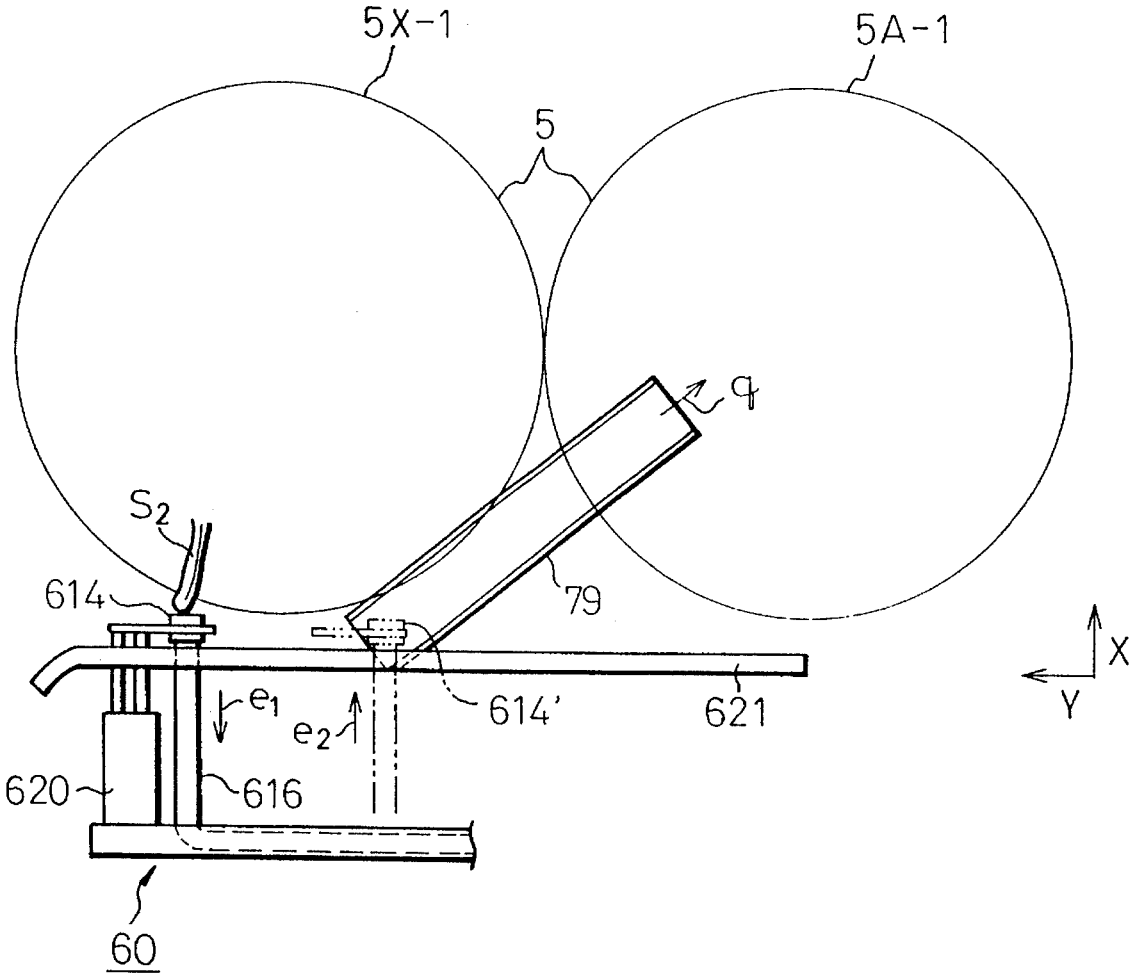

FIG. 21 is show a chute for waste sliver seen along an arrow XXI in FIG. 7.

Figure 22:
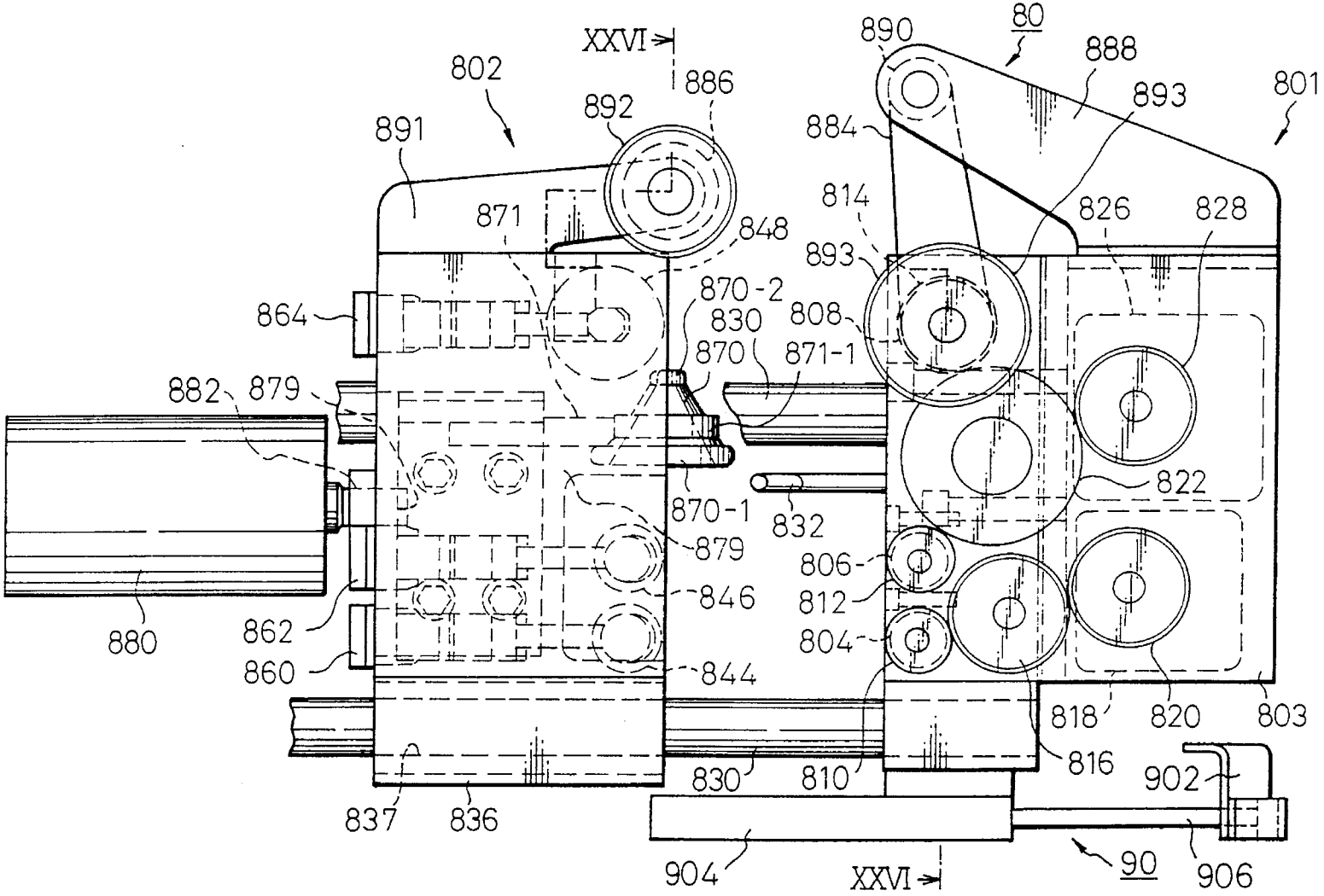

FIG. 22 is a side view of a sliver piecing unit when it is in an opened condition.

Figure 23:
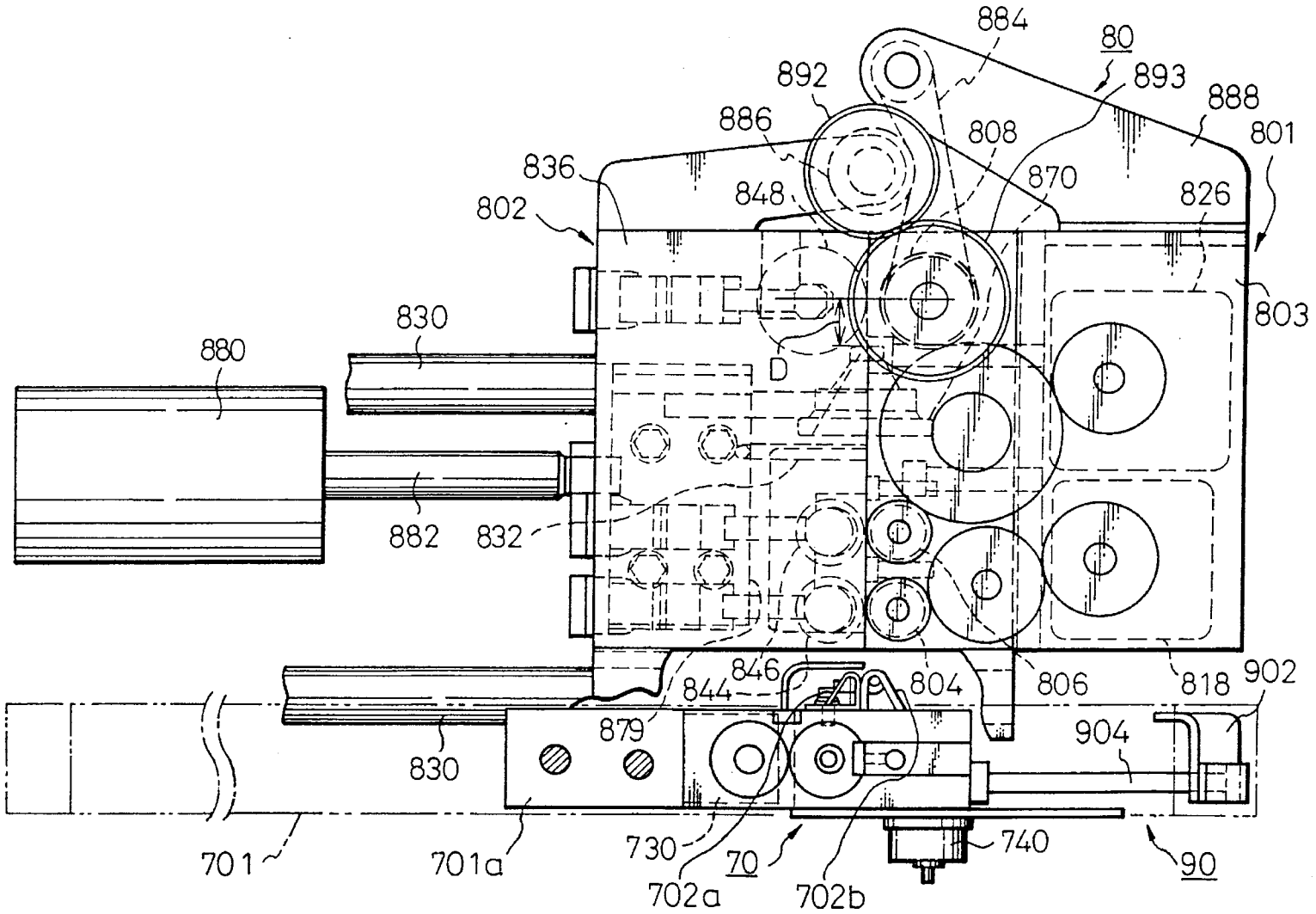

FIG. 23 is the same as FIG. 22, except that the sliver piecing unit is in a closed condition.

Figure 24:
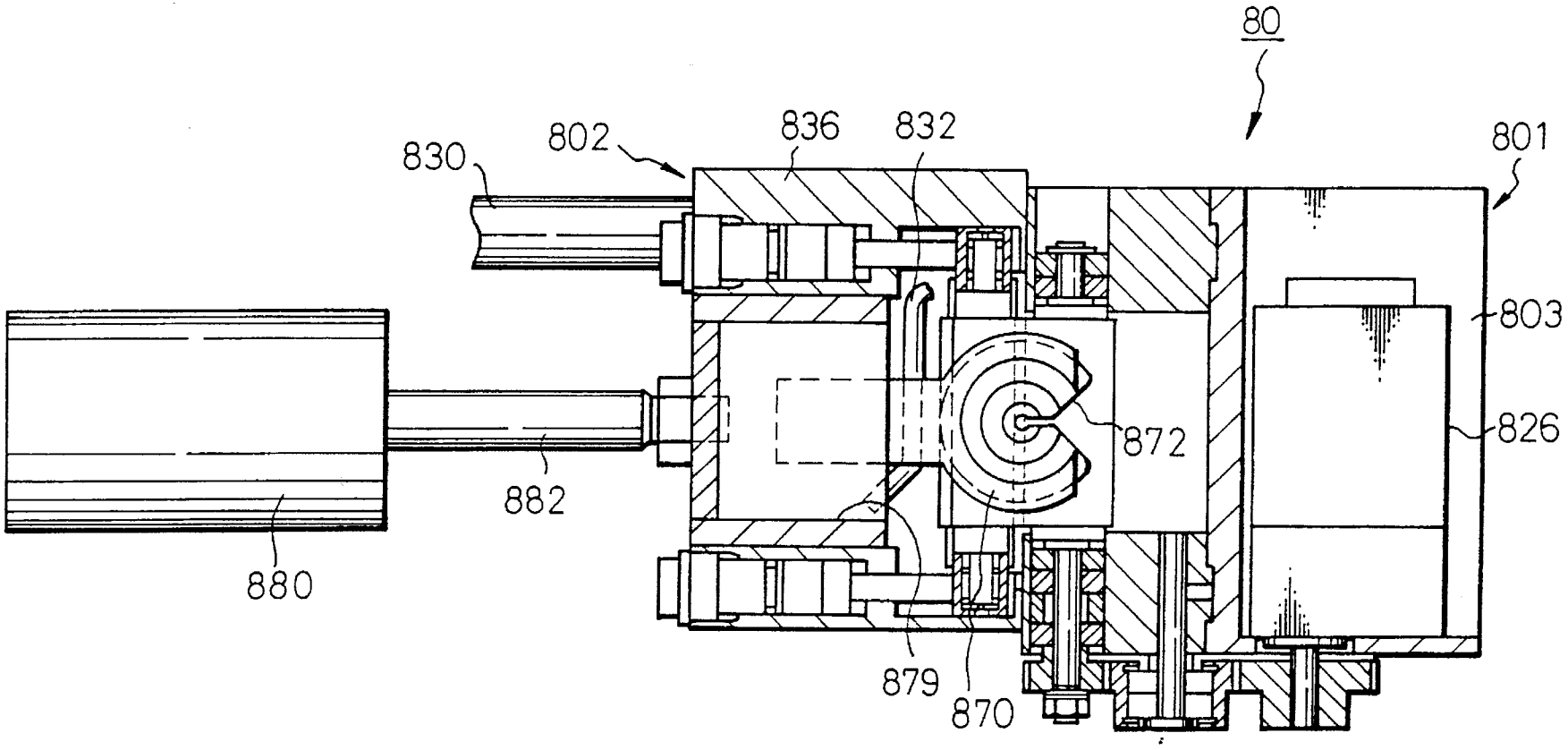

FIG. 24 is a transverse cross sectional view of the piecing unit when it is in the close position in FIG. 23.

Figure 25:
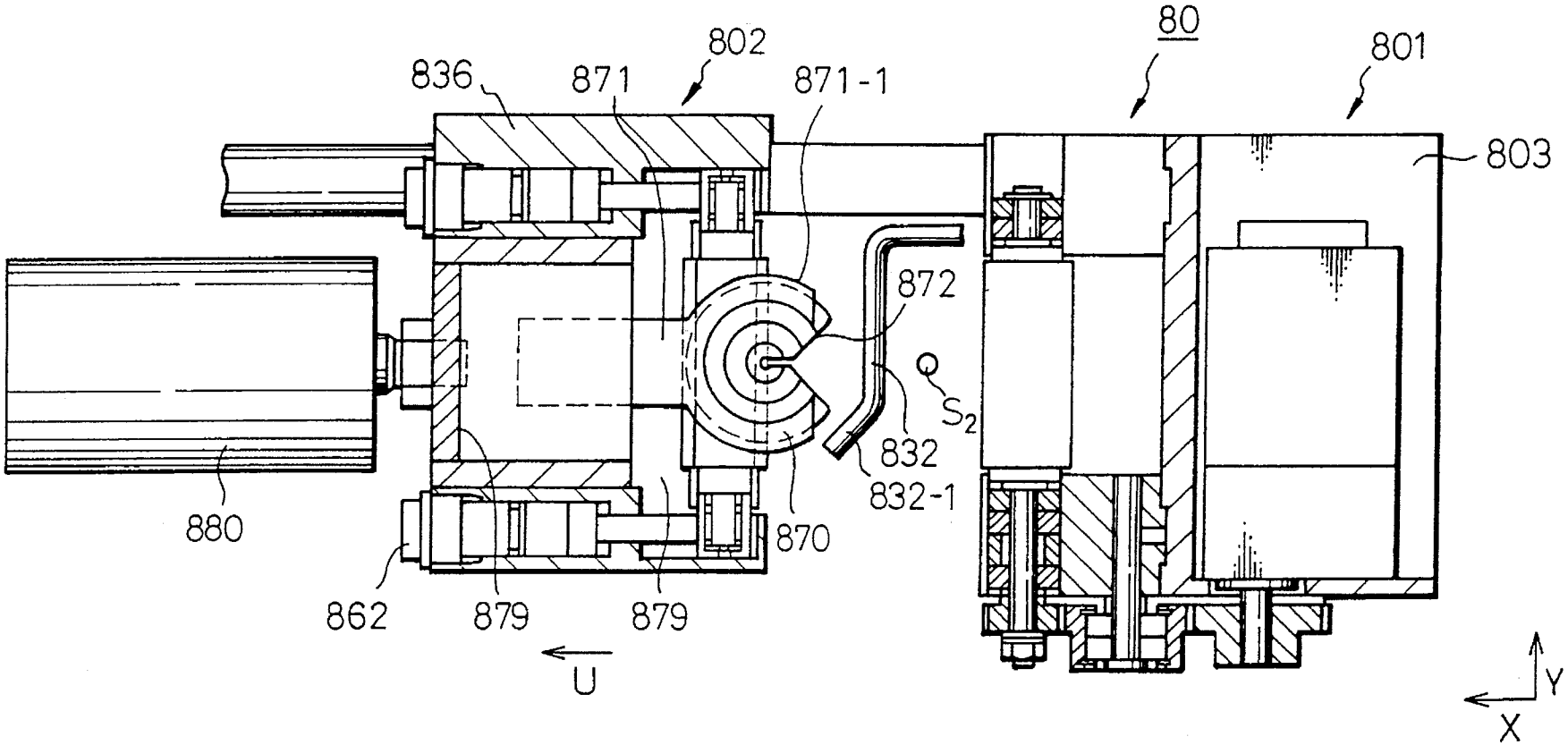

FIG. 25 is a transverse cross sectional view of the piecing unit when it is in the opened position in FIG. 24.

Figure 26:
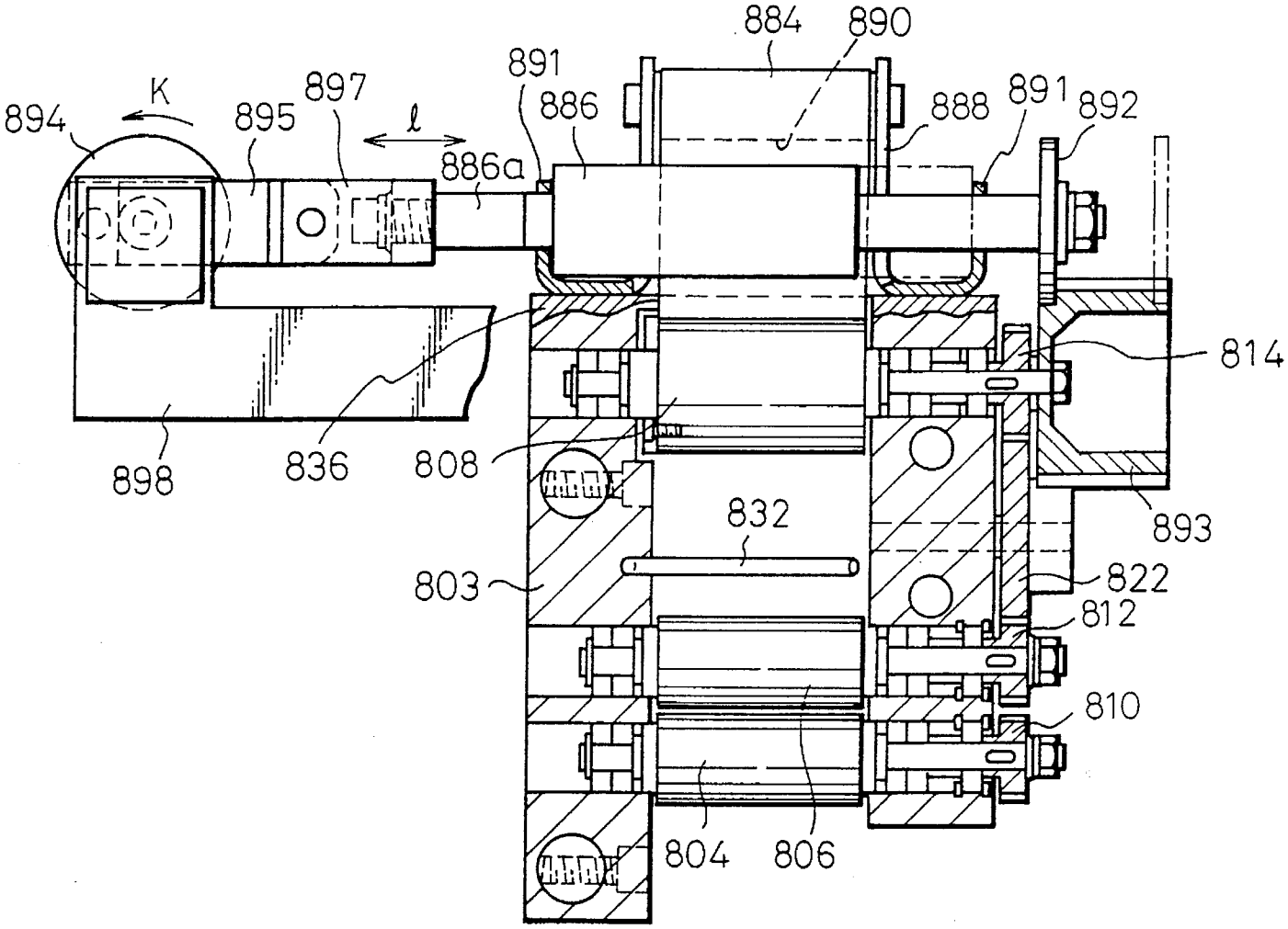

FIG. 26 is a view taken along lines XXVI—XXVI in FIG. 22.

Figure 27:
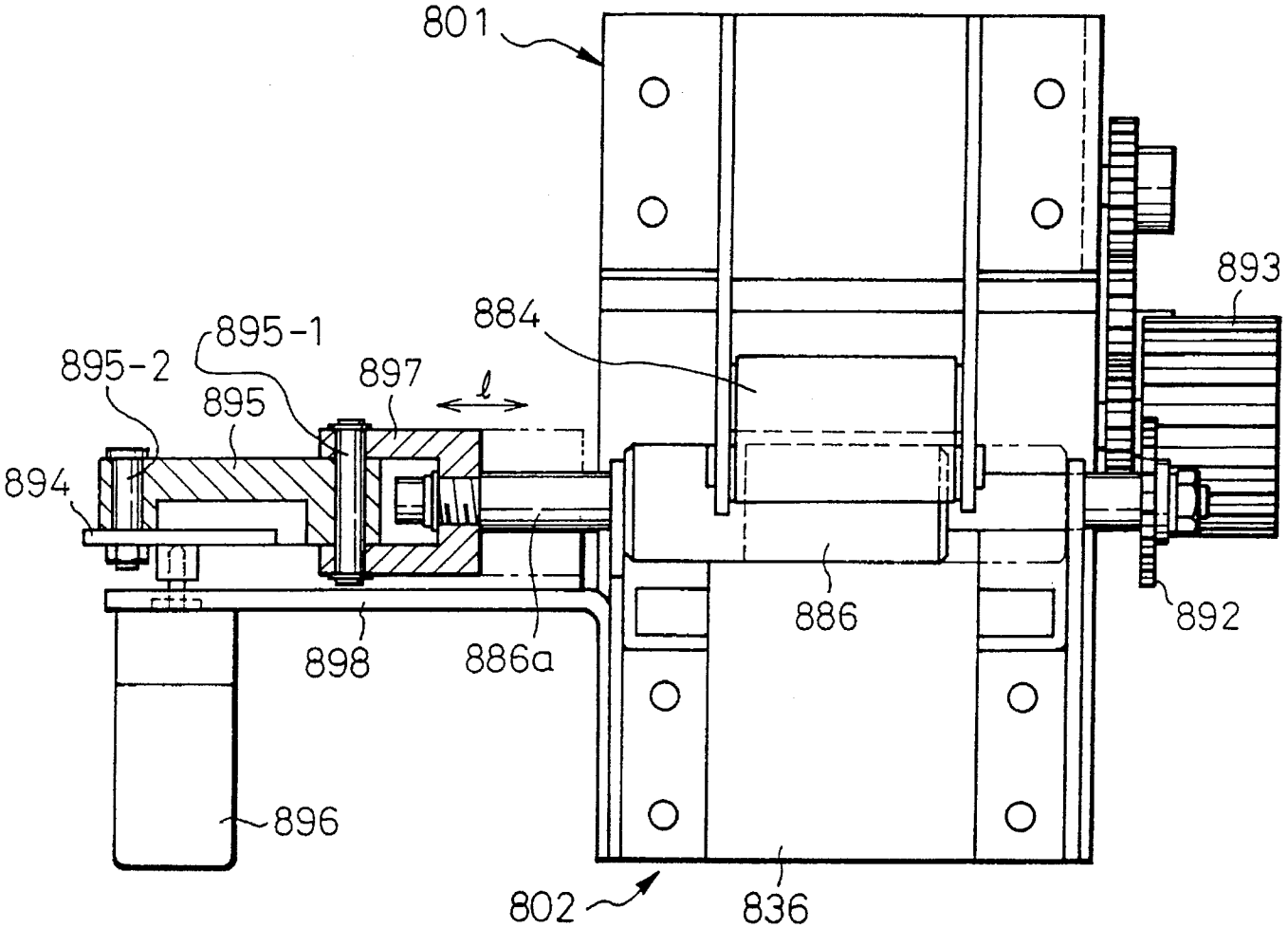

FIG. 27 a plan view of the sliver piecing unit in FIG. 22 partially cross-sectioned.

Figure 28:
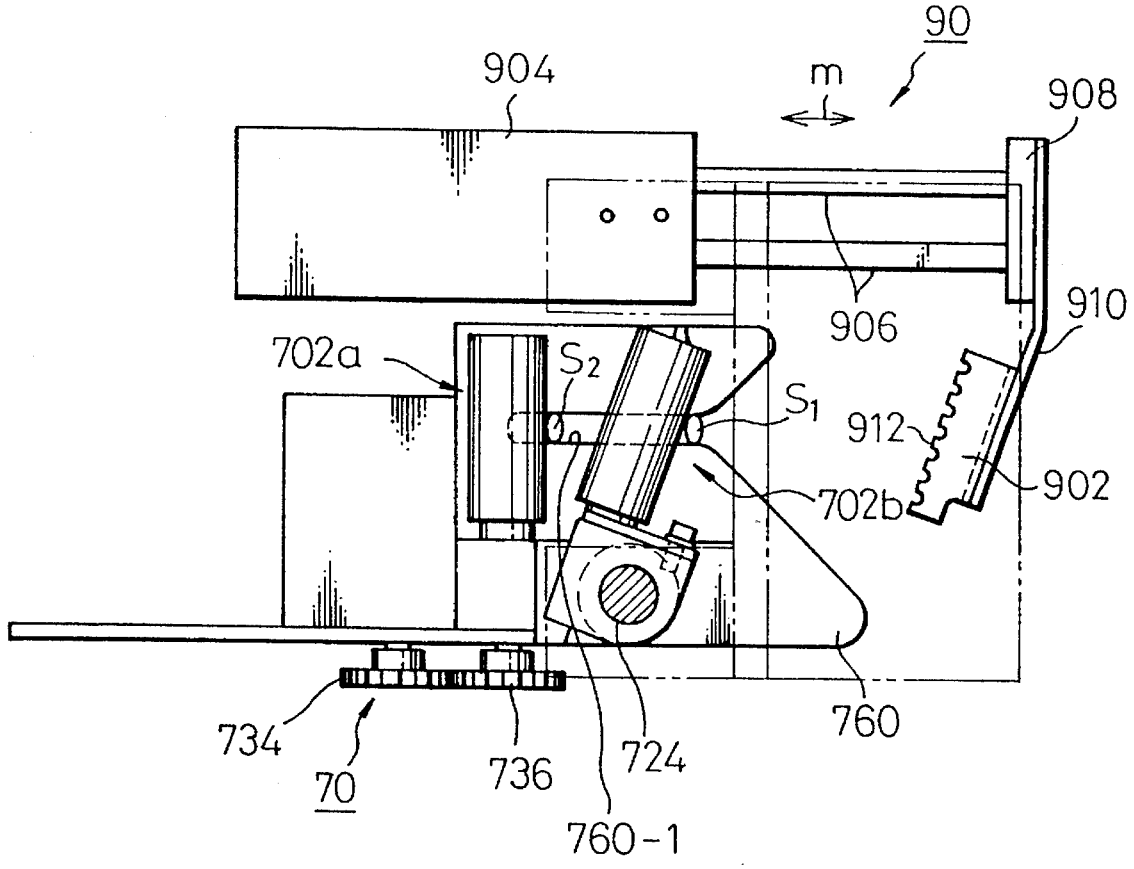

FIG. 28 is a plan view of a sliver breaking unit in relation of the sliver feed unit.

Figure 29A:
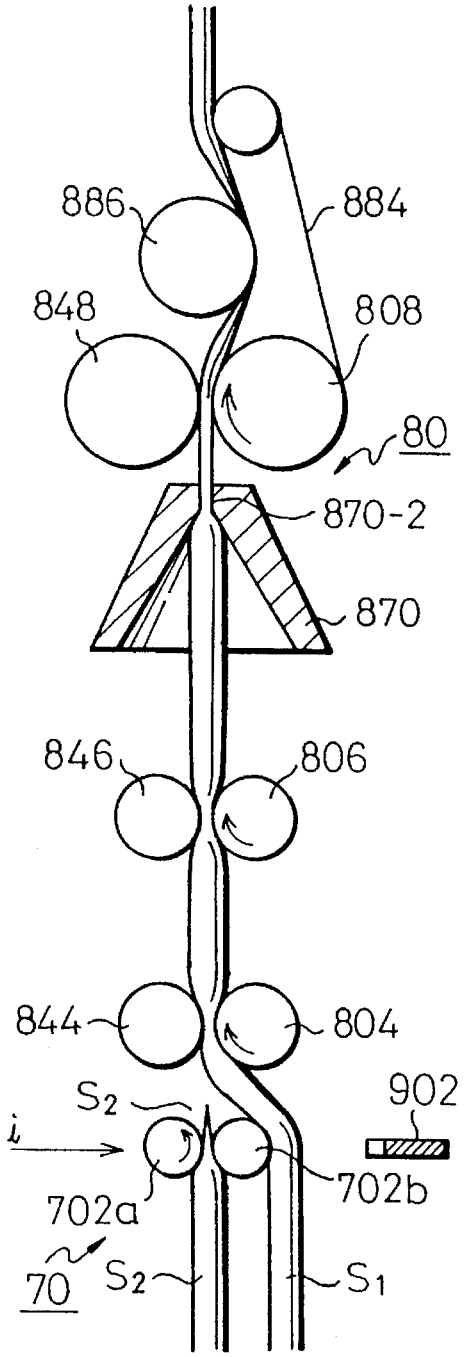
Figure 29B:
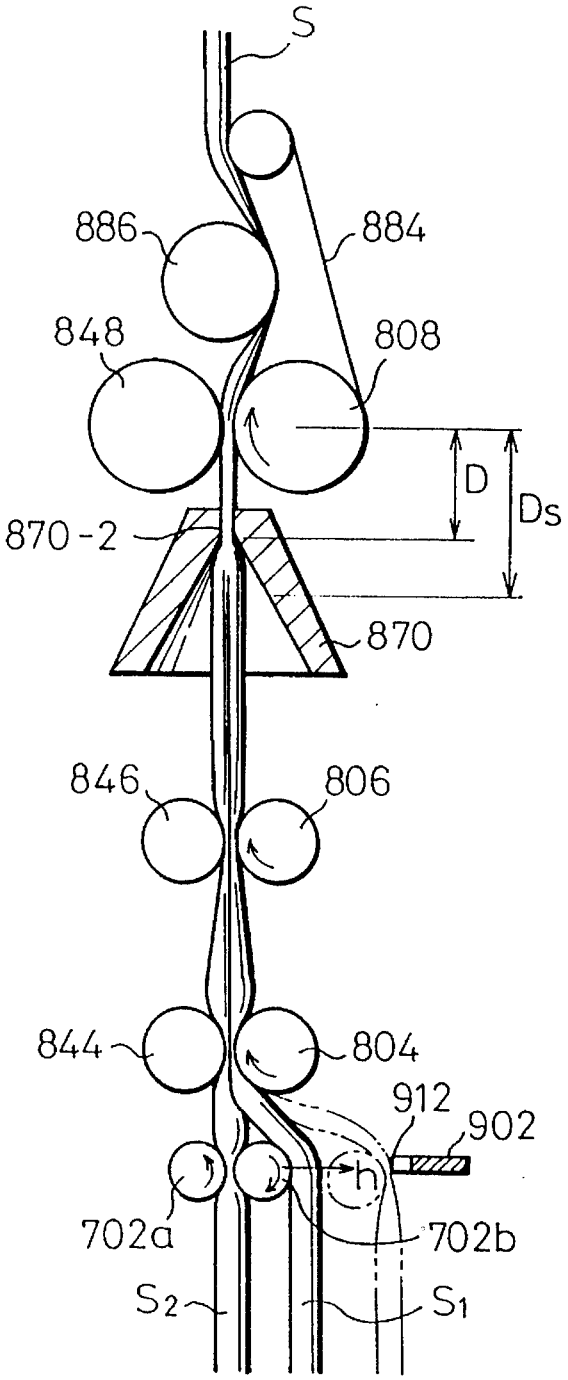

FIGS. 29-(*a*) and (*b*) show, schematically, a sliver piecing operation at different phases, respectively.

FIGS. 30 to 36 show a series of phases (1) to (7), respectively in a cycle for piecing and can exchanging operation.

Figure 37A:
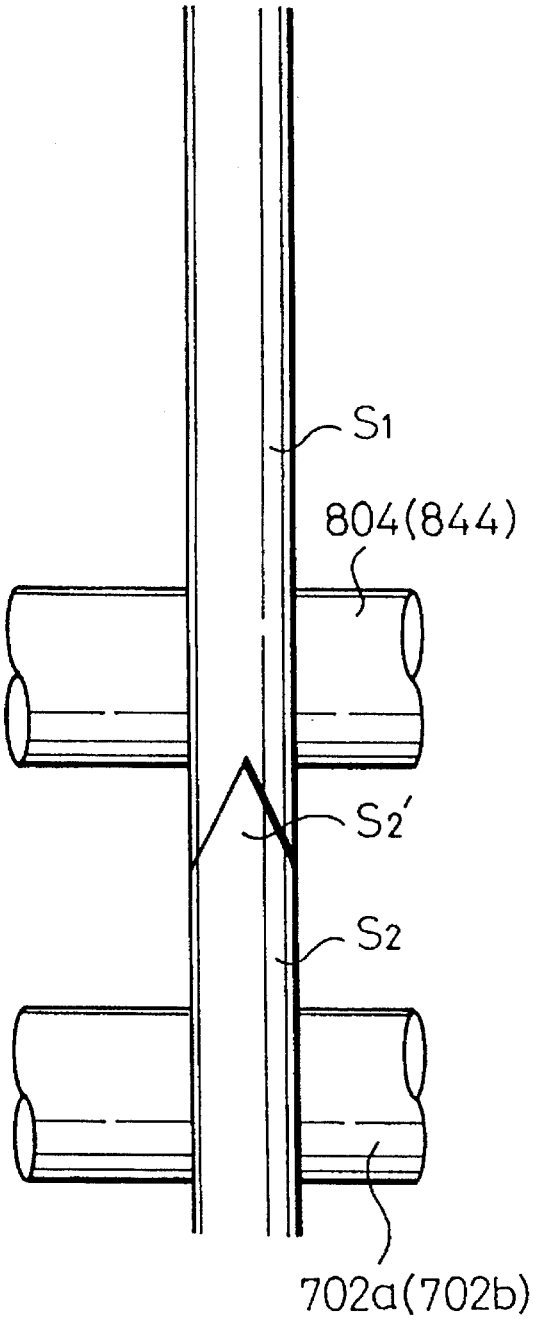
Figure 37B:
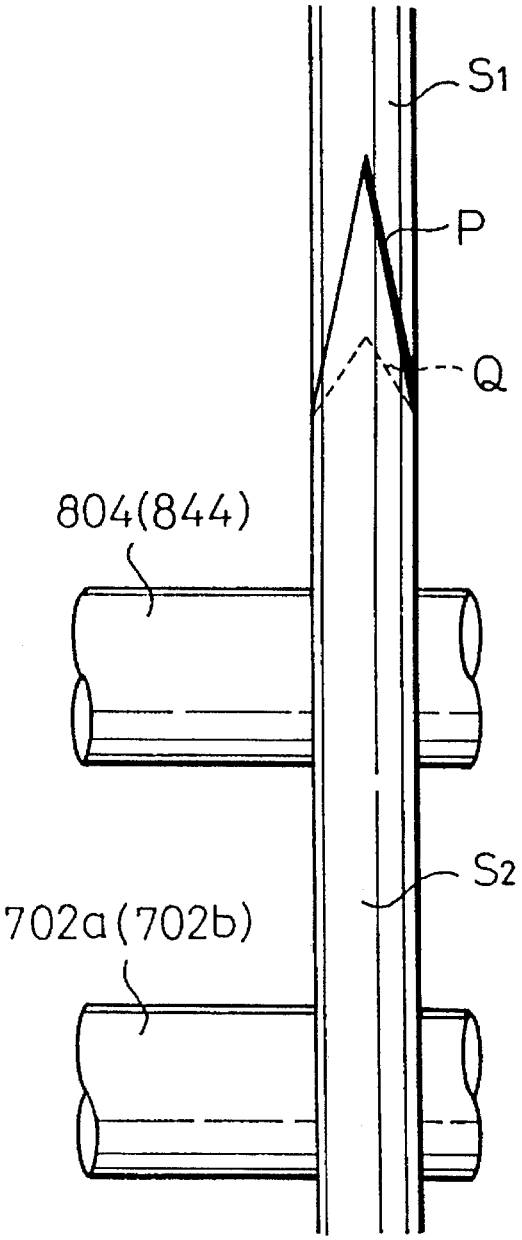

FIGS. 37-(*a*) and (*b*) show, schematically, a sliver end drafting operation at different phases, respectively.

Figure 38:
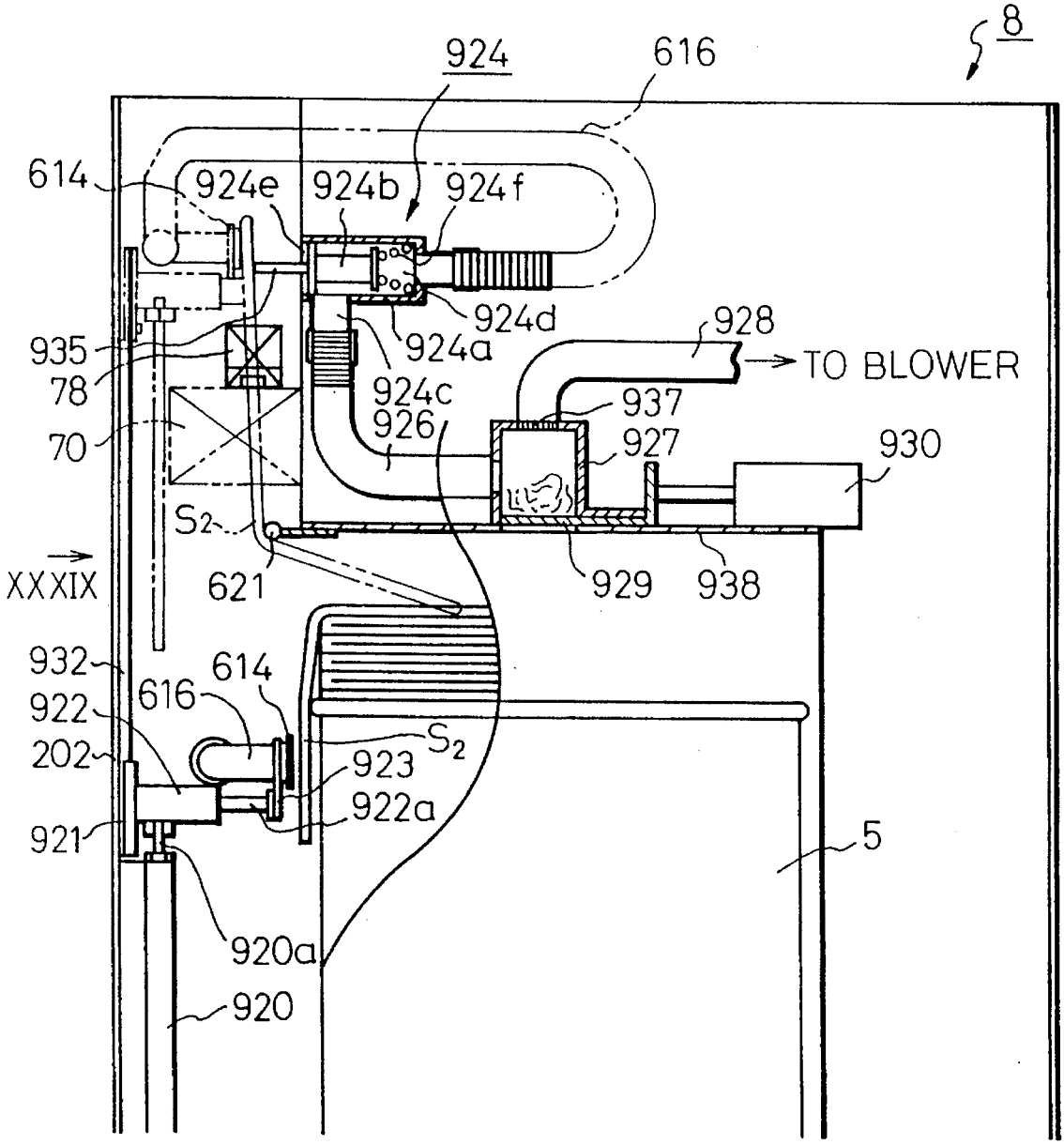

FIG. 38 is a side view of a can in the can exchanger illustrating a modification of a system for treating a waste sliver generated during the sliver piecing operation.

Figure 39:
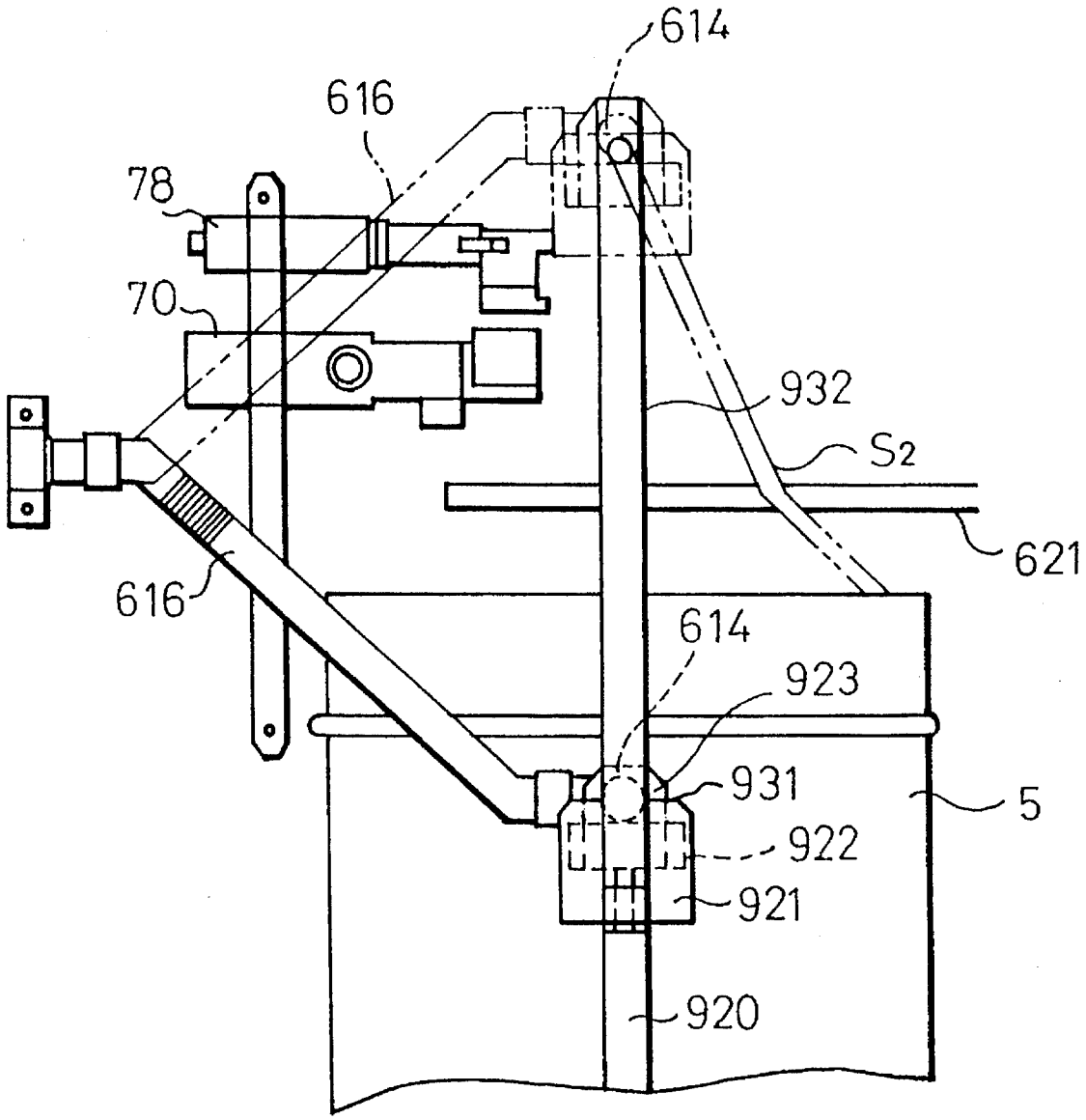

FIG. 39 is a view taken along an arrow XXXIX in FIG. 38.

Figure 40:
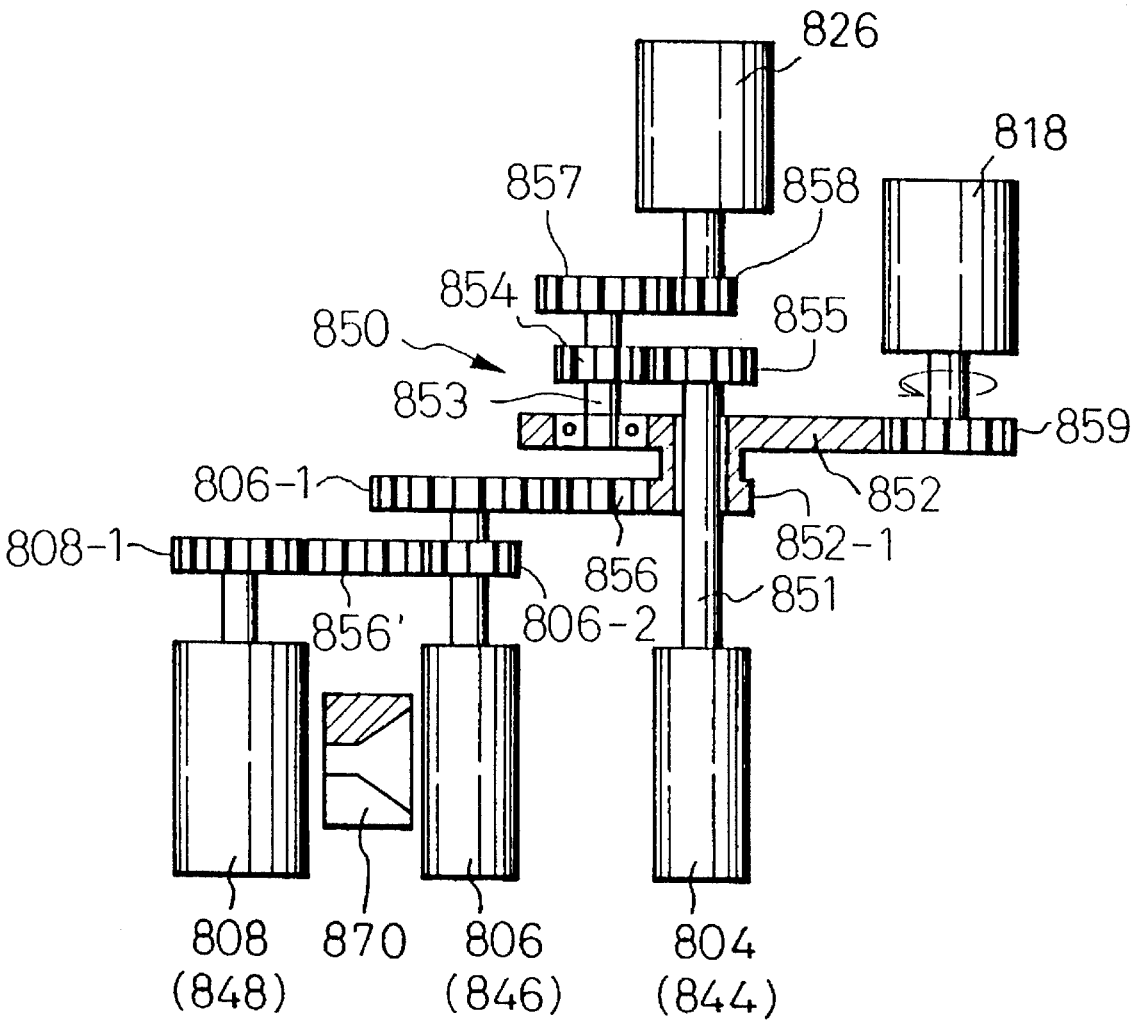

FIG. 40 shows generally a modification of a gearing for operating sets of rollers in the sliver piecing unit.

Figure 41:
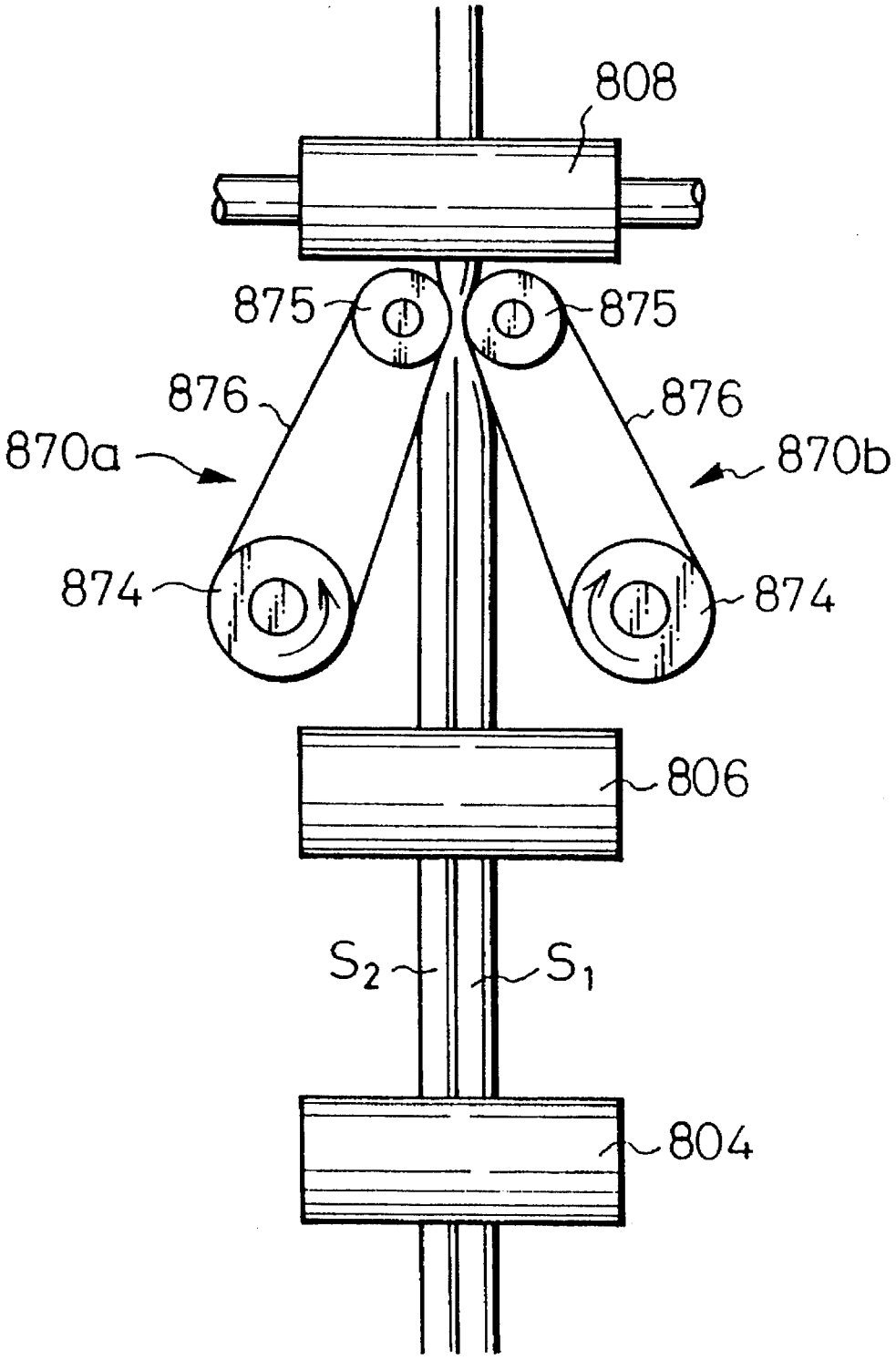
Figure 42A:
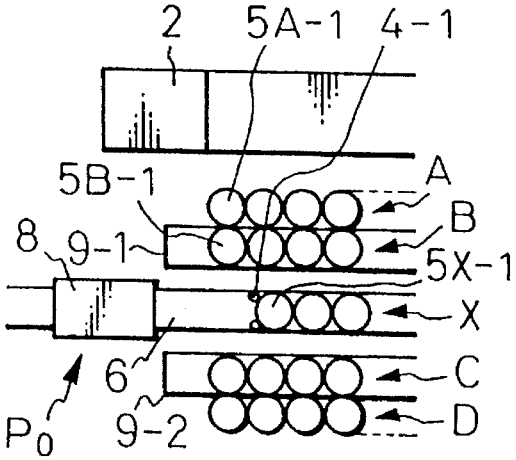
Figure 42B:
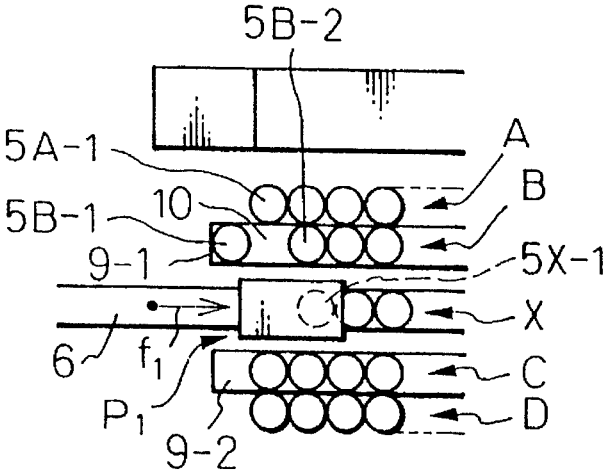
Figure 42C:
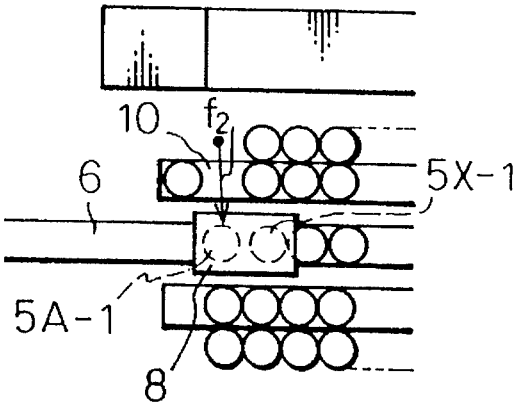
Figure 42D:
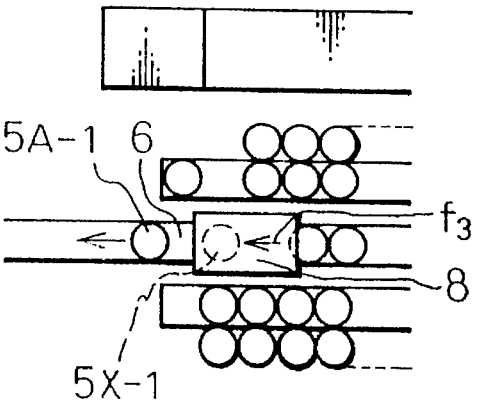
Figure 42E:
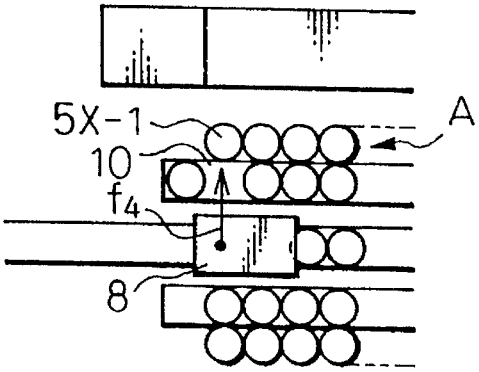
Figure 42F:
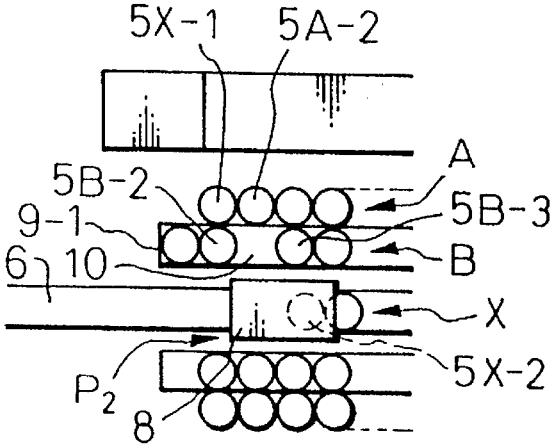

FIG. 41 is schematic view of a modification of a throttling means.

FIGS. 42-(*a*) to (*f*) are similar to FIGS. 3-(*a*) to (*f*), respectively, but illustrates a modification of a can exchanging system.

DESCRIPTION OF PREFERRED EMBODIMENTS

FIG. 1 shows schematically the principle of piecing slivers according to the present invention. Provided is a first or lower roller assembly constructed by a rollers Ia, IIIa and IVa and a nipping belt Va, and a second or upper roller assembly constructed by a rollers Ib, IIIb and IVb and a nipping roller Vb. In a condition (a), the first and the second assemblies are separated from each other. The first roller assembly is further provided with a nozzle II as a means for collecting fibers, arranged between the rollers Ia and IIIa. The nozzle II forms a slit II' on its one side facing the upper roller assembly. In a condition (b), a sliver $S_1$ to be pieced is introduced into the space between the first and second roller assemblies so that the sliver is in contact with the rollers Ia, IIIa and IVa, and is introduced into the nozzle II via the slit II'. In a condition in FIG. 3-(*c*), the upper roller assembly is moved downwardly, so that opposite sets of the rollers Ia and Ib, IIIa and IIIb, and IVa and IVb are contacted with each other so that the sliver $S_1$ is nipped between the opposite rollers. A draft means is constructed by the sets of opposite rollers IVa and IVb, and IIIa and IIIb. A draft ratio which is ratio of the surface speed of the set of the opposite rollers IIIa and IIIb to the surface speed of the set of the opposite rollers IVa and IVb is variable between 1.0 and 2.0. No draft is, basically, generated between the sets of the rollers IIIa and IIIb, and Ia and Ib, and therefore, the surface speed of the opposite set of the roller Ia and Ib is always equalized to that of the opposite set of the rollers IIIa and IIIb.

As shown in FIG. 1-(*d*), a sliver feed means is constructed by a set of opposite apron rollers VIa and VIb for feeding a second sliver $S_2$ which is to be pieced to the first sliver $S_1$. The second sliver $S_2$ is fed to the opposite set of the rollers IVa and IVb so that the sliver $S_2$ is combined with the sliver $S_1$. As mentioned above, the draft ratio of the sets of the rollers IVa and IVb, and IIIa and IIIb, which construct the draft means, is usually set to 1.0. But, at a time when the leading end of the combined sliver has just come to a desired location between the roller sets IVa and IVb, and IIIa and IIIb, the draft ratio is increased to a value of 2.0. Namely, the peripheral speed of the upstream set of the rollers IVa and IVb is reduced to a half of that of the downstream set of the rollers IIIa and IIIb. As a result, the thickness of the combined slivers is reduced to that of a single, complete sliver as it should be when it comes out from the upstream set of the draft rollers IIIa and IIIb. It should be noted that, in place of the ½ reduction of the speed of the upstream set of the draft rollers IVa and IVb, the speed of the downstream set of the draft rollers IIIa and IIIb can be doubled, so that the draft of 2.0 is, also, obtained between the upstream set of the rollers IVa and IVb, and the downstream set of the rollers IIIa and IIIb.

As shown in FIG. 1-(*e*), the combined slivers are, at the collecting nozzle II, subjected to a lateral force which causes the combined slivers $S_1$ and $S_2$ to be interwound with each other to a complete single sliver. In addition, the sliver coming out from the opposite rollers Ia and Ib is subjected to a rubbing movement by the rubbing roller Vb which is rotated and which is axially reciprocated while contacting with the flexible belt Va. The flexibility of the belt Va allows the sliver to contact with the roller Vb along a certain range of its outer periphery. In other words, the nipping of the sliver between the belt Va and the roller Vb takes place along a length in the direction of the supply of the sliver. As a result, an effective rubbing movement is applied to the sliver, causing the slivers $S_1$ and $S_2$ to be effectively interwound with each other to produce a single complete sliver.

As shown in FIG. 1-(*f*), a sliver breaking member VII, which is usually at a retracted position, is moved in a direction as shown by an arrow, while the feed roller VIa is moved toward the sliver cut member VII to a position as shown in FIG. 1-(*g*), Where the feed roller VIa is, at its outer surface, contacted with the sliver breaking member VII via the first sliver $S_1$, which causes the fibers to be separated with each other, which causes the sliver $S_1$ to be broken. The member VII is, at its outer periphery, formed with a plurality of grooves, so that the sliver $S_1$ is partially gripped along the width of the sliver $S_1$, so that the separation of the fibers is sparsely done, so that an increase length of a end portion of the sliver of reduced number of fibers can be obtained. In place of using the sliver breaking member VII, other means for breaking the sliver can be employed, such as a nipping member for nipping the sliver or a sucking nozzle for sucking the sliver.

At a final stage of the sliver piecing operation according to the present invention, the speed of the upstream set of the draft rollers IVa and IV is doubled, so that the speed of the rollers IVa and IVb is equalized to that of the downstream set of the draft roller IIIa and IIIb, when the broken end of the first sliver $S_1$ has just come to a desired location between the sets of the rollers IIIa and IIIb, and Iva and IVb. Namely, no draft is now applied to the sliver at the drafting means, thereby maintaining the desired thickness of the sliver.

In FIG. 1-(*h*), it is shown that the upper assembly (Ib, IIIb, IVb and Vb) is separated from the lower assembly (Ia, II, IIIa, IVa and Va) for the following piecing operation of a sliver. Furthermore, the sliver breaking member VII is also returned to a home position for the following piecing operation. It should be noted that the peripheral speed of the sliver feed rollers VIa and VIb may be always equalized to that of the inlet side set of the draft rollers IVa and IVb. Namely, the reduction in the speed of the rollers IVa and IVb causes the speed of the sliver feed rollers VIa and VIb to be reduced. Alternately, the peripheral speed of the sliver feed rollers VIa and VIb may be always the half the speed of the set of the inlet side draft rollers IVa and IVb. Namely, the speed of the feed rollers VIa and VIb is unchanged even if the speed of the inlet side rollers IVa and IVb is reduced during the piecing process.

Figure 1A:
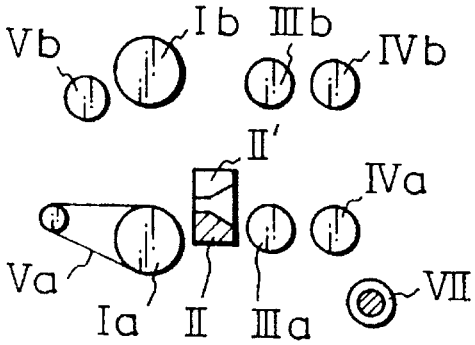
Figure 1B:
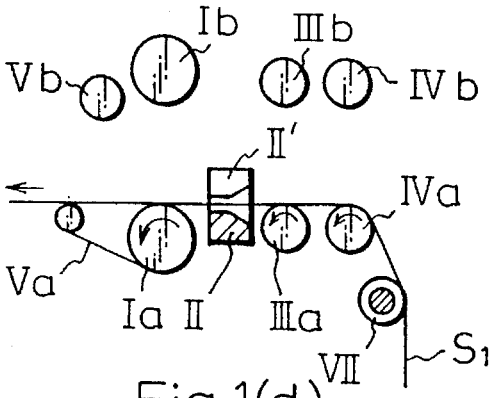
Figure 1C:
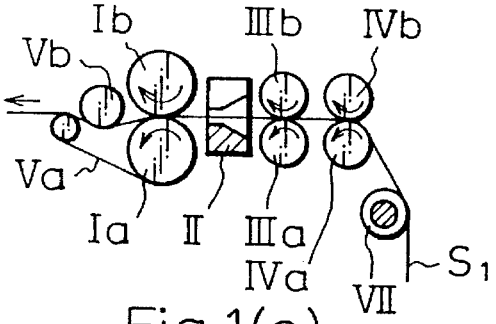
Figure 1D:
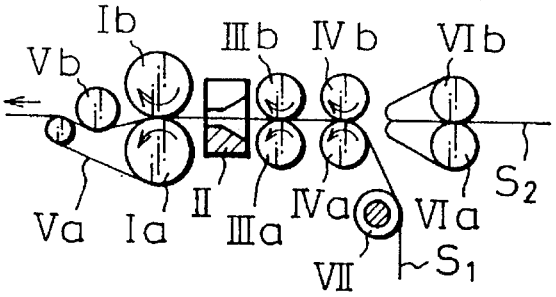
Figure 1E:
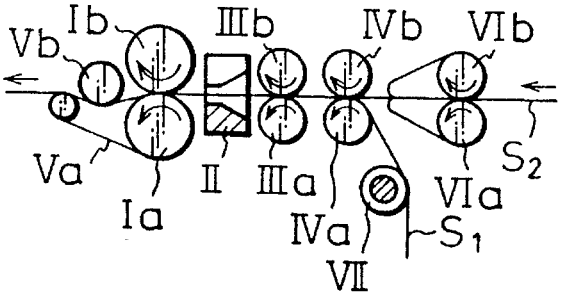
Figure 1F:
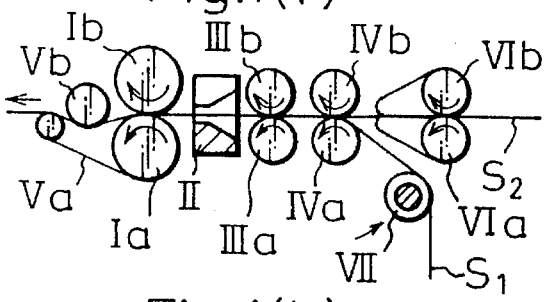
Figure 1G:
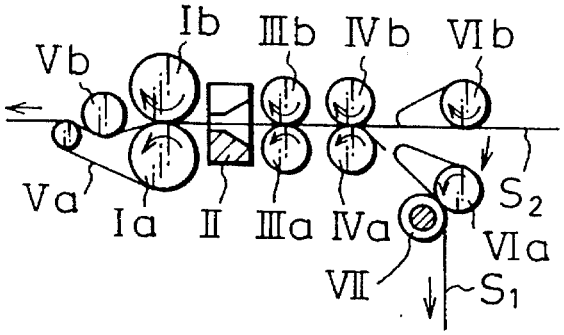
Figure 1H:
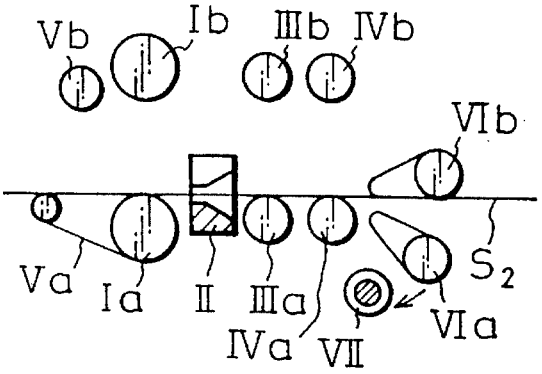
Figure 2:
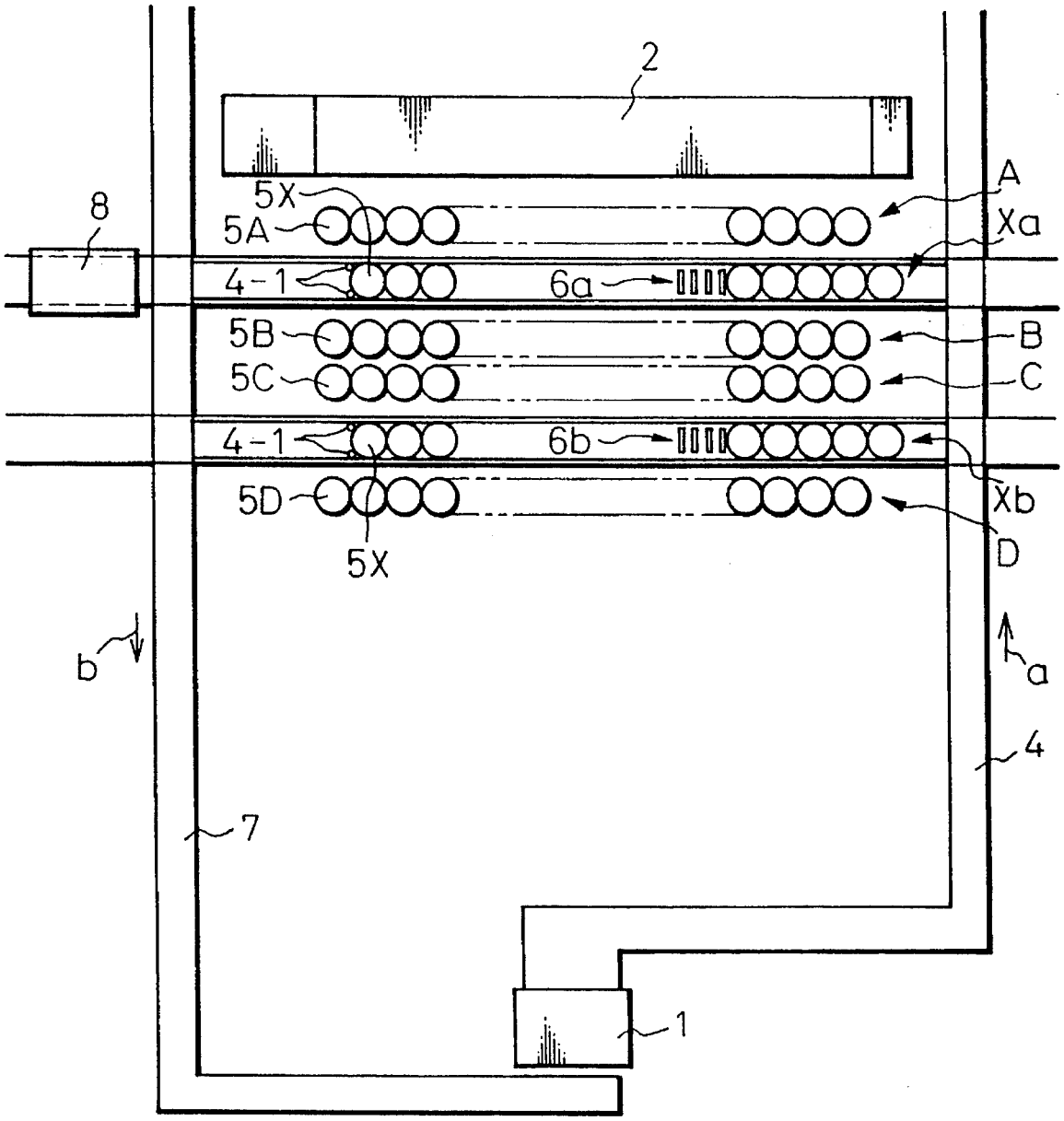
Figure 3A:
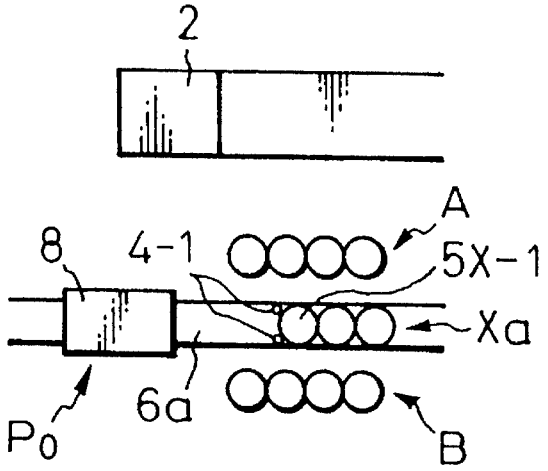
Figure 3B:
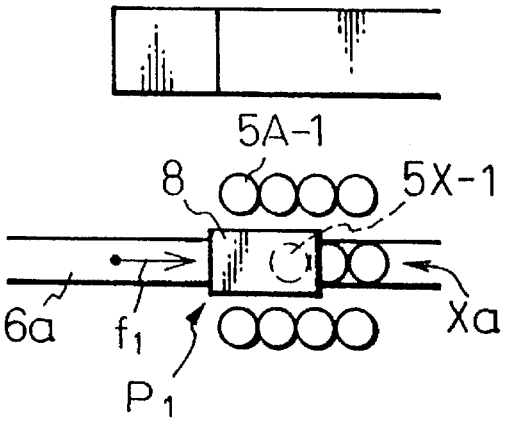
Figure 3C:
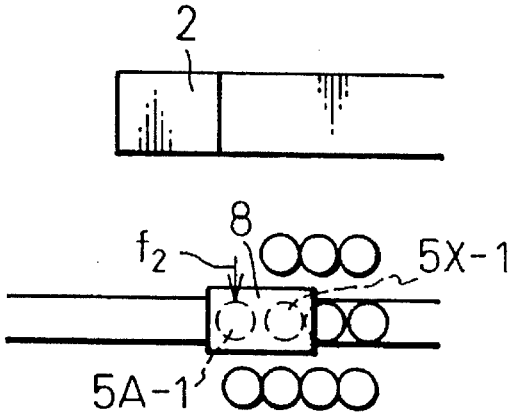
Figure 3D:
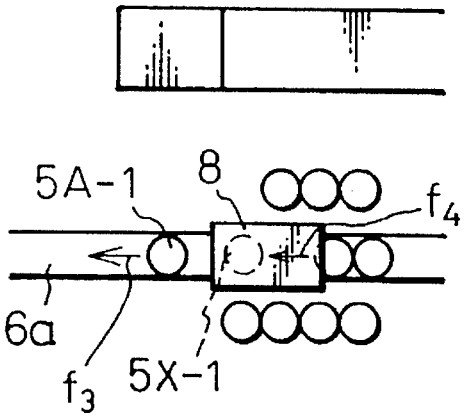
Figure 3E:
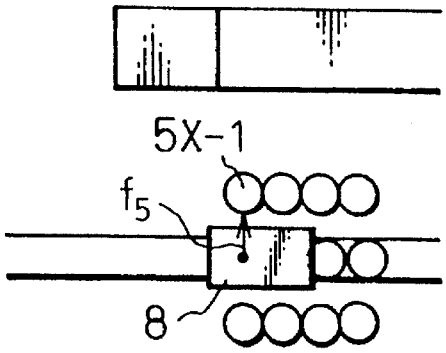
Figure 3F:
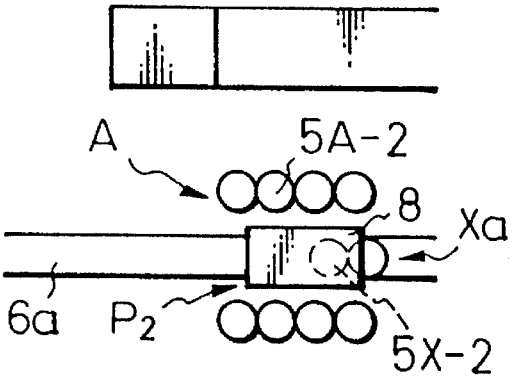

FIG. 2 illustrates, generally, a continuous system having a conveyor system 4 of sliver cans for connecting a drawing frame 1 with a roving frame 2. Namely, slivers produced by the drawing frame 1 are stored in cans, which are delivered to the conveyor 4 in a direction as shown by an arrow a. The roving frame 2 is, at its rear side, along the length thereof, provided with a plurality of rows of cans for slivers being supplied to draft units (not shown) of the roving frame 2. In the embodiment shown in FIG. 2, four rows A, B, C and D of the cans for supplied slivers are provided. In a direction transverse to the length of the roving frame 2, straight columns, each constructed by the cans 5A, 5B, 5C and 5D being supplied, are constructed. The slivers from the cans 5A, 5B, 5C and 5D of the each of the columns are supplied to respective four drafting units (not shown) in the roving frame 2 via a creel not shown in FIG. 2 but shown by a reference numeral 14 in FIG. 4.

Connected to the full can supply conveyor 4 is a conveyor 6*a* arranged between the rows A and B for supplying and exchanging cans for the rows A and B and a conveyor 6*b* arranged between the rows C and D for supplying and exchanging cans for the rows C and D. Connected to the full can exchanging conveyors 6*a* and 6*b* is a conveyor 7 for returning consumed cans replaced by the full cans toward the drawing frame 1 as shown by an arrow b. These conveyors 4, 6*a*, 6*b* and 7 are constructed as roller conveyors having a plurality of parallel rolls.

It should be noted that a step like consumption of the slivers in the cans is done between the rows A, B, C and D. Namely, the amount of the consumption of the slivers at a selected time is changed under a step like manner between the rows A, B, C and D. Thus, the cans in one of the rows A, B, C and D, which are nearly completely consumed, are replaced by new, full cans 5X. The full cans 5X from the drawing frame 1 are supplied from the conveyor 4 to the full can changing conveyor 6*a* between the rows A and B for the supplied cans or to the full can changing conveyor 6*b* between the rows C and D for the supplied cans. A can exchanger 8 is provided, as will be fully explained later, for executing the exchanging operation for replacing the consumed cans in the row A, B, C or D by full cans 5X on the conveyor 6*a* or 6*b*. FIG. 2 shows a state where slivers in one of the rows A, B, C and D are nearly fully consumed, and full cans 5X, which are necessary for replacing the all of the cans in the consumed row, are assembled to create a row Xa or Xb of the full cans 5X on the full can exchanging conveyor 6*a* between the supply can rows A and B or on the full can exchanging conveyor 6*b* between the supply can rows C and D. As shown in FIG. 2, sets of spaced apart stopper pins 4-1 are provided for the full can exchanging conveyor 6*a* for the rows A and B of the supplying cans and for the full can exchanging conveyor 6*b* for the rows C and D, respectively. Solenoid mechanisms (not shown) are provided for the stopper pins 4-1, which are extended to engage the full can at the front end of the row Xa or Xb for obtaining a desired positional relationship of the full can row Xa or Xb with respect to the consumed can row A, B, C or D. Namely, the stoppers 4-1 function to locate the full can row Xa or Xb with respect to the consumed can row A, B, C or D so that the full can row Xa or Xb is offset with respect to the consumed can row A, B, C or D for a length corresponding to one pitch. It should be noted that stoppers 4-1 can be provided in the conveyors 6*a* and 6*b* at locations corresponding to each of the feeding cans in the rows A, B, C and D.

In FIG. 2, the can exchanger 8 is capable of being moved along the row of cans for the slivers, and executes a progressive replacing operation for replacing, by full cans from the conveyor 6*a* or 6*b*, consumed cans on the row A, B, C or D from the one located at the top of the row. The detailed construction of the can exchanger 8 will be explained later. Furthermore, a lifter (not shown) is provided for obtaining a desired "rotary" movement of the can exchanger 8 between 180 degree opposite positions, so that a single set of operating mechanisms for executing the can replacing operation, which is provided on only one side of the can exchanger 8, is sufficient for executing a desired can replacing operation wherein the consumed sliver cans on the rows A or B can be replaced by the full cans on the single row Xa, or the consumed sliver cans on the rows C or D can be replaced by the full cans on the single row Xb. Namely, the replacement of the consumed cans on the row A or C is commenced from its left-handed end by moving the exchanger 8 in the right handed direction as will be explained later. In this case, the initial position of the row Xa or Xb of the full cans 5X is determined by the stoppers 4-1, so that the full can row Xa or Xb is offset in the right handed direction for the length of one pitch with respect to the consumed can row A or C. Contrary to this, the replacement of the consumed cans on the row B or D is commenced from its right-handed end by moving the exchanger 8 in the left handed direction. In this case, another set of stoppers (not shown) is provided for determination of the initial position of the row Xa or Xb, so that the full can row Xa or Xb is offset in the left handed direction for the length of one pitch with respect to the consumed can row B or D.

FIG. 3 schematically illustrates how an operation for replacing consumed cans on the row A by full cans on the row Xa located between the rows A and B of the supplying cans. In FIG. 3-(*a*), the can exchanger 8 is moved to a position $P_0$, where the exchanger 8 is located slightly forward of the full can row Xa on the conveyor 6*a*. The full can row Xa is located offset, in the right-hand direction, by one pitch length (substantially equal to the diameter of a can) with respect to the row A or B of cans being supplied.

In a condition in FIG. 3-(*b*), the can exchanger 8 is moved, as shown by an arrow $f_1$, toward the full can row Xa to a position $P_1$, where the front half portion of the exchanger 8 stores therein the can 5X-1 at the front end of the row Xa. As will be explained later, the can exchanger 8 is constructed as a bottom less type, so that a mere forward movement of the exchanger 8 allows the can 5X-1 to be housed by the exchanger 8.

In a following phase of operation as shown in FIG. 3-(*c*), the consumed can 5A-1 at the front end of the row A is introduced into another half part of the can exchanger 8 in a direction as shown by an arrow $f_2$, which is transverse to the direction of the length of the roving frame 2. Such a movement of the consumed can is done by an working means provided in the exchanger 8 as will described later. It should be noted that such a movement of the consumed can 5A-1 is done without stopping a supply of the sliver from the can 5A-1 to the corresponding drafting unit. In other words, the can replacement operation is done while a spinning operation is continued.

A piecing operation of the sliver from the full can 5X-1 to the sliver 5A-1 fed from the consumed can 5A-1 to the corresponding drafting unit is done at the can exchanger 8 according to the principle as described with reference to FIG. 1, where the slivers from the cans 5A-1 and 5X-1 are combined with a draft of 2.0, while the combined sliver is passed through a throttle and is subjected to a rubbing movement, the details of which will be explained later.

In FIG. 3-(*d*), after the piecing operation, the consumed can 5A-1 is delivered from the can exchanger 8 as shown by an arrow $f_3$, and the full can 5X-1 now feeding the pieced sliver to the corresponding drafting unit of the roving frame is moved to the front half part of the exchanger as shown by an arrow $f_4$. Then, as shown in FIG. 3-(*e*), the full can 5X-1 is moved in a direction transverse to the length of the roving frame 2 as shown by an arrow $f_5$, to the front position of the row A previously occupied by the consumed can 5A-1.

FIG. 3-(*f*) shows a commencement of an operation for replacing the second, consumed can 5A-2 in the row A by a second full can 5X-2 in the row Xa. Namely, one pitch movement of the can exchanger 8 to a position $P_2$ is obtained, where the second can 5X-2 in the row Xa is housed in the exchanger 8. The process described in FIGS. 3-(*c*) to (*e*) are repeated for replacing the second consumed can 5A-2 in the row A by the second full can 5X-2 in the row Xa. Namely, the second consumed can 5A-2 is taken into the can exchanger 8 in front of the full can 5X-2, then, the piecing operation slivers from the can 5A-2 and 5X-2 is done, the consumed can 5A-2 is moved out of the exchanger 8, and the full can 5X-2 is moved to the location previously occupied by the consumed can 5A-2 in the row A. These steps further repeated until all of the consumed cans in the row A are replaced by the full cans on the row Xa.

The above operation is directed to a replacing operation of the consumed can 5*a* in the row A by the full can 5X-1 in the row Xa between the rows A and B. A similar operation is done for replacing a can in the row B by a full can. In this case, a 180° reversal of the position of the can exchanger 8 is obtained from the position as shown in FIG. 3, which allows the same working elements as described later to be commonly used for executing the replacing operation of cans on the row B by the full can on the row Xa. It should, however, be noted that, as an alternative, a separate exchanger may be provided for executing the replacing operation for the row B and D.

In FIG. 2, consumed cans 5C or 5D on the row C or D are replaced by full cans 5X on the row Xb, in the same way as explained with reference to FIG. 3.

Figure 4:
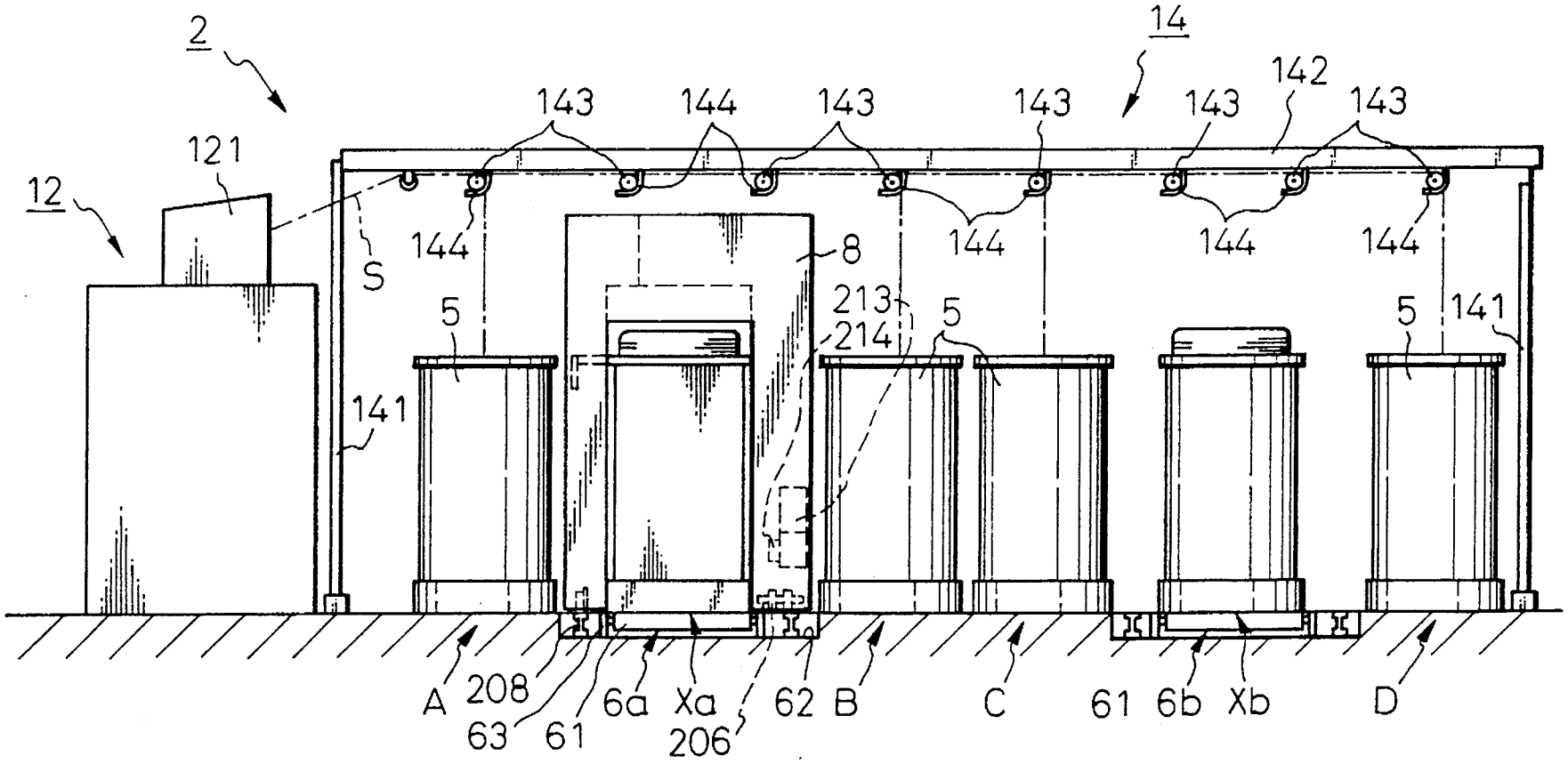
FIG. 4 is a side elevational view illustrating an arrangement of cans along a direction transverse to a row of cans.

Next, an actual construction of the device executing the replacement of cans realizing the principle as explained with reference to FIGS. 1 to 3 will now be explained. In FIG. 4, the roving frame 2 realized as a flyer frame includes a main stand 12 and a creel 14. The main stand include a casing 121, in which draft parts are stored for corresponding cans 5, so that slivers from the respective cans are subjected to a drafting process, and wound on respective bobbins (not shown) via respective flyers (not shown). As illustrated in FIG. 2, these cans 5 form, along the length of the frame, rows A, B, C and D. Furthermore, a row Xa of full cans is located between the rows A and B of cans supplied to the roving frame, and a row Xb of full cans is located between the rows C and D of supplied cans. The creel 14 includes upright pillars 141 having bottom ends connected to a floor, beams 142 connected to upper ends of the pillars 141, lifting rollers 143 rotatably mounted to the beams 142, and guides 144 arranged adjacent the lifting rollers 143. As well known, the slivers S from the cans 5 are supplied to respective drafting units via the guides 144 and the lifting rollers 143.

The can exchanger 8 is, in FIG. 4, shown to be located in a position between the rows A and B of the cans 5 being supplied. As explained with reference to FIGS. 2 and 3, the can exchanger 8 is arranged to move along the length of the roving frame 2 between the rows A and B or rows C and D, so that the full cans are taken from the row Xa or Xb on the full can exchanging conveyor 6*a* or 6*b*, and so that consumed cans in a row are, from the front end of the row, progressively replaced by the full cans.

Figure 5:
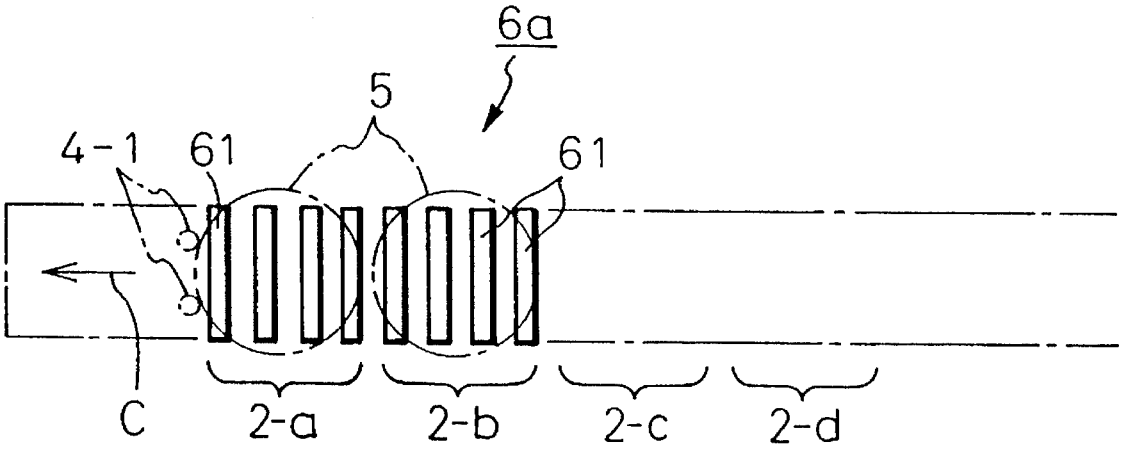
FIG. 5 is a schematic view illustrating a construction of a can conveyor.

As shown in FIG. 5, the full can exchanging conveyor 6*a* (same as to the conveyor 6*b*) includes a plurality of parallel and spaced rollers 61. Each of the rollers 61 has an axis of rotation which extends transverse to the direction of the movement of cans as shown by an arrow c. A can 5 can be supported by a plurality of the rollers 61 (for example, four rollers 61). Thus, a plurality of sets of four rollers 2-*a*, 2-*b*, 2-*c*, and 2-*d*, et al, are provided, so that each of set is connected to a respective independent drive motor means.

Figure 6:
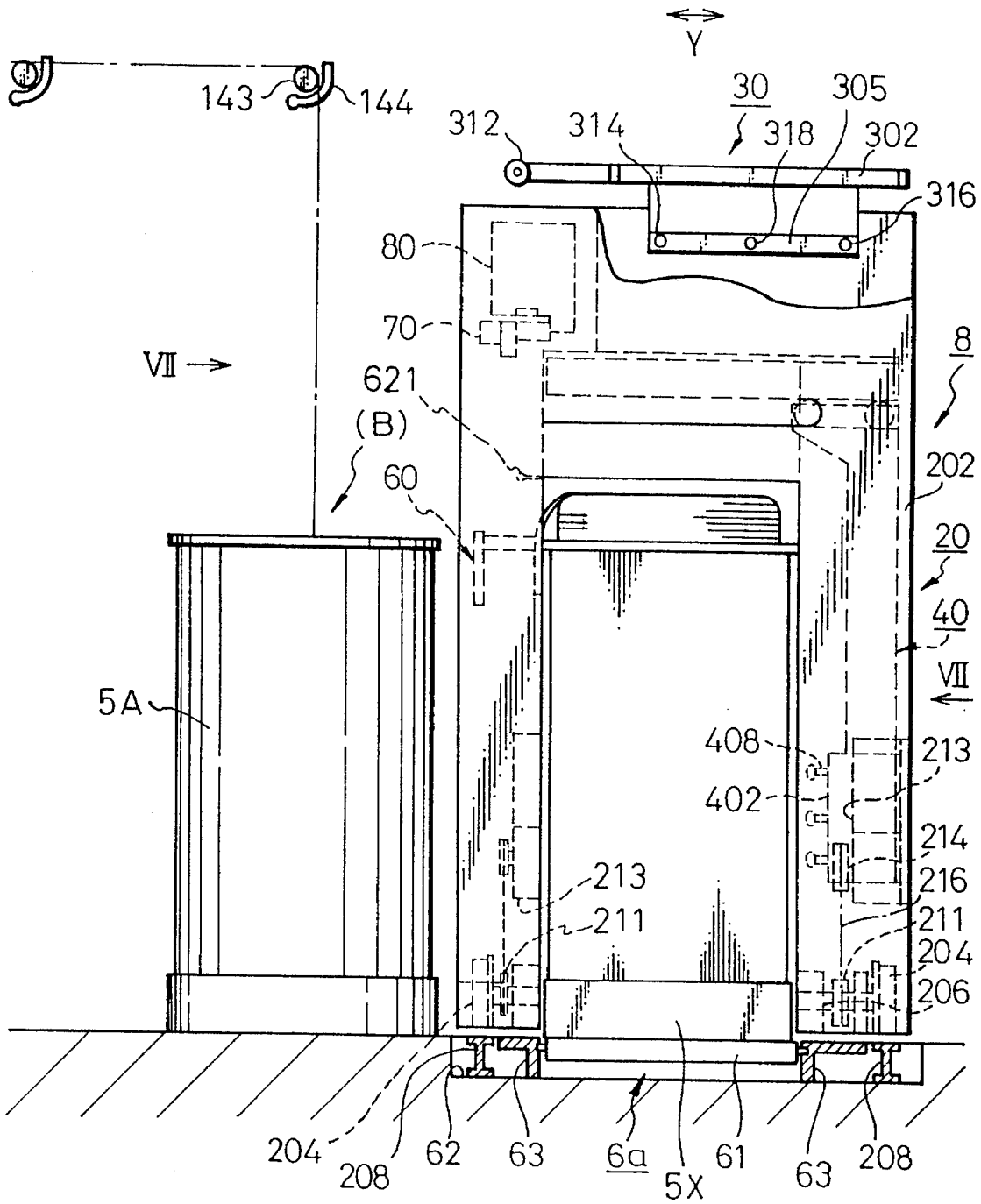
FIG. 6 shows an enlarged view of the can exchanger and the can located adjacent the roving frame.

As shown in FIG. 6, the floor forms a longitudinal recess 62 extending transverse to the plane of the paper, in which the conveyor 6*a* is stored. A similar longitudinal recess is also provided for storing the conveyor 6*b* as shown in FIG. 4. As shown in FIG. 6, arranged in the longitudinal recess is a pair of laterally spaced apart supporting frames 63, to which the rollers 61 are, at their opposite ends, rotatably supported. The rollers 61 have upper peripheral surfaces which are substantially coplanar with respect to the floor surface, which allows the cans to be moved along the direction transverse to the rows of the cans. Namely, the cans can be moved between the floor and the rollers 61 in the direction of the axis of the rollers 61. Suitable means such as rotor motors or a combination of a motor and chains, which are not shown for the sake of the simplicity of the drawing, are employed for obtaining a rotating movement of the rollers 61. Finally, the supporting members 63 can be provided with guide means for guiding the cans.

In FIG. 7, the can exchanger 8 includes: a carriage 20 with no bottom; a sliver guide unit 30 for guiding a sliver from a consumed can 5 when the can is taken into the can exchanger 8 which is to be replaced by a full can 5X; a can exchanging unit 40 for obtaining the taking-in movement of the consumed can 5 into the carriage 20 and for delivering the full can 5X after the exchanging operation into the position previously occupied by the consumed can 5; sliver end pickup unit 60 for picking up an end of a sliver from the full can 5X; a sliver feeding unit 70 for nipping the picked up sliver and for feeding the end of the nipped sliver so as to be combined with a sliver from the consumed can 5; a sliver end formation unit 78 for obtaining a pointed paint brush shape at a broken end of the nipped sliver projected from the feeding unit 70; a chute 79 for receiving a waste sliver dropped during the formation of the pointed paint brush shape of the broken end of the nipped sliver and for directing the wasted sliver into the consumed can 5; a sliver piecing unit 80 for holding the sliver supplied from the consumed can to the corresponding drafting unit (not shown) of the roving frame, for combining, with the sliver nipped by the sliver piecing unit 80, the sliver from the full can 5X fed by the feeding unit 70, so that a draft of a predetermined ratio is applied to the combined slivers while preventing an unevenness from being created in the thickness of the combined slivers, and for imparting a rubbing movement to the combined sliver, and; a sliver breaking unit 90 for breaking the sliver from the consumed can after the completion of the piecing operation.

Figure 8:
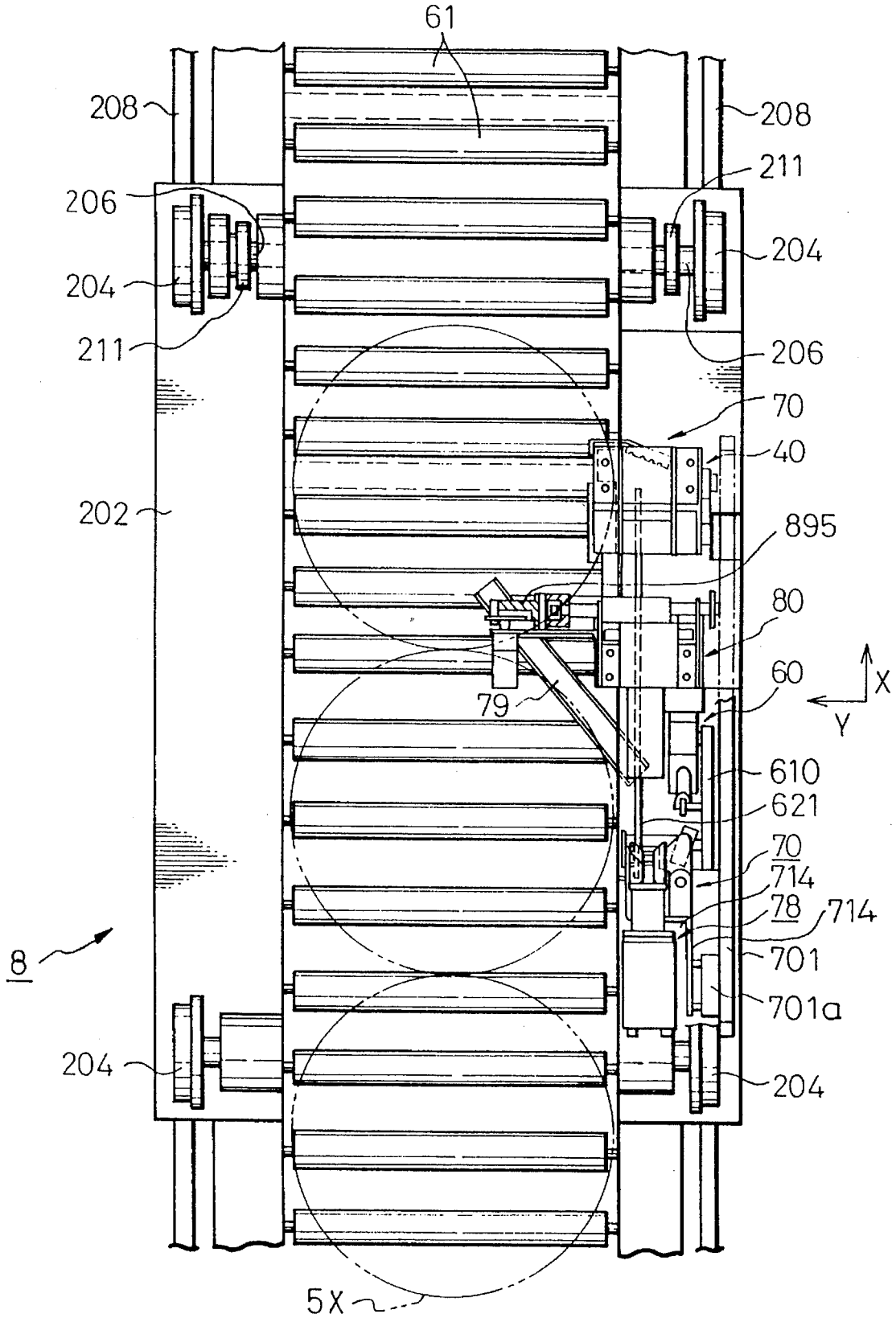
FIG. 8 is a plan view of the can exchanger without a portion of the frame of the can exchanger.

As shown in FIG. 6 and 7, the carriage unit 20 includes a frame 202 of substantially rectangular box shape having an opened bottom. As shown in FIG. 8, the frame 202 is provided, at its four corners, at its bottom, with wheels 204 which have shafts 206 which are rotatable with respect to the frame 202 by means of suitable bearing units. As shown in FIG. 6, at the groove 62 on the floor, a pair of rails 208 extend along the direction of the length of the stand of the roving frame, on which rails 208 the wheels 204 move, which allows the can exchanger 8 to move along the length of the rails 208. As shown in FIG. 8, mounted on the shafts 206 of one of the sets of the wheels 204 are pulleys 211, which are, as shown in FIG. 6, drivingly connected, via respective belts 216, to pulleys 214 on shaft of respective rotary electric motors 213. As a result, synchronized rotating movements of the shafts of the respective motor 213 are independently transmitted to the respective wheels 204, which allows the carriage unit to be moved on the rails 208.

Figure 9:
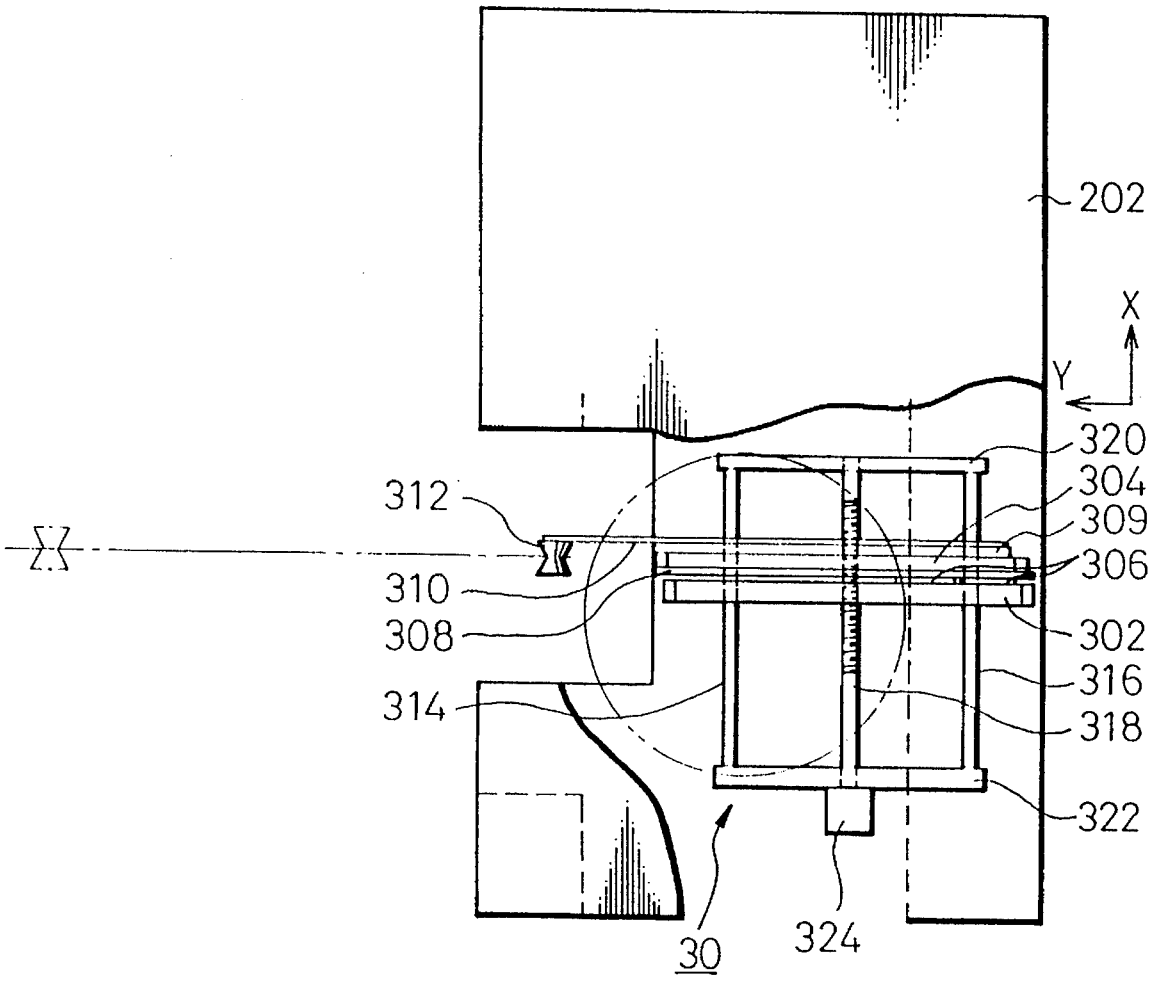
FIG. 9 illustrates a plan view of a sliver guide unit in the can exchanger, the sliver guide unit being in its retracted condition.
Figure 10:
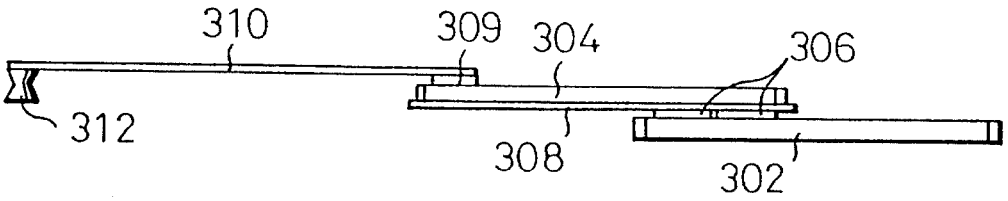
FIG. 10 shows only elements for guiding a sliver in the sliver guide unit in FIG. 9 when it is an extended condition.

As shown in FIGS. 6 and 7, the sliver guide unit 30 is arranged at the top of the frame 202, and includes, as shown in FIG. 9, a first rod-less cylinder assembly 302 and a second rod-less cylinder assembly 304. The first rod-less cylinder assembly 302 has a body to which a bracket 305 (FIG. 6) is, at a lower side of the body, fixedly connected, and has a movable member (not shown) connected to a pair of connecting members 306, to which a plate 308 is connected as shown in FIGS. 9 and 10. The second rodless cylinder assembly 304 has a body connected to the plate 308 and a movable member (not shown) connected to a connecting member 309, to which a guide rod 310 is connected at its one end. Connected to the other, free end of the guide rod 310 is a guide roller 312 of a V shaped cross section which is freely rotatably about its own axis. As shown in FIG. 6, the bracket 305 is a plate member which extends along the length of the cylinder assemblies 302 and 304. Connected slidably along a direction (X) transverse to the direction (Y) of the length of the cylinder assemblies 302 and 304 are a pair of parallel guides 314 and 316. Furthermore, arranged in parallel with respect to the guide rods 314 and 316 is a driving rod 318, which has a central, screw thread portion, which is under a screw engagement with a screw bore formed in the bracket 305. As shown in FIG. 9, the guide rods 314 and 316 are, at their ends, fixedly connected to a pair of brackets 320 and 322 which are spaced along the direction X. Contrary to this, the driving rod 318 has opposite ends which are connected freely rotatably with respect to the brackets 320 and 322, respectively. Furthermore, the one of the ends of the driving rod 318 projects from the bracket 322 and the projecting end is connected to a driving shaft of a rotary electric motor 324.

A rotational movement occurring at the rotating shaft of the electric motor 324 causes the driving rod 318 to be rotated, resulting in a linear movement in the direction X (the direction of the movement of the can exchanger 8) of the movable bracket 305 screw engaged with the driving rod 318 as well as the first rod-less cylinder 302 connected to the movable bracket 305 and the second rod-less cylinder 304 connected to the first rod-less cylinder 302. As a result, the guide rod 310 together with the guide roller 312 at its free end moves along the direction X in FIG. 9 (the direction of the movement of the can exchanger 8 along the length of the roving frame 2). Such a movement of the guide roller 312 along the direction X is necessary in order to cause the guide roller 312 to engage with a sliver from a consumed can when it is required to take the consumed can into the can exchanger 8 to replace it by a full can. Namely, a supply of a pneumatic pressure to the rod-less cylinders 302 and 304 causes the guide rod 310 together with the guide roller 312 to be moved in the direction transverse to the length of the roving frame (the direction Y in FIG. 9). Such a movement of the guide roller 312 along the direction Y combined with the movement thereof along the direction X by means of the rotation of the motor 324 allows the guide roller 312 to be selectively engaged with a sliver from a consumed can as will fully described later. The provision of the first and second rodless cylinders 302 and 304, which are connected in series, allows an increased movement along the direction Y. FIG. 10 illustrates the full stroke position, where both of the first and second rod-less cylinders 302 and 304 are fully extended.

Figure 11:
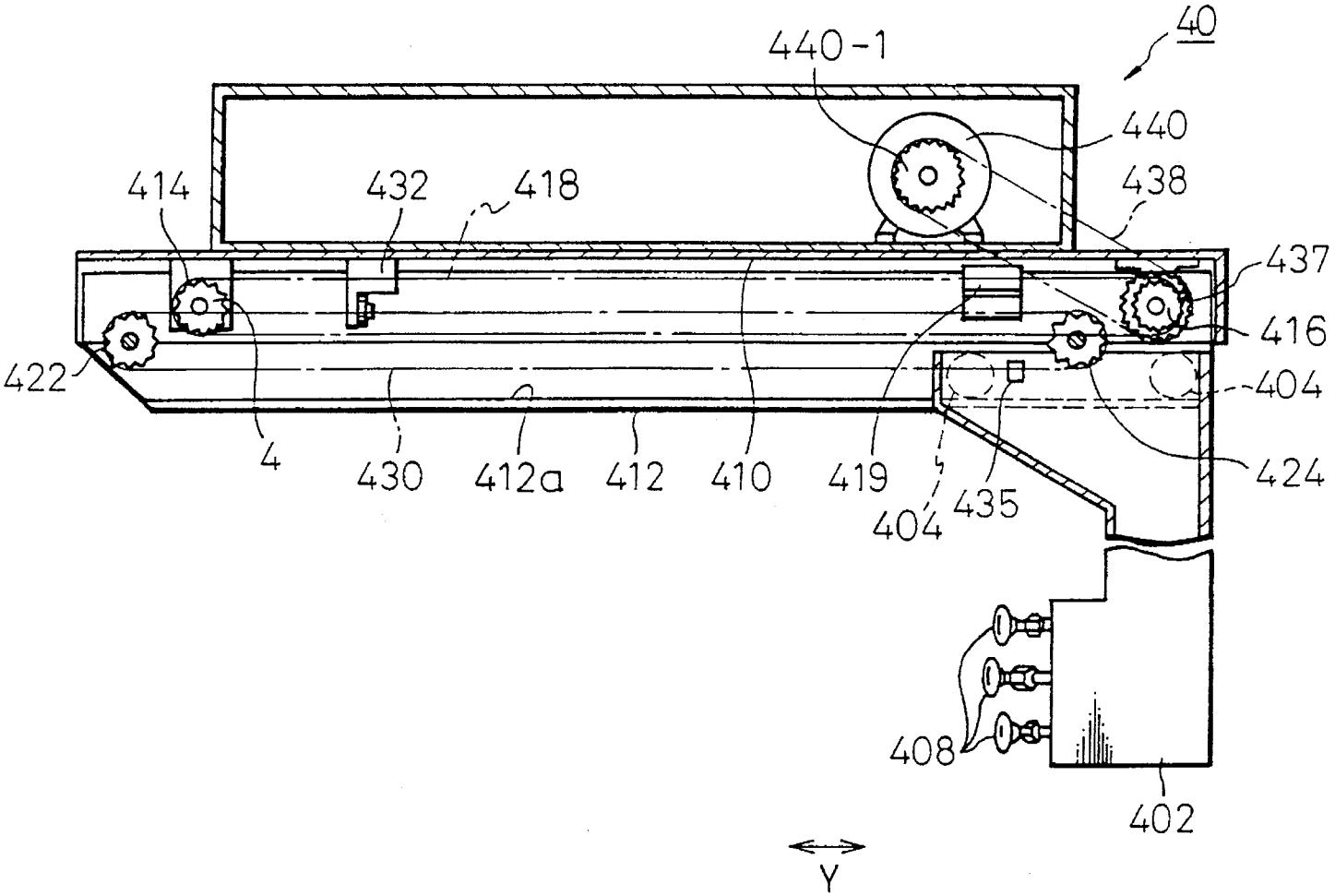
FIG. 11 is a cross sectional view of a can exchanging unit when it is in a retracted condition.
Figure 12:
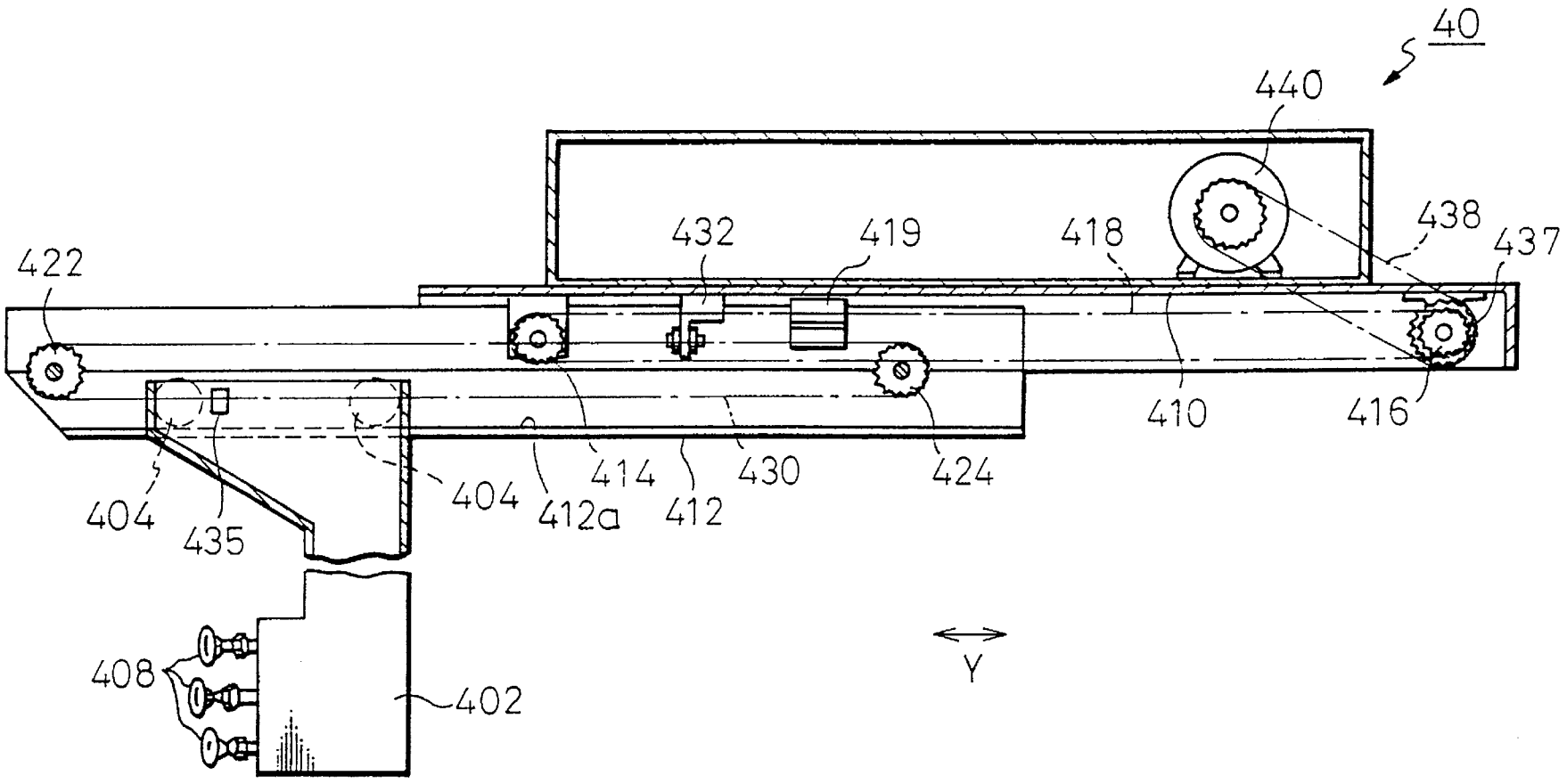
FIG. 12 is a cross sectional view of the can exchanging unit when it is in an extended condition.

The can exchanging unit 40 shown in FIGS. 6 and 7 is for taking a consumed can into the can conveyor 8 from the row A, B, C or D, and for introducing a full can from the full can exchanging conveyor 6*a* or 6*b* to the location previously occupied by the taken, consumed can. The detail of the unit 40 is shown in FIGS. 11 and 12 in the form of a type using a vacuum force for holding a can, which is, for example, disclosed in the Japanese Un-Examined Patent Publication No. 1-55183 owned by the same assignee. Namely, the can exchanging unit 40 includes a holder frame 402 which is moved toward or away with respect to a can to be treated along the direction transverse to the direction of the row of cans. The holder frame 402 is, at its top sides, provided with pairs of spaced guide rollers 404. The holder frame 402 is, at its lower part, provided with a plurality of suckers 408 which are adapted to face a can to be treated. The suckers 408 are connected to a sucking source such as a vacuum pump (not shown), which allows the suckers 408 to hold a can by a vacuum force when a taking-in operation of a consumed can or a delivering operation of a full can is executed. A double stroke mechanism is provided for obtaining a movement of a can to be treated along a direction which is transverse to the rows of cans. This mechanism includes a fixed frame 410 of a cross section of an angular U-shape, which extends in the direction Y transverse to the direction X of rows of cans, and a movable frame 412 which also extend in the direction Y and which is movable with respect to the fixed frame 410 in the direction Y. The movable frame 412 is slidably housed in the fixed frame 410, which allows the movable frame 412 to be moved along the direction Y transverse to the direction X of the rows of cans. The movable frame 412 is provided with a pair of guide rails 412*a* (FIG. 7) extending in the direction Y transverse to the rows of cans, which are spaced in the direction X parallel to the rows of cans. The guide rollers 404 at the top of the holder frame 402 are arranged on respective guide rails 412*a*, so that the holder frame 402 is horizontally movable with respect to the movable frame 412 in the direction which is transverse to the rows of cans.

As shown in FIG. 11, the fixed frame 410 is provided with a pair of sprocket wheel assemblies 414 and 416 which are spaced in the direction Y transverse to the rows of cans. A chain 418 is arranged between the sprocket wheels 414 and 416. An attachment member 419 is provided for connecting opposite ends of the chain 418. The attachment member 419 is fixedly connected to the movable frame 412 by means of a suitable fixing means, so that the movement of the chain 418 by a rotation of the sprocket wheels 414 and 416 causes the movable frame 412 to be moved along the direction Y. The movable frame 412 is provided with a pair of sprocket wheels 422 and 424 which are spaced along the direction Y, which are engaged by a chain 430, which has opposite ends connected by an attachment member 432 fixed to the fixed frame 410 to create an endless loop of the chain 430. An attachment member 435 is provided for fixing the chain 430 to the holder frame 402. Furthermore, the sprocket 416 has an axis to which another sprocket 437 is provided, which is in connection with a drive shaft of an electric motor 440 via a sprocket 440-1.

A rotating movement of the electric motor 440 is transmitted, via the sprocket 440-1, the chain 438, the sprocket 437, and sprocket 416, to the chain 418, which causes it to be horizontally moved. The provision of the attachment member 419 for fixing a portion of the chain 418 with the movable frame 412 cause the latter to be moved along the direction Y for the amount corresponding to the rotating angle of the outlet shaft of the motor 440. Furthermore, the movement of the movable frame 412 causes the chain 430 to be moved via a rotation of the sprocket wheels 422 and 424 due to the provision of the attachment member 432 for fixing a lower side portion of the chain 430 to the holder frame 402. As a result, the movement of the holder frame 402 is twice the amount of the movement of the movable frame 412 induced by the rotation of the drive shaft of the motor 440. Such a double stroke movement is effective for obtaining a desired movement of the holder frame 402 for executing the can exchanging operation by means of a reduced size unit 40. FIG. 12 illustrate a condition of the can exchanging unit 40 where the holder frame 402 is fully extended, where the suckers 408 contact with a can (not shown in FIG. 12) to be treated.

In FIG. 7, the sliver end pick-up unit 60 is picking up an end of a sliver from a full can taken into the can exchanger 8, and includes a rod-less cylinder 601 having a body portion supported on a supporting member connected to a frame 202 at a suitable location and a moving part 604 connected to an L shaped nozzle support member 608 which is arranged vertically. At an upper end of the nozzle support merrier 608, an arm 610 is, at its bottom end, rotatably connected by means of a pin 610-1. A cylinder 612 is provided having a body portion connected to the nozzle support member 608 and a rod portion connected to the arm 610 at a location adjacent the pin 610-1. This construction allows the arm 610 to be rotated about the axis of the pin 610-1 when the piston rod is extended. The arm 610 is, at its top end, provided with a sliver end pick-up nozzle 614, which is opened at the end facing the cans. Provided at the open end of the pick-up nozzle 614 is a net engaging with a sliver being sucked and a detector (not shown) for detection if a sliver being sucked is picked up. The pick-up nozzle 614 is connected, via a hose 616 in FIG. 21 and a valve (not shown), to a suction source, such as a suction pump (not shown). Furthermore, the supporting member for supporting the nozzle 614 is reciprocated as shown by arrows $e_1$ and $e_2$ in the direction Y which is transverse to the direction X of the rows of cans. As shown in FIG. 8, the sliver end pick-up unit 60 together with the sliver feed unit 70 and the sliver piecing unit 80 are arranged on one side of the frame 202 of the can exchanger 8 spaced from the center axis. In order to bring the picked up end of the sliver to a desired, proper location in the sliver feed unit 70 and the sliver piecing unit 80, irrespective of the offset arrangement thereof, a guide rod 621 extends along the direction parallel to the direction X of the movement of the can exchanger 8 at side adjacent the units 60, 70 and 80. The guide 621 is for assisting the picked up sliver to be moved up at a location outside the guide 621 when the pick-up unit 60 is elevated toward the sliver feed unit 70 during the piecing operation. Namely, during the movement of the sliver picked up by the nozzle 614 of the sliver pick-up unit 60, the nozzle 614 is, first, moved in the direction as shown by the arrow $e_1$ in FIG. 21 to a position outside the guide plate 621. Then, the nozzle 614 holding the sliver $S_2$ by its sucking force is moved upwardly by means of the cylinders 601 and 612 in FIG. 7. This allows the sliver to be guided by the guide rod 621 so that the sliver is moved upwardly along a desired path toward the sliver feed unit 70 and the sliver piecing unit 80.

When an end of the sliver from a full can 5X is picked up by means of the sliver end pick-up unit 60, the pick-up nozzle 614 is situated, as shown in the solid line in FIG. 21, to face a free end of the sliver. Namely, from a full can 5X-1, the free end of the sliver $S_2$ is dangled, and a positioning means (not shown) of the full can is provided for obtaining the faced position of the dangled end of the sliver $S_2$ with the nozzle 614. Thus, the communication of the nozzle 614 with the vacuum source (not shown) automatically causes the sliver end to be sucked and held by the nozzle 614. A supply of the compressed air to the cylinder 620 causes the nozzle 614 to be moved in the direction as shown by the arrow $e_1$ to a position outside the guide bar 621. Then, compressed air is supplied to the cylinder 612 in FIG. 7, which causes its moving part 604 to be moved upwardly, so that the supporting member is also moved upwardly, while sliver is sucked and held by the nozzle 614. Then, the compressed air to the cylinder 620 in FIG. 21 is again controlled so that the nozzle 614 is moved in the direction as shown by the arrow $e_2$ to a position as shown by a dotted line 614'. This position corresponds to the position in FIG. 32 for preparing the sliver $S_2$, from a full can, to be nipped by the sliver feed unit 70. In place of picking up the sliver end dangling from the upper edge of a can as explained above, the sliver end pick-up unit 60 can operate to pick up an end of the sliver located at the center of a can. Furthermore, any other type of sliver end pick-up unit other than using a vacuum can be employed.

Figure 13:
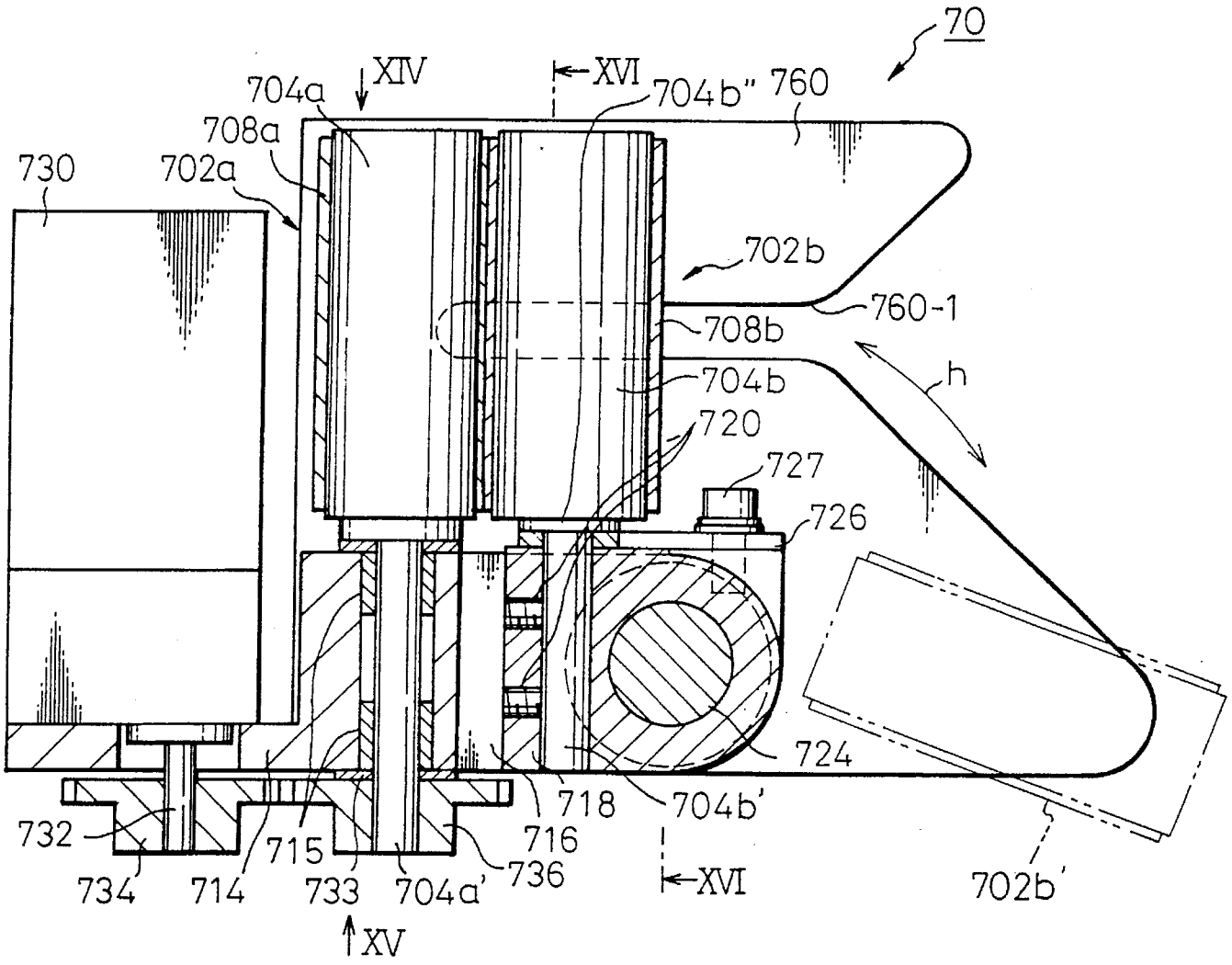
FIG. 13 is a cross-sectional view of a sliver feed unit.
Figure 14:
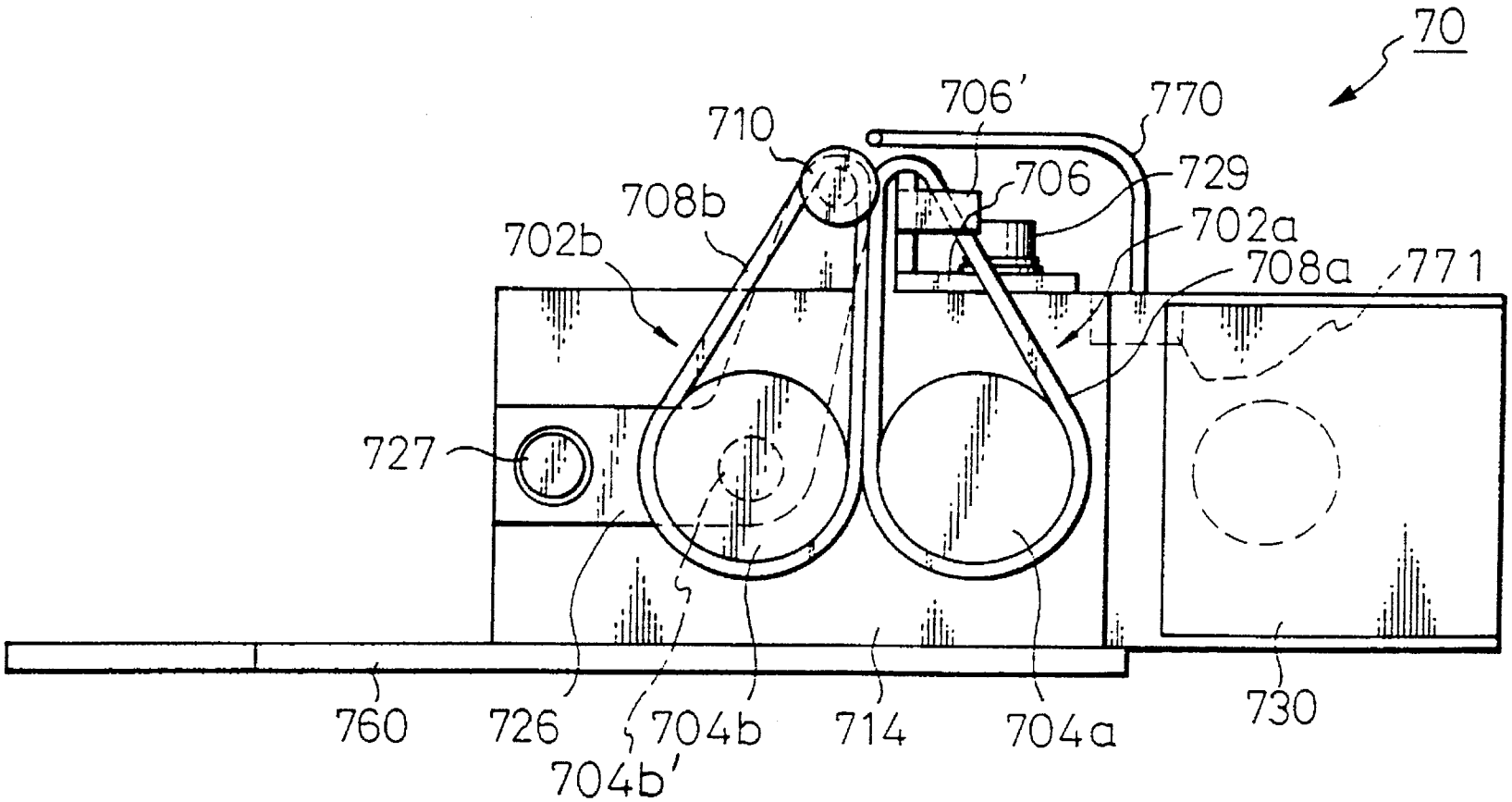
FIG. 14 is view taken along line XIV in FIG. 13.
Figure 15:
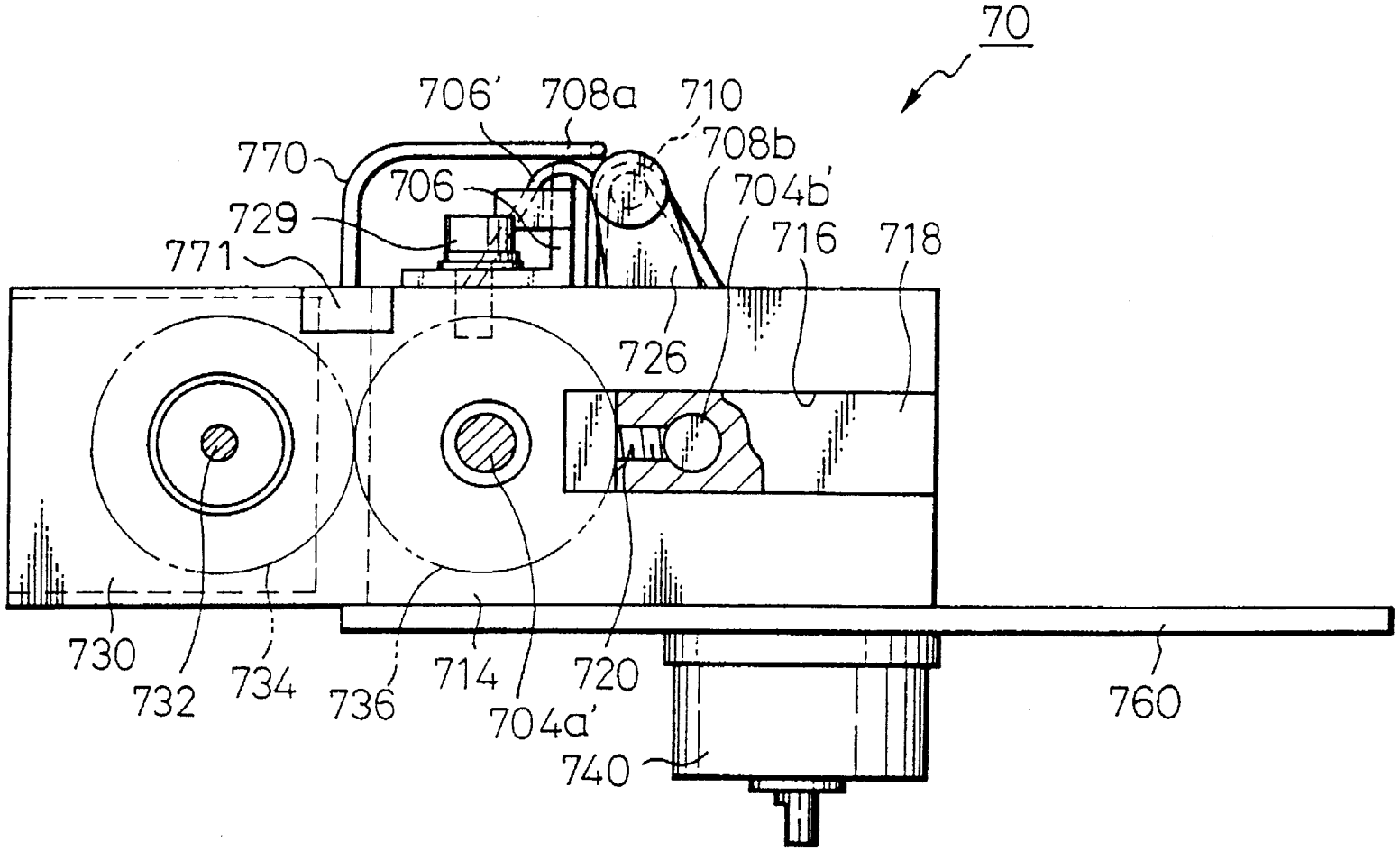
FIG. 15 is view seen as shown by an arrow XV in FIG. 13.
Figure 16:
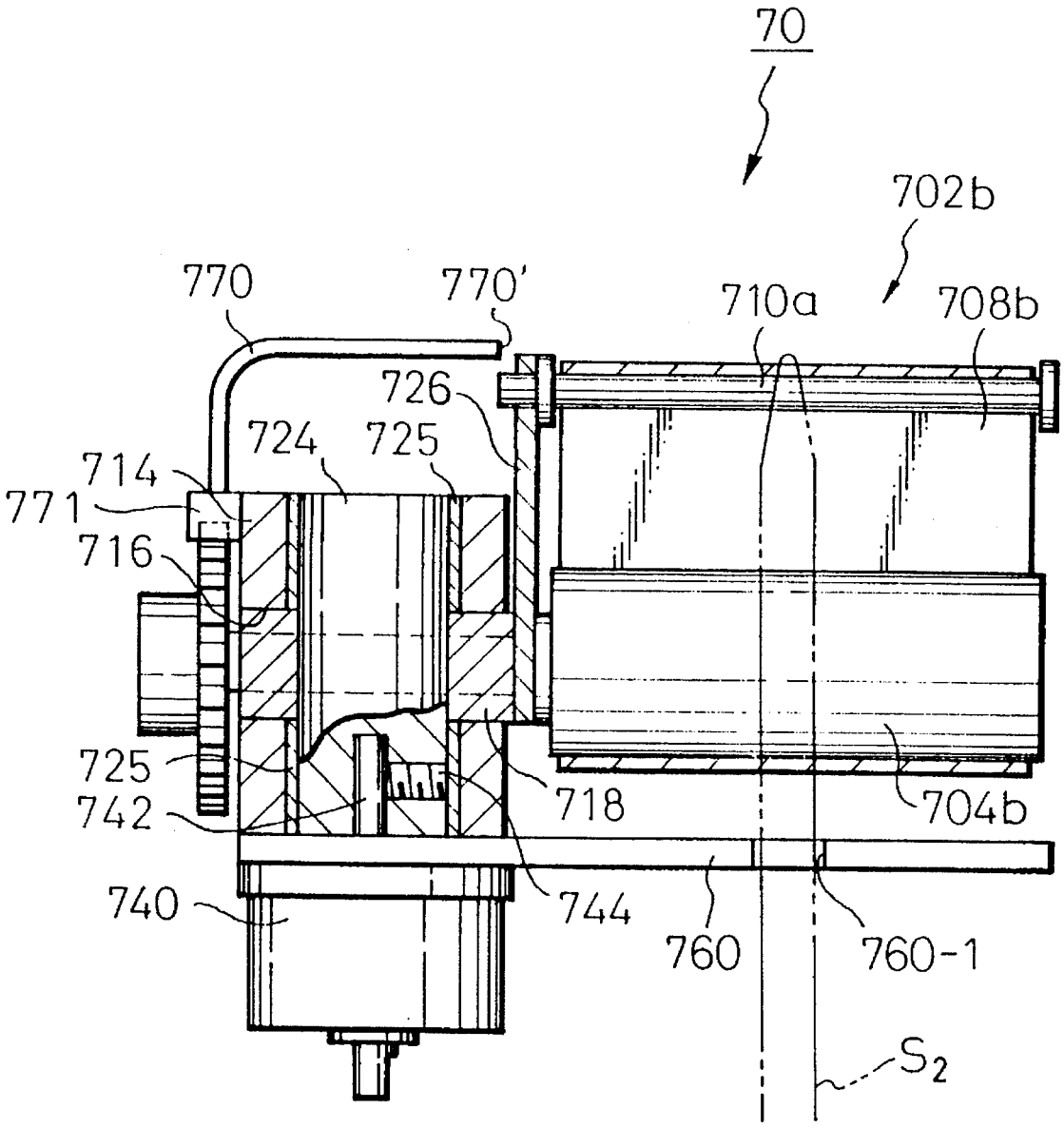
FIG. 16 is view taken along lines XVI—XVI in FIG. 13.

In FIG. 7, the sliver feed unit 70 is holding a sliver picked up by means of the sliver end pick-up unit 60 and supplying the sliver to the piecing unit 80. As shown in FIGS. 13 to 16, the sliver feed unit 70 includes a pair of apron roller assemblies 702*a* and 702*b*, the latter roller assembly 702*b* is swingable with respect to the former roller assembly 702*a*. As best shown in FIG. 14, the first roller assembly 702*a* is constructed by a roller 704*a*, an apron position controller member 706 of an L cross sectional shape, and an apron 708*a* looped between the roller 704*a* and the apron position controller member 706. The second roller assembly 702*b* is constructed by a first roller 704*b* of a large diameter same as that of the roller 704*a* of the first roller assembly 702*a*, a second roller of small diameter having flanges at its ends, and an apron looped between the rollers 704*b* and 710. As shown in FIG. 13, a shaft 704*a'* is integrally extending from the roller 704*a* of the first assembly 702*a* and is rotatably supported by a support body 714 by means of a pair of spaced apart metal bearings 715. A shaft 704*b'* which is by means of bearing units (not shown) rotatable with respect to the first roller 704*b* of the second assembly 702*b*. The shaft 704*b'* is extending from the roller 704*b* and is inserted into a corresponding bore in a swing member 718. The shaft 704*b'* is fixedly connected to the member 718 by means of spaced apart screws 720 and as a result, a free rotation of the roller 704*b* with respect to the shaft 704*b'* is obtained. As shown in FIG. 15, the supporting member 714 is formed with a cut out portion 716, which has opposite parallel walls extending parallel to the axis of the rollers 704*a* and 704*b* and spaced in a direction transverse to said axis. The swing body 718 having opposite parallel walls is fitted to the cut out portion 716 so that the parallel walls of the swing body 718 face the respective opposite walls of the cut-out portion 716. As shown in FIG. 16, a pin 724 having an axis extending transverse to the axis of the rollers 704*a* and 704*b* is rotatably mounted with respect to the support body 714 by means of a pair of spaced apart metal bearings 725. The pin 724 is fitted to the swing body 718 so that, as shown in FIG. 13, the rotation of the pin 724 causes the swing body 718 to be swung as shown by an arrow h about the axis of the pin 724 between a first position where the second roller assembly 702*b* as shown by a solid line is in contact with the first roller assembly 702*a* so that a sliver is nipped and fed between the aprons 708*a* and 708*b*, and a second position where the second roller assembly 702*b* is as shown by a solid line 702*b'* spaced from the first roller assembly 702*a*, which allows a sliver to be introduced between the roller assemblies 702*a* and 702*b*.

As shown in FIG. 14, the tension control member 706 has, at its ends, spaced apart guide plates 706', between which the apron 708*b* is guided. The tension control member 706 is arranged on an outer wall of the support body 714 so that the position of the member 706 with respect to the body 714 is adjustable to obtain a desired relationship of the apron 708*a* of the first roller assembly 702*a* with respect to the apron 708*b* of the second roller assembly 702*b*. A bolt 729 is used for fixing the tension control member 706 to the support body 714 when the desired relationship is obtained. Finally, a support plate 726 of substantially L shape is provided, which is rests on the surface of the support body as shown in FIG. 13 so that the roller 704*b* contacts at its end collar 704*b"* the plate 726 and the shaft 704*b'* is inserted through the plate 726. The plate 726 has a first end connected to the support body 714 by means of a screw 727 and a second end to which the second roller 710*a* is rotatably connected.

As shown in FIG. 13, an electric motor 730 is mounted to the supporting body 714 and has an output shaft 732 extending out of the body 714. A pinion 734 is connected to the end of the shaft 732. Another pinion 736 which meshes with the pinion 734 is connected to the end of the shaft 740*a'* projected out of the body 714 . As a result, the rotational movement of the shaft 732 of the motor 730 is transmitted to the drive roller assembly 702*a* via the pinions 734 and 736. As a result, when the first and second roller assemblies 702*a* and 702*b* are in the positions shown by the solid lines in FIG. 13, the rotation of the motor shaft 732 causes a sliver nipped between the assemblies 702*a* and 702*b* to be fed. The electric motor 730 is constructed as a variable speed type, such as servo motor, a stepping motor or an inverter controlled motor. The speed of the motor 730 is, usually, controlled such that a sliver feed speed by the aprons 708*a* and 708*b* conforms with a sliver induction speed by the piecing unit 80, so that no draft is created in a sliver from a full can between the sliver feed unit 70 and the sliver piecing unit 80. When a sliver from a full can via the feeding unit 70 is combined with a sliver from a consumed can at the piecing unit 80, a reduction in the speed of the inlet set of the rollers of the piecing unit 80 occurs to obtain a draft of 2.0. In this situation, a reduction in the speed of the feed unit 70 occurs simultaneously, so that no draft occurs between the sliver feed unit 70 and the sliver piecing unit 80. However, in the period from the time wherein the tip end portion of a sliver of a reduced number of fibers from a full can is engaged with the inlet set of rollers of the sliver piecing unit 80 to the time wherein the said portion of the reduced fibers leaves the inlet set of rollers of the sliver piecing unit 80, the speed of the sliver feed unit 70 is slightly reduced over the intake speed at the sliver piecing unit 80, so that a draft is created between the sliver feed unit 70 and the sliver piecing unit 80, so that a change in the thickness of the fiber reduced portion is made to be gradual, thereby improving the regularity of a sliver after being pieced at the piecing unit 80.

In order to obtain the swing movement of the second roller assembly 702*b* between the closed position in the solid line in FIG. 13 and the opened position as shown by the dotted line 702*b'*, a rotary drive means such as a rotary solenoid 740 is provided as shown in FIGS. 15 and 16. As shown in FIG. 16, the rotary solenoid 740 has a rotating shaft 742 connected to the rocking pin 724 by means of a set screw 744. As a result, a rotary movement of a desired angle is transmitted, via the shaft 742 and the pin 724, to the swing body 718 on which the second roller assembly 702 is mounted. As a result, the angular rotation of the shaft 742 of the rotary solenoid 740 causes the second roller assembly 702*b* to be moved to the closed position as shown by the solid line and to the opened position as shown by the dotted line 702*b'* in FIG. 13.

AS shown in FIGS. 15 and 16, at the bottom of the support body 714, a sliver guide plate 760 is fixedly connected so that the plate 760 extends along a horizontal plane. The sliver guide plate 760 is for guiding a sliver $S_2$ from a full can so that it is directed properly between the first and second roller assemblies 702*a* and 702*b* as shown by a phantom line in FIG. 16. As shown in FIG. 13, the sliver guide plate 760 forms a guide slot 760-1 which extends transverse to the axis of the rollers 702*a* and 702*b*, and which has a widened open end which makes it easy for a sliver $S_2$ from a full can to be introduced into the slot 760-1, as shown in FIG. 16.

As shown in FIGS. 14 and 16, a light detector (light amplifier) 771 is mounted to the supporting body 714. A light guide 770 extends from the light detector 771 to an end 770', which is opened horizontally at a side of the first and second roller assemblies at their upper edges. Inside the light guide, an optical fiber is inserted as a light receiver. A light source (not shown) is arranged at the side opposite the light guide 770, so that the light from the source is introduced into the light guide 770. A change in the amount of the light received by the light guide 770 is detected by the detector 771, so that a projection of a tip end of the sliver $S_2$ of a predetermined length from the upper edges of the first and second roller assembly 702*a* and 702*b* can be detected.

Figure 33:
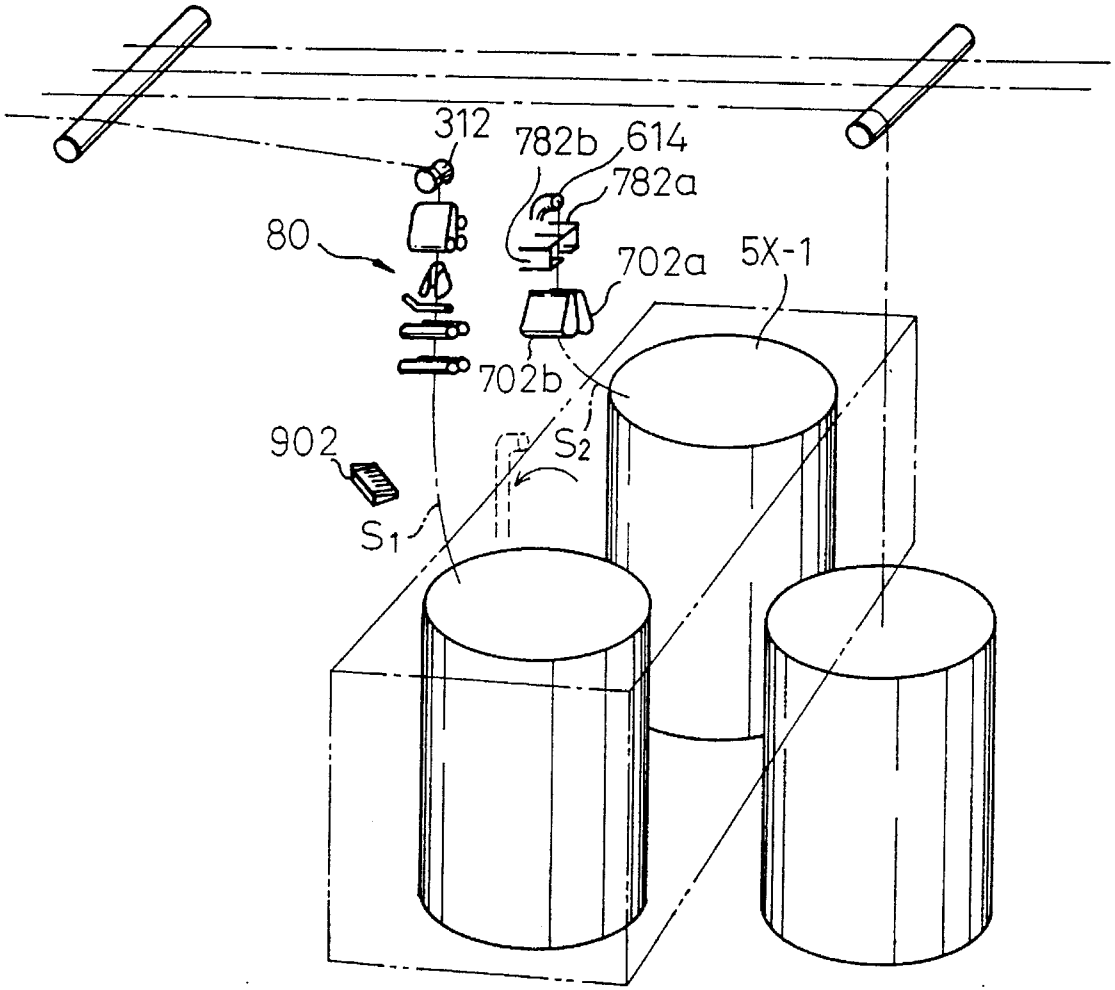

As shown in FIG. 8, the support body 714 of the sliver feed unit 70 is connected to a moving part 701*a* of a rodless cylinder 701 connected to the frame 202 of the carriage unit 20, which allows the sliver feed unit 70 to be reciprocated in the direction X parallel to the rows of cans as shown by an arrow i in FIG. 7. In FIG. 7, the sliver feed unit 70 is in its retracted position. Upon a slider feeding operation, the sliver feed unit 70 is moved forward toward a sliver $S_2$ from a full can while, with respect to the first roller assembly 702*a*, the second roller assembly 702*b* is fully opened as shown in FIG. 17 to a position -where the sliver $S_2$ is guided by the slit 760-1. Finally, the second roller assembly 702*b* is swung so that it is contacted with the first roller assembly 702*a*, thereby the sliver $S_2$ to be nipped between the assemblies 702*a* and 702*b* as shown in FIGS. 16 and 33).

The sliver end formation unit 78 is for obtaining a brush-shaped smoothly-pointed end of a broken end of a sliver $S_2$ from a full can, so that a high quality piecing operation at the piecing unit 80 is always maintained. As shown in FIGS. 7 and 17, the sliver end formation unit 78 is usually at a retracted position slightly above the retracted position of the sliver feed unit 70. The sliver end formation unit 78 includes a supporting body 780 and a cylinder assembly 788 for reciprocating the body 780 in the direction as shown by an arrow i, corresponding to the direction X parallel to the rows of cans. The cylinder assembly 788 includes a support member 787 connected to the frame 202 (not shown in FIG. 17) of the can exchanger, a cylinder body 788 fixedly connected to the support member 787, a piston rod 788*a* and a guide rod 788*b*. Connected to the piston rod 788*a* is a movable member 788*c*, to which the supporting body 780 is connected. As shown in FIG. 18, a pair of spaced apart pieces 783*a* and 783*b* are mounted to a front part of the supporting body 780, in such a manner that the pieces 783*a* and 783*b* are reciprocated in a direction as shown by an arrow b transverse to the direction of the movement of the unit 78 as shown by an arrow i. In order to obtain such a reciprocating movement of the pieces 783*a* and 783*b* a suitable cylinder unit and a link mechanism are provided inside the body 780, which are not shown for the sake of the simplicity of the drawings. As shown in FIG. 19, a pair of nipper elements 781*a* and 781*b* of substantially L cross sectional shape are fixedly connected to the pieces 783*a* and 783*b*, respectively by means of suitable means such as screws. A pair of sliver throttling members 782*a* and 782*b* of a substantially U shape are fixedly connected to the nipper elements 781*a* and 781*b*, respectively by means of suitable means such as screws, in such a manner that the throttling members 782*a* and 782*b* are opened together. As a result, the movement of the pieces 783*a* and 783*b* in the direction shown by the arrow b also causes the throttling member 782*a* and 782*b* to be moved in the same direction. As shown in FIG. 19, the nipper members 781*a* and 781*b* form opposite nipping surfaces 781*a*-1 and 781*b*-1, respectively, which are contacted with each other as shown in FIG. 20 so that a sliver $S_2$ from a full can is nipped between the surfaces 781*a*-1 and 781*b*-1 when the sliver $S_2$ is to be broken. The sliver throttling members 782*a* and 782*b* form, as shown in FIG. 18, at their upper ends, sliver guide portions 782*a*-3 and 782*b*-3, respectively, which are widely opened outwardly for easing the introduction of a sliver. The sliver throttling members 782*a* and 782*b* form, at their lower ends, opposite surfaces constructing throttle portions 782*a*-1 and 782*b*-1, respectively, and sliver guide portions 782*a*-2 and 782*b*-2 which are extending from the throttle portions 782*a*-1 and 782*b*-1, respectively and are outwardly opened for easing an introduction of a sliver. As shown in FIG. 20, a small gap δ is left between the throttling portions 782*a*-1 and 782*b*-1 even in the case where the nipping surfaces 781*a*-1 and 781*b*-1 are in contact with each other for nipping a sliver $S_2$ therebetween. The upper opposite surfaces 781*a*-1 and 781*b*-1 and the lower opposite surfaces 782*a*-1 and 782*b*-1 extend along a plane which is transverse to the plane of FIG. 19 or 20 and which is transverse to a plane for nipping a sliver $S_2$ by means of the roller assemblies 702*a* and 702*b* of the sliver feed unit 70. A reverse rotation of the aprons 708*a* and 708*b* nipping a sliver $S_2$, while the sliver $S_2$ is nipped by means of the sliver nip members 781*a* and 781*b*, causes the sliver to be broken at a location 789 between a nipping point produced by means of the opposite surfaces 781*a*-1 and 781*b*-1 and a nipping point produced by means of the opposite aprons 708*a* and 708*b*. The broken portion S" of the sliver from the nip point 789 becomes waste. Furthermore, the slivers $S_2$ emerged from the aprons 708*a* and 708*b* are widened along the plane of the aprons 708*a* and 708*b* due to a nipping force generated between the aprons 708*a* and 708*b*. However, the provision of the throttling members 782*a*-1 and 782*b*-1 at the small gap δ extending transverse to the plane of the aprons 708*a* and 708*b* allows the sliver $S_2$ to be narrowed to obtain a pointed paint-brush shape at the broken end of the sliver $S_2$.

The cylinder mechanism 786 in FIG. 17 is usually in a retracted position where the piston rod 788*a* is retracted. Upon a sliver feed operation, the piston rod 788*a* is extended toward the sliver $S_2$ in the direction as shown by the arrow i, while the nip members 781*a* and 781*b* as well as the sliver throttling members 782*a* and are opened as shown in FIG. 19, so that the nip members 781*a* and 781*b* and the sliver throttling members 782*a* and 782*b* are situated around the slivers $S_2$ with the assistance of a guiding operation by means of the guide portions 782*a*-3 and 782*b*-3 and the guide portions 782*a*-2 and 782*b*-2. Then, the above mentioned sliver breaking operation and sliver throttling operation are executed.

In FIG. 7, the chute 79 is for receiving a waste S" (FIG. 20) of sliver which is created when obtaining the paint brush shape of the broken end of the sliver $S_2$ from a full can, and for directing the waste S" to a consumed can. The chute 79 is arranged so that it is downwardly inclined toward a consumed can. Namely, the chute 79 has a lower end located above the consumed can taken into the can exchanger 8, and an upper end located below the nozzle 614 of the sliver pick-up unit 60 located at the position shown by the phantom line 614' in FIG. 21, where the sliver $S_2$ from the full can is held between the first and second roller assemblies 702*a* and 702*b* of the feed unit 70. Thus, the waste S" between the nipping members 781*a* and 781*b* as shown in FIG. 20 is dropped to the chute 79 when the nipping members 781*a* and 781*b* are separated, and the vacuum at the nozzle 614 is diminished.

In FIG. 7, the sliver piecing unit 80 is for executing a sliver piecing operation by supplying a sliver $S_1$ from a can to be replaced by a full can, combining the sliver $S_1$ with the sliver $S_2$ fed from the sliver feed unit 70, and applying a draft of 2 times to the combined slivers. As shown in FIG. 7, the sliver piecing unit 80 is basically constructed by a first, stationary roller assembly 801 and a second, movable roller assembly 802 which is horizontally moved with respect to the first roller assembly 801. As shown in FIG. 22, the first roller assembly 801 includes a body 803, to which a first, second and third rollers 804, 806 and 808 are rotatably connected, so that they are spaced apart in parallel as shown in FIG. 26. In comparison with the diameter of the first and second rollers 804 and 806, the diameter of the third roller 808 is increased. In comparison with the spacing between the first and second rollers 804 and 806, the spacing between the second and third rollers 806 and 808 is increased and this allows a throttling nozzle 870 to be arranged between the second and third rollers 806 and 808 as will be fully described later. The distance between the first and the second rollers 804 and 806 is made slightly larger than an average fiber length of fibers constructing a sliver, which allows the sliver to be drafted between the first and second rollers 804 and 806. As shown in FIG. 26, connected to ends of the first, second and rollers 804, 806 and 808 are gear wheels 810, 812 and 814, respectively. The gear wheel 804 on the end of the first roller 804 meshes with an intermediate gear 816, which meshes with a gear 820 on a rotating shaft of a first motor 818. The gear wheels 812 and 814 on the second and third rollers 806 and 808 mesh with a common gear wheel 822, which meshes with a gear 828 on a rotating shaft of a second motor 826. The gear number ratio between the gear wheels 812 and 814 on the second and third rollers 806 and 808, respectively is such that the peripheral speeds of the second and third rollers 806 and 808 are equalized. The control of the first and second motors 818 and 826 is as follows. Namely, before feeding of a sliver from a full can, the rotational speed of the first motor 818 connected to the first roller 804 over that of the second motor 826 connected to the second and third rollers 806 and 808 is such that the peripheral speed of the first roller 804 is equalized to that of the second and third rollers 806 and 808, so that no draft (draft ratio =1.0) occurs in a sliver from a consumed can between the first roller 804, and the second and third rollers 806 and 808. When a sliver from a full can is pieced to the sliver from the consumed can, the rotational speed of the first motor 818 connected to the first roller 804 over that of the second motor 826 connected to the second and third rollers 806 and 808 is such that the peripheral speed of the first roller 804 becomes ½ of that of the second and third rollers 806 and 808, so that a draft (draft ratio =2.0) occurs in a sliver. It should be noted that, upon the reduction in the speed of the first roller 804, a reduction in the speed of the motor 730 in the sliver feed unit 70 is simultaneously occurs. In order to obtain the draft ratio of 2.0 between the first roller 804 and the second roller 806, in place of a reduction of the speed of the first roller 804, an increase in the speed of the second and third rollers 806 and 808 over the speed of the first roller 804 can be used. In this case, a slack would be formed in a sliver from the piecing unit 80 to a corresponding draft unit in a roving frame. In order to absorb such slack in the sliver, a swing lever for guiding the sliver can be arranged on a frame 202, which is returned to a can after the completion of a piecing operation or the slack in the sliver can be absorbed by a spinning operation after a piecing operation.

In FIG. 22, a plurality of parallel, horizontally extending guide rods 830 (two guide rods in the shown embodiment) are fixedly mounted to the body 803 of the first roller assembly 801. The guide rods 830 are for guiding a horizontal movement of the second roller assembly 802. A sliver separation guide 832 is fixedly connected to the body 803 of the first roller assembly 801 by a suitable means. As will be fully described later, the sliver separation guide 832 is for obtaining a reliable separation of a sliver after a piecing operation from the throttling nozzle 870. Namely, as shown in FIG. 25, the throttling nozzle 870 is located on one side of the sliver separation guide 832 remote from the body 803 of the first roller assembly 801, while the sliver S is located between the sliver separation guide 832 and the body 803 of the first roller assembly 801, when the second roller assembly 802 is in a opened position where the second roller assembly 802 is spaced from the first roller assembly. In a closed position of the second roller assembly 802 as shown in FIG. 24, the throttling nozzle 870 is now located on one side of the sliver separation guide 832 adjacent the body 803 of the first roller assembly 80i, which allows the sliver to be introduced into the throttling nozzle 870 as will be fully described later. Upon a separation of the second roller assembly 802 from the first roller assembly to take the open position as shown in FIG. 25 from the closed position in FIG. 24, the sliver separation guide 832 assists the sliver $S_2$ to be separated from the throttling nozzle 870. As shown in FIG. 25, the sliver separation guide 832 has an outwardly bent portion 832-1, which allows the sliver S to be situated between the sliver separation guide 832 and the body 803 of the first roller assembly 801 upon the movement of the sliver piecing assembly 80 to the opened condition in the direction U.

In FIG. 22, the second roller assembly 802 includes a body 836 having guide openings 837 for slidably receiving the guide rods 830 extending from the body 803 of the first roller assembly 801, so that the second roller assembly 802 can be moved toward or away from the second roller assembly 801. Connected rotatably to the body 836 of the second roller assembly 802 are first, second and third rollers 44, 846 and 848, which are spaced in parallel with each other. The first, second and third rollers 844, 846 and 848 of the second roller assembly 802 are arranged to face the first, second and third rollers 804, 806 and 808, respectively. Sets of rollers are constructed by the first rollers 804 and 844, the second rollers 806 and 846, and the third rollers 808 and 848, respectively, which control the supply of a sliver in the sliver piecing unit 80. The first, second and third rollers 844, 846 and 848 are connected to position control mechanisms 860, 862 and 864, respectively, of a spring force generating type, so that the pressure of the first, second and third rollers 844, 846 and 848 with respect to the first, second and third rollers 804, 806 and 808, respectively, is suitably adjustable. The construction of such position control mechanisms 860, 862 and 864 is well known to those skilled in this art, and therefore detailed explanation thereof will be omitted. The sliver throttling nozzle 870 is provided in the body 836 of the second roller assembly 802. As shown in FIG. 25, a nozzle support member 871 has a first end fixedly connected to the body 836 of the second roller assembly 802 at a suitable location and a second end 871-1 of a rounded U-shape, to which the nozzle 870 is fixedly connected. As shown in FIG. 22, the nozzle 870 forms, generally, an outer conical shape converged upwardly, and forms a inner conical bore having a bottom open end 870-1 of a larger dimension and a top open end 870-2 of a smaller dimension. Furthermore, the nozzle 870 forms a side slit 872 extending along the entire length from the bottom to the top on the side facing the body 803 of the first roller assembly 801 as shown in FIG. 25. As a result, during the sliver piecing operation, upon the movement of the second roller assembly 802 toward the first roller assembly 801 along the direction X, the nozzle 870 can receive therein the sliver $S_2$ via the side slit 872. Furthermore, upon the completion of the piecing operation, upon the movement of the second roller assembly 802 away from the first roller assembly 801, the sliver S can leave the nozzle 870 via the side slit 872. In FIG. 22, the body 836 of the second roller assembly 802 forms a recess 879 opened to the first roller assembly 801, which allows the sliver separation guide 832 to be stored in the recess 879 when the first and second roller assemblies 801 and 802 are closed for executing the piecing operation as shown in FIG. 24. It should be noted that a distance D (FIG. 23) between a nip point of the set of the third rollers 808 and 848 and the upper opening of the nozzle 870 is smaller than the mean length of fibers construction a sliver for preventing the sliver from being broken when the sliver passes through the nozzle 870.

In FIG. 22, a cylinder assembly 880 is arranged on one side of the body 836 remote from the nozzle 870. The cylinder assembly 880 has a cylinder body, which is fixedly connected to a frame 202 of the can exchanger 8 by a suitable means and a piston rod 882 connected to the body 836. A control of the pneumatic pressure in the cylinder 880 causes the second roller assembly 82 to be moved between an opened position as shown in FIG. 22 and a closed position as shown in FIG. 23. Namely, during a can exchange operation, in order to allow a sliver from a consumed can to be introduced between the first and second roller assemblies 801 and 802, the piston rod 882 is retracted as shown in FIG. 22, so that the second roller assembly 802 is situated at the opened position, which allows a sliver from a consumed can to be introduced between the first and second roller assemblies 801 and 802. After introduction of the sliver between the first and second roller assemblies 801 and 802, the piston rod 882 is extended so that the second roller assembly 802 is situated at the closed position as shown in FIG. 23, which allows the sliver from a consumed can to be nipped between sets of opposite rollers 804 and 846, 806 and 846, and 808 and 848, while the sliver is located in the throttling nozzle 870. At a first stage of a piecing operation, the ratio of the speed of the first motor 818 with respect to that of the second motor 826 is controlled such that the peripheral speed of the first roller 804 operated by the first motor 818 and the peripheral speed of the second and third rollers 806 and 808 by the second motor 826 are equalized.

The sliver piecing unit 80 is further provided with means for obtaining a rubbing movement applied to a sliver which is formed by combining a sliver from a consumed can and a sliver from a full can. This means includes, basically, a flexible, endless nipping belt 884 provided at the first roller assembly 801 and a nipping roller 886 provided at the second roller assembly 802. The endless nipping belt 884 is, at its one end, looped around the third roller 808, and is at its other end, looped around an auxiliary roller 890 rotatably mounted to a stay 888, which is fixedly connected to the body 803. As shown in FIG. 26, the nipping roller 886 has, at its opposite ends, reduced diameter portions **886*a*, which is rotatably and slidably passed through a pair of spaced brackets 891 which is fixed to the body 836 of the second roller assembly 802. Namely, with respect to the brackets 891, the nip roller 886 can be rotated about its own axis, while the nip roller 886 is axially slidable along its own axis as shown by an arrow 1, which allows a manual-like, rubbing motion to be applied to a sliver held between the nipping belt 884 and the nipping roller 886. In order to execute such a rotating and sliding movement of the nipping roller 886, the nipping roller 886 has, at its one end, a toothed wheel 892, which mesh with a spline sleeve 893 fixedly connected to an end of the third roller 808. Furthermore, the other reduced diameter portion 886*a* of the nipping roller 886 is connected, via a connecting sleeve 897 and a connecting rod 895, to a crank disk 894 connected to a rotating shaft of an electric motor 896. Namely, as shown in FIG. 27, the reduced diameter portion 886*a* of the nipping roller 886 has a screw portion screwed to an end of the sleeve 897. The sleeve 897 has a second, opened end to which the connecting rod 895 is, at its one end, inserted and articulated by a pin 895-1. The other end of the connecting rod 895 is articulated, by a pin 895-2, to the crank disk 894** at a location spaced from its center.

In the opened position as shown in FIG. 22, where the first and the second roller assembly 801 and 802 are spaced, the toothed wheel 892 on the second roller assembly 802 is detached from the spline sleeve 893 on the first roller assembly. When the first and second roller assemblies 801 and 802 are combined as shown in FIG. 23, the toothed wheel 892 is brought to be meshed with the spline sleeve 893, which allows the rotation of the rotation of the third roller 808 to be transmitted not only to the belt 884 but also to the nipping roller 886. The connection of the toothed wheel 892 with the spline sleeve 893 allows the nip roller 886 to be axially reciprocated, while the rotation is transmitted therebetween. Contrary to this, a rotation of the crank disk 894 as shown by an arrow K in FIG. 26 by means of the rotation of the rotating shaft of the motor 896 causes the nipping roller 886 to be reciprocated as shown by the arrow 1 by means of the rod 895 and the sleeve 897. As a result, the nipping roller 886 is rotated about its own axis, while it is axially reciprocated, so that a rubbing movement is applied to a sliver nipped between the nipping belt 884 and the nipping roller 886. During this rubbing movement, the nipping roller 886 is pressed to the nipping belt 884, so that the belt 884 made of a flexible material is inwardly deformed, which causes the sliver to be held for a length along the direction of the feed of the sliver. As a result, an increased length of contact of the sliver with respect to the nipping belt 884 and roller 886 is obtained, thereby imparting an effective rubbing movement to the sliver, which causes the combined slivers to be effectively interwound.

In FIG. 7, the sliver breaking unit 90 is for breaking a sliver from a consumed can upon a completion of the sliver piecing operation. In FIG. 28, the sliver breaking unit 90 includes a breaking member 902 formed with a combed portion 912, and a cylinder mechanism 904 for obtaining a reciprocal movement of the breaking member 902 in the direction transverse to the rows of cans as shown by an arrow m. The cylinder mechanism 904 has a cylinder and piston rods 906 extending therefrom. Connected to free ends of the piston rods 906 is a supporting member 908, to which a supporting rod 910 is connected. The supporting rod 910 is formed with a bent portion, to which the breaking member 902 is connected, so that the combed portion 912 faces the sliver feed unit 70. In FIG. 28, the sliver feed unit 70 is shown in a position, where the second roller assembly **702*b*** is slightly opened to that the second roller assembly 702b forms an angle with respect to the first roller assembly 702a, so that the second roller assembly 702b is generally in parallel with respect to the sliver breaking member 902. A sliver $S_1$ from a consumed can is located on the back side of the second roller assembly 702b. Namely, as shown in FIG. 28, the sliver $S_1$ is located in the sliver guide 760-1 outside from the second roller assembly 702b. The cylinder 904 is then operated so that the piston rods 906 are retracted in the direction as shown by the arrow m, which causes the breaking member 902 to be moved toward the second roller assembly 702b, so that the sliver $S_1$ is sandwiched between the second roller assembly 702b and the breaking member 902, which cause sliver $S_1$ to be broken. The provision of the comb portion 912 causes the sliver $S_1$ to be partially nipped along the length of the breaking member 902. As a result, at the broken end of the sliver $S_1$, along the thickness of the sliver, a separation of fibers partially occurs, so that an increased length of the portion of the sliver end with a reduced number of fibers is obtained while its thickness is substantially unchanged. As a result, when the sliver $S_1$ is combined with a sliver $S_2$ from a full can at the sliver piecing unit 80, this broken end of the sliver $S_1$ with a reduced number of fibers and of an increased thickness contacts with the sliver $S_2$ from the full can, so that the latter sliver $S_2$ is encircled by the former sliver $S_1$, which prevents the combined sliver from being abruptly thickened, thereby obtaining an improved evenness of the pieced portion of the combined slivers.

Now, an operation for piecing a sliver from a consumed can with a sliver from a full can will be explained. In this case, a relative position of the sliver feed unit 70 and the sliver breaking unit 90 with respect to the piecing unit 80 is shown in FIG. 23. FIGS. 29-(*a*) and (*b*) schematically illustrate the sliver feeding operation and the sliver piecing operation. Namely, the nipping surface by the roller mechanisms 702a and 702b of the feed unit 70 is aligned with the nip line of the roller assemblies 801 and 802 of the piecing unit 80. In FIGS. 29-(*a*) and (*b*), the first and second roller assemblies are merely shown as rollers for the sake of the simplicity. Furthermore, a sliver $S_1$ from a consumed can is shown so that it is nipped between the opposite sets of rollers 804 and 844, 806 and 846, 808 and 848, and 884 and 886.

FIG. 29-(*a*) illustrates a situation where the feeding unit 70 commences a feeding operation of the sliver $S_2$ from a full can to the piecing unit 80. Namely, the sliver feed unit 70 is, while the slivers $S_2$ to be nipped between roller assemblies 702a and 702b, already moved to the position as shown by an arrow i where the sliver feed unit 70 is in a line with respect to the sliver piecing unit 80, so that the set of the rollers 702a and 702b of the sliver feed unit 70 is adjacent with respect to the set of rollers 804 and 844 of the sliver piecing unit as shown in FIG. 23. Next, the rotation of the motor 730 in FIG. 13 is commenced, so that the sliver $S_2$ issued from the set of the rollers 702a and 702b is, as shown in FIG. 29-(*a*), directed to the set of the rollers 804 and 844. It should be noted that, upon the commencement of the feeding operation of the sliver $S_2$ from the full can, the peripheral speed of the set of the rollers 702a and 702b is controlled so as to be slightly reduced with respect to that of the set of the rollers 804 and 844. As a result, a draft is applied between the set of the rollers 702a and 702b of the feed unit 70 and the set of the rollers 804 and 806 when the brush shaped portion of the broken end of the sliver $S_2$ is taken by the set of the rollers 804 and 844, so that a rate of the change in the thickness of the end of the sliver $S_2$ is reduced, when it is combined with the sliver $S_1$ from a consumed can. Namely, FIG. 37-(*a*) illustrates a situation that the sliver $S_2$ from the set of the rollers 702a and 702b of the feed unit 70 has, at its brush-shaped end $S_2'$, just arrived at the inlet side set of the rollers 804 and 844 of the piecing unit 80. In this situation, the surface speed of the rollers 702a and 702b of the feed unit 70 is slower than that of the rollers 804 and 844 of the piecing unit 80, so that the brush shaped end portion $S_2'$ is subjected to drafting, causing its fibers to be displaced with each other. At the timing when the brush shaped end $S_2'$ of the sliver $S_2$ has just completely passed the rollers 804 and 844, the surface speed of the rollers 702a and 702b of the feed unit 70 is equalized to that of the rollers 804 and 844, so that no draft is generated. FIG. 37-(*b*) illustrates a situation that the brush-shape portion $S_2'$ of the sliver has passed the rollers 804 and 844, which shows that the degree of the change in the thickness of the end of the sliver $S_2$ is reduced as shown by a line P. In FIG. 37-(*b*), a dotted line Q shows a shape of the end of the sliver $S_2'$ after passed the rollers 804 and 844, when no draft is applied between the set of the rollers 702a and 702b and the set of the rollers 804 and 844, which corresponds to the brush shaped end of the sliver $S_2$, before being introduced into the rollers 804 and 844. Such a slackened shape in the end of the sliver $S_2$ is advantageous in that a combination with the sliver $S_2$ can provide a more evenly combined sliver. It should be noted that the draft between the set of the rollers 702a and 702b and the set of the rollers 804 and 844 is obtained only during a very limited period to allow the brushed end portion $S_2'$ of the sliver to pass the rollers 804 and 844, and the completion of such a passage of the end portion $S_2'$ causes the draft to be instantly canceled, and thereby the peripheral speed of the rollers 702a and 702b and 804 and 844 to be equalized.

Again in FIG. 29, the sliver $S_1$ from the consumed can and the sliver $S_2$ from the full can, which are combined, are moved into the drafting rollers in the piecing unit 80, the draft ratio of which is now under 1.0. Namely, the thickness of the combined slivers is of the twice thickness of a single sliver. A means such as a timer is provided for detecting a time when the leading end of the sliver $S_2$ comes to a desired position (for example, intermediate position) between the set of first rollers 804 and 844 and the set of the second rollers 806 and 846. In this instance, a reduction in the speed of the first set of the rollers 804 and 844 is realized by a corresponding reduction of the speed of the of the first motor 818 (FIG. 22) for rotating the rollers 804 and 844. Simultaneously, a reduction of the speed of the motor 730 (FIG. 13) for rotating the rollers 702a and 702b is also obtained. As a result, a reduction in the peripheral speed of the first rollers 804 and 844 of the piecing unit 80 and the feed rollers 702a and 702b of the feed unit 70 is realized with respect to the peripheral speed of the second and third sets of rollers 806 and 846, and 808 and 848. As a result, a draft of 2 is applied to the combines slivers $S_1$ and $S_2$ between the set of the first rollers 804 and 844 and the second set of the rollers 806 and 846, which causes the thickness of the combined slivers to be reduced to that of a single sliver when the combined slivers come out of the second set of the rollers 806 and 846.

FIG. 29-(*b*) illustrates schematically how the interwinding of the combined slivers occurs. Namely, when the combined slivers $S_1$ and $S_2$ are moved in the throttling nozzle 870 between the second set of the rollers 806 and 846 and the third set of the rollers 808 and 846, the converged shape of the nozzle 870 with the throttled outlet end 870-2 causes the combined slivers $S_1$ and $S_2$ to be pressed laterally with each other, which causes the fibers to be interwound between the slivers $S_1$ and $S_2$, which causes an integral, single sliver to be come out from the third set of the rollers 808 and 848. Such a throttling of the combined slivers creates, inevitably, a resistance force in the slivers at the nozzle 870, which does not cause the fibers constructing the slivers to be separated, due to the fact that the distance D between the throttle portion 870-2 and the nip point of the rollers 808 and 848 is shorter than an average fiber length $D_s$ of the fibers of the slivers. Namely, such a selection of the distance D prevents the fibers from being withdrawn irrespective of the resistance force at the orifice 870, which allows the combined fibers to be taken up by the third set of the rollers 808 and 848.

The integrated sliver from the third set of rollers 808 and 848 is, then, passed between the nipping belt 884 and nipping roller 886, which is rotated while reciprocated along the axial direction (the direction transverse to the paper), so that a manual-like rubbing movement is applied to the sliver by the nipping belt 884 and nipping roller 886, which is effective in obtaining an improved interwound condition. Furthermore, the flexibility of the belt 884 allows the nipping roller 886, along its peripheral length, to be engaged with the belt 884, which assists in an increased degree of the engagement of the roller 886 with the belt 884. As a result, an effective rubbing movement in the sliver between the belt 884 and roller 886 is created for obtaining an improved piecing operation.

A timer for detecting a desired time after the commencement of the piecing operation issues signals for moving the roller **702*b* of the feed unit 70 as shown by an arrow h to a position where the roller 702*b* is spaced from the first roller 702*a*. This position of the roller 702*b* corresponds to that shown in FIG. 28. As a result, the sliver $S_1$ from the consumed can is nipped between the back side of the roller 702*b* and the comb portion 912 of the sliver breaking element 902, which causes the sliver $S_1$ to be broken. The comb shaped portion 912 provides spaced portions of the sliver nipped between the sliver breaking element 902 and the roller 702*b*. As a result, a partial separation of the fibers along the width of the sliver occurs between a portion of the sliver near the roller 804 and a portion of the sliver neat the can occurs when the sliver $S_2$ is broken. Thus, an increased length of the portion of reduced number of fibers is obtained at the broken end of the sliver $S_1$, which is effective to decrease an unevenness in the combined slivers where this broken end is combined with the sliver $S_2$ At a timing where the broken end of the sliver $S_1$ comes to a desired location (for example, intermediate portion) between the first set of the rollers 804 and 844 and the second set of the rollers 806 and 846, a two times increase in the speed of the motor 818 (FIG. 22) to the initial value is obtained, which causes the peripheral speed of the first set of the roller 804 and 844 to be equalized to the peripheral speed of the second and third sets of the rollers 806 and 846, and 808 and 848. As a result, the thickness of the combined slivers changes to the thickness of a single sliver, without generating a substantial unevenness. The period for obtaining the draft of 2.0, which is, as explained above, commenced when the sliver $S_2$ from the full can is come to the desired location between the first set of the rollers 804 and 844 and the second set of the rollers 806 and 846, and is finished when the broken end of the sliver $S_1$ is come to the desired location between the first set of the rollers 804 and 844 and the second set of the rollers 806 and 846**, is factor to be suitably adjusted so as to obtain the best evenness of the combined slivers.

Figure 30:
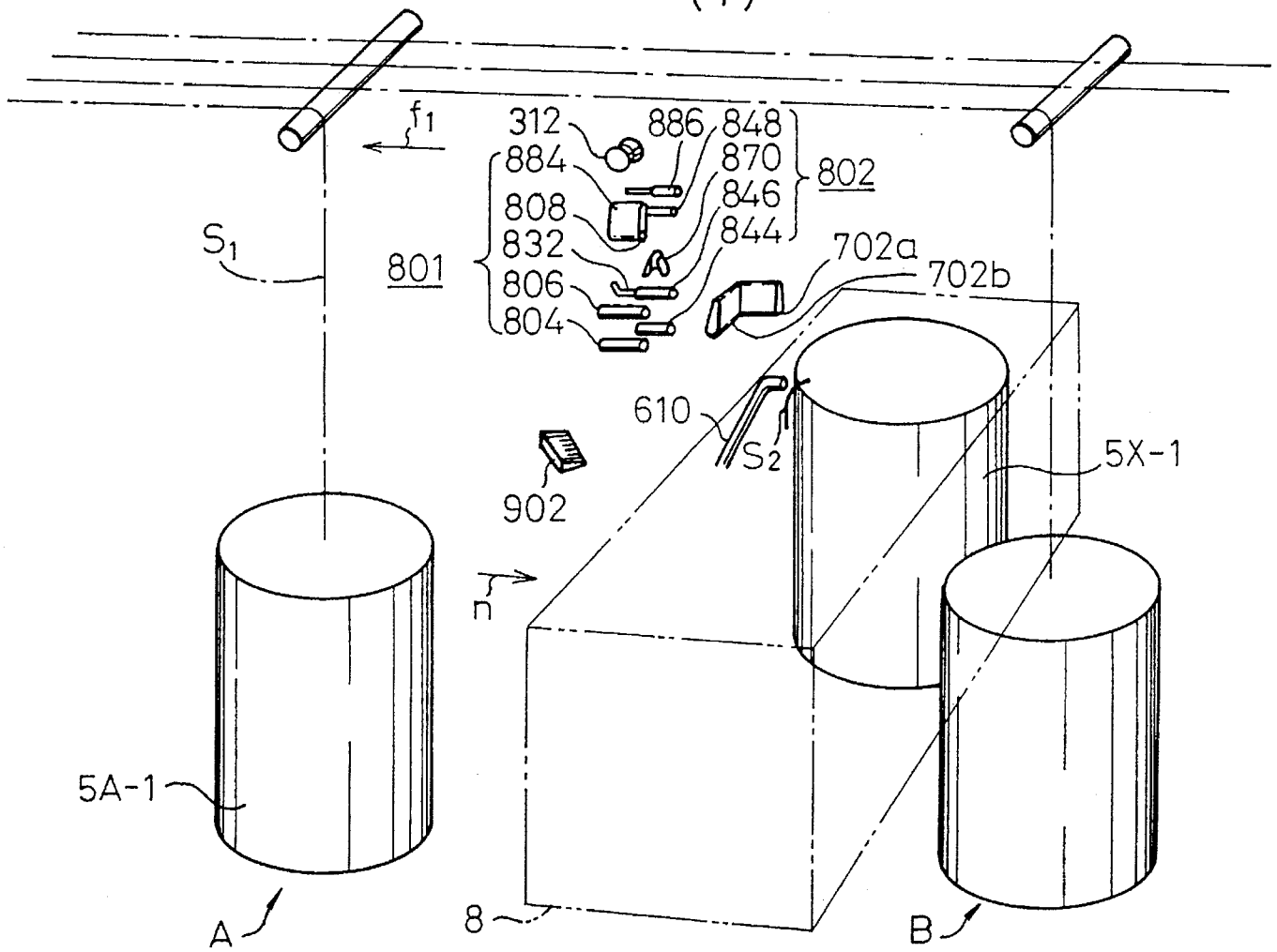

FIGS. 30 to 36 illustrate a series of phases (1) to (7) for obtaining a can exchange operation by means of the can exchanger 8 without interrupting the spinning operation at the flyer frame, according to the present invention. At the first phase (1) in FIG. 30, in order to commence the can exchanging operation of the row A of cans fed to the roving frame, the can 5X-1 at the forward end of the full can row is taken into the position in the can exchanger 8. This construction shown in FIG. 30 corresponds to the position shown in FIG. 1-(*a*) and FIG. 3-(*b*). In FIG. 30, the guide roller 312 in the sliver guide unit 30, the first and second roller assemblies **702*a* and 702*b* of the sliver feed unit 70, the sliver breaking element 902 of the sliver breaking unit 70, and the first and second roller assemblies 801 and 802 of the sliver piecing unit 80 are shown. The second roller mechanism 702*b* is in the opened position (the dotted line 702*b*' in FIG. 13) with respect to the first roller mechanism 702*a*. Furthermore, the second roller assembly 802 is in the opened position (FIGS. 22 and 25) with respect to the first roller assembly 801**.

From the condition (1) in FIG. 1, the holding frame 402 of the can exchanging unit 40 in FIG. 11 is, by a forward rotation of the motor 440, moved toward the position as shown in FIG. 12, so that the suckers 408 are contacted with a side wall of the can 5A-1 at the forward end of the row, for example, row A of cans to be replaced. The vacuum is applied to the suckers 408 so as cause them to be engaged with the side wall of the can 5A-1. A reverse rotation of the motor 440 (FIG. 12) causes the holding frame 402 with the can 5A-1 to be moved toward the position shown in FIG. 11 along an arrow n in FIG. 30, which causes the can 5A-1 to be received by the can exchanger 8 in front of the full can 5X-1 as shown in a condition (2) in FIG. 31. Simultaneously with the movement for taking in the consumed can 5A-1, the guide roller 312 of the sliver guide unit 30 is operated. Namely, before taking the can 5A-1 into the can exchanger 8 by means of the unit 40, an introduction of compressed air into the rod-less cylinders 302 and 304 (FIG. 9) is done, so that the guide roller 312 is extended to the position in FIG. 10 along a direction as shown by an arrow $f_1$ in FIG. 30, so that the guide roller 312 is located in a position slightly passed by the sliver $S_1$ from the consumed can 5A-1 without engaging therewith. Then, the motor 324 in FIG. 9 is operated which causes the guide roller 312 to be slightly moved as shown by an arrow $f_2$ in FIG. 31. Then, the pneumatic pressure at the rod-less cylinder 302 and 304 in FIG. 9 is switched, which causes the guide roller 312 to be retracted toward the condition in FIG. 9 as shown by an arrow $f_3$ in FIG. 31. The retracting movement of the guide roller 312 causes it to be engaged with the sliver $S_1$ from the can 5A-1, so that, when the can 5A-1 is taken into the can exchanger 8 as shown by the arrow n, the guide 312 allows the sliver $S_1$ to be placed between the first roller assembly 801 (including the rollers 804, 806 and 808, the sliver separation guide 832 and the nipping belt 884) and the second roller assembly 802 (including the rollers 844, 846 and 848, the sliver throttling nozzle 870, and the nipping roller 886) which is spaced from the first roller assembly 801. Due to the fact that the sliver separation guide 832 is spaced from the rollers 804, 806 and 808 as shown in FIGS. 22 and 25, the sliver $S_1$ is located between the sliver separation guide 832 and the series of the rollers 804, 806 and 808 of the first roller assembly 801 which is spaced from the second roller assembly 802. See also FIG. 1-(*b*).

Figure 31:
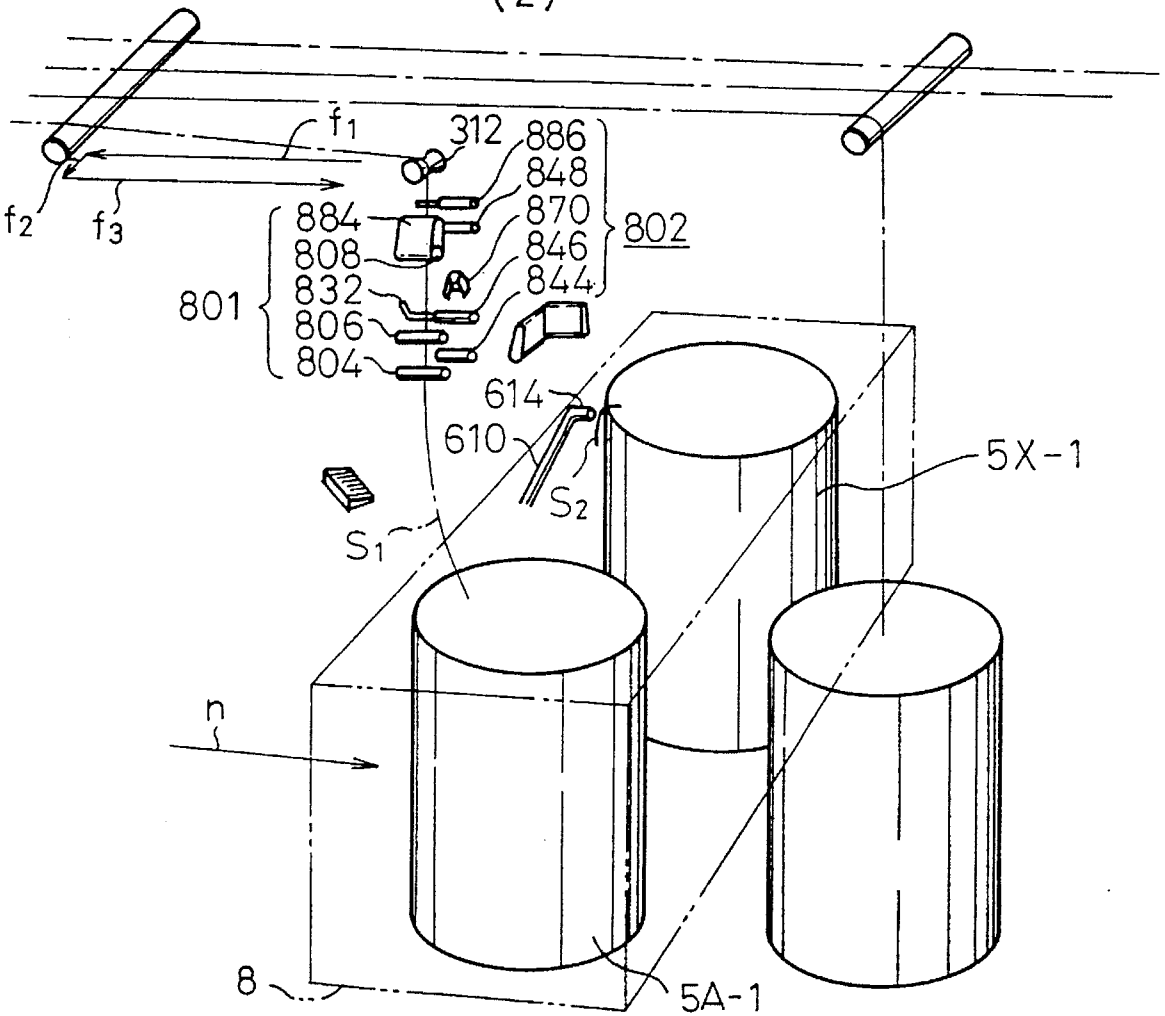
Figure 32:
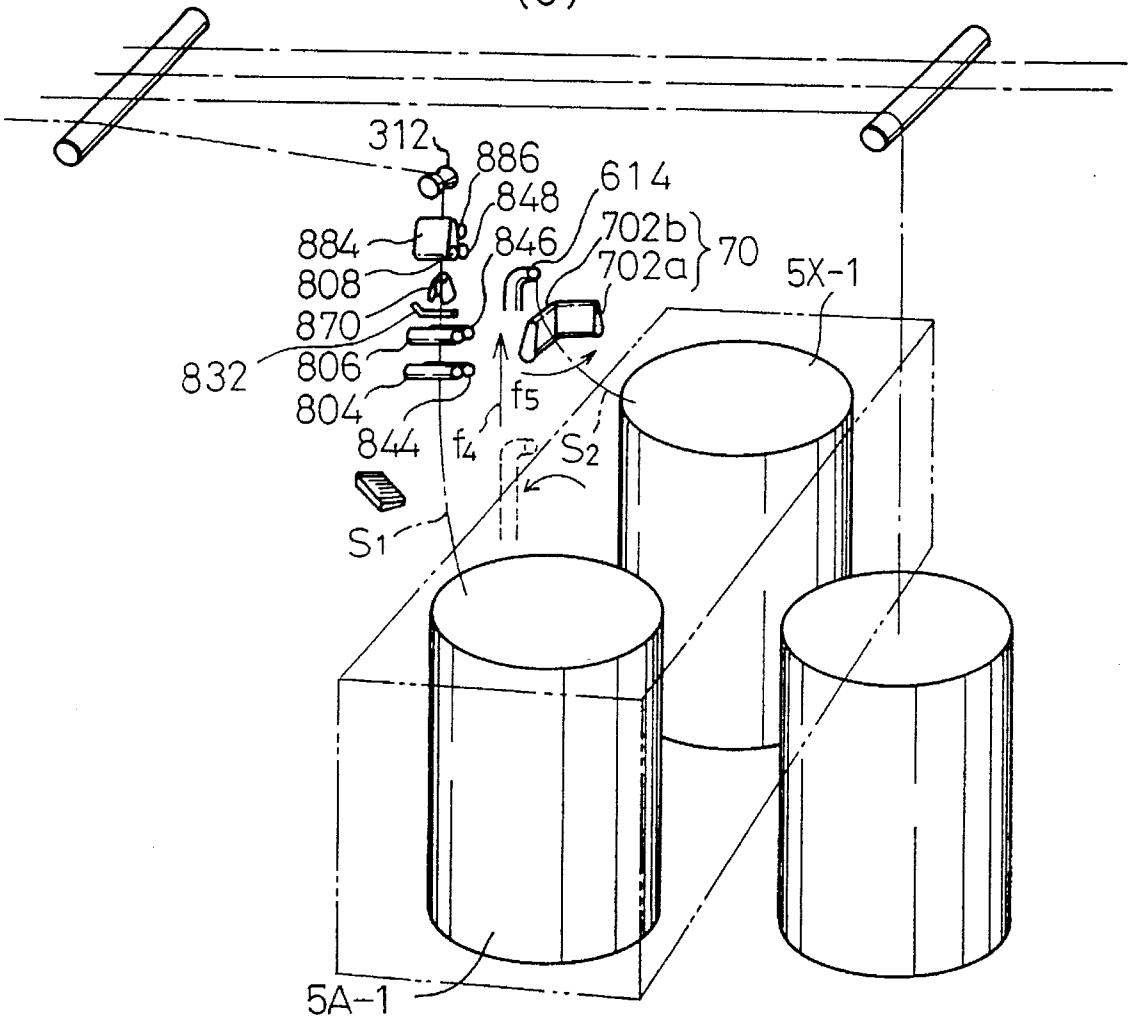

From the condition (2) in FIG. 31, by supplying compressed air to the cylinder 880 in FIG. 22, the second roller assembly 802 (including the rollers 844, 846 and 848, the sliver throttling nozzle 870, and the nipping roller 886 while they are rotating) is moved forwardly to a condition (3) as shown in FIG. 32, where the first, second and third sets of the rollers 804 and 844, 806 and 846, and 808 and 848, respectively, are contacted with each other, so as to grip the sliver $S_1$ from the consumed can 5A-1. At this time, the feeding operation of the sliver $S_1$ from the consumed can 5A-1 to the roving frame, i.e., the spinning operation, is continued due to the rotation of the rollers. No draft is, however, generated in the sliver $S_1$ due to the fact that the peripheral speed of the first set of the rollers 804 and 844 is equalized to that of the second and third sets of the rollers 806 and 846, and 808 and 848. See also FIG. 1-(*c*).

From the full can 5X-1, as shown in FIGS. 30 and 31, an end of the sliver $S_2$ is dangled, to which the sliver end pick-up nozzle 614 is faced. An application of a vacuum to the nozzle 614 causes the sliver end to be sucked and held thereby. In order to obtain the faced condition of the sliver end with the nozzle 614, a can rotating mechanism as shown in Japanese Un-Examined Patent Publication No. 2-251626 is provided at a location where the full can conveyor 4 is connected to the full can exchanging conveyors 6*a* and 6*b*. This means allows a sliver end to be dangled from a respective cans at a fixed angular position, so that the end when taken into the can exchanger 8 is always situated to be faced with the sliver sucking nozzle 14.

Under the condition where the sliver end from the can 5X-1 is sucked by the sliver end pick-up nozzle 614 as shown in FIG. 2, air pressure is applied to the cylinder 620, so that the nozzle 614 is, as shown in FIG. 21, moved to the position located outside of the sliver guide bar 621 as shown by the arrow $e_1$. Then, air pressure is supplied to the cylinder 612 in FIG. 7, which causes the arm 613 together with the nozzle 614 sucking the sliver end, to rise to a condition as shown by a phantom line 610-1 in FIG. 7. At the same time, the sliver feed unit 70 is in the open position, where with respect to the first roller mechanism 702*a*, the second roller mechanism 702*b* is opened to the position as shown by the phantom line 702*b*'. Then, air pressure in the rod-less cylinder 601 in FIG. 7 causes the sliver end pick-up nozzle 614 to be moved upwardly, while the sliver $S_2$ from the full can 5X-1 is held by the nozzle 614, as shown by an arrow $f_4$ i FIG. 32. Finally, a supply of the air pressure to the cylinder 620 in FIG. 21 is reversed, which causes the nozzle 614 to be moved to the position 614' as shown by the phantom line, at a location slightly forward of the sliver feed unit 70. Then, the rodless cylinder 701 in FIG. 8 is operated so that the sliver feed unit 70 is moved toward the sliver $S_2$ as shown by the arrow i in FIG. 17. The movement of the feed unit 70 toward the sliver $S_2$ causes it to be contacted with the fixed roller mechanism 702*a* as shown in FIG. 28 by the assistance of the guide slot 760-1 in the guide plate 760. Then, the rotary solenoid 740 in FIG. 16 is operated so that the second roller mechanism 702*b* in the position in FIG. 13 is swung as shown by an arrow $f_5$ in FIG. 32, so that the second roller mechanism 702*b* is, as shown by the solid line in FIG. 13, in contact with the first roller mechanism 702*b*, so that the sliver $S_2$ from the full can 5X-1 is nipped between the rollers 702*a* and 702*b* as shown in the condition (4) in FIG. 33.

Under the condition where the sliver $S_2$ is nipped between the rollers 702*a* and 702*b*, air pressure is applied to the cylinder 786, so that the nipper elements 781*a* and 781*b* of the sliver end formation unit 78 are moved toward the sliver $S_2$, while elements 781*a* and 781*b* are opened along the direction b as shown in FIG. 18, so that the elements 781*a* and 781*b* are finally located so that they are astride the sliver $S_2$. Then, the cylinder (not shown) in the body 780 is operated so that the elements 781*a* and 781*b* are moved toward each other, so that, between the upper, faced nipping surfaces 781*a*-1 and 781*b*-1 elements 781*a* and 781*b*, the sliver $S_2$ is nipped as shown in FIGS. 20 and 33.

The motor 730 of the feed unit 70 is, now, rotated in the reverse direction, so that the apron 708*a* is moved in the opposite direction as shown by an arrow in FIG. 20, which causes the sliver $S_2$ to be broken along the line 789 between the nip point between the opposite surfaces 781*a*-1 and 781*b*-1 and the nip point between the aprons 708*a* and 708*b* of the feed unit 70 due to the fact that the slivers constructing the sliver are separated. The gap of thickness of δ between the lower opposite surfaces 782*a*-1 and 782*b*-1 extends along the direction transverse to the plane of nipping of the sliver $S_2$ between the aprons 708*a* and 708*b*. Thus, the sliver $S_2$ once widened when come out from the aprons 708*a* and 708*b* along their plane is narrowed by the gap δ between the surfaces 782*a*-1 and 782-*b*, which causes the broken end of the sliver $S_2$ at the line 789 to form a paint-brush shape as shown in FIG. 16.

The reverse rotation of the first roller mechanism 702*a* by the motor 730 in FIG. 13 is continued up to the condition where the brush shaped end is slightly projected from the upper edges of the apron 708*a* and 708*b* as shown in FIG. 16. Then, the photo detector 771 detects this condition due to the change in the amount of the light received by the end 770' of the optical fiber guide 770, and the reverse rotation of the first roller mechanism 702*a* is stopped. Such a detection of the sliver end makes it possible to obtain the amount of the projection of the sliver $S_2$ from the upper edges of the aprons 708*a* and 708*b*, which is effective to prevent the fibers at the projected portion to become bent, which assists in obtaining a desired piecing operation.

Upon the completion of the breaking process of the sliver $S_2$, the nipper elements 781*a* and 781*b* of the sliver end formation unit 78 are separated from the position in FIG. 20 to the position in FIG. 19, and the cylinder 786 is operated so that the support member 780 of the nipper elements 781*a* and 781*b* is moved away from the sliver $S_2$. When the sliver end pick-up nozzle 614 is disconnected from the vacuum source, the portion (waste) S" of the sliver $S_2$ between the nozzle 614 and the breaking point 789 in FIG. 20 is dropped to the top end of the chute 79 in FIG. 7, and is discharged to the consumed can 5A-1 to be replaced by the full can 5X-1 as shown by an arrow q in FIG. 21. The sliver portion S" is together with the sliver reining in the can 5A-1 are treated as a waste. The sliver end pick-up nozzle 614 is, then, returned to the initial position as shown by the solid line in FIG. 21.

Figure 34:
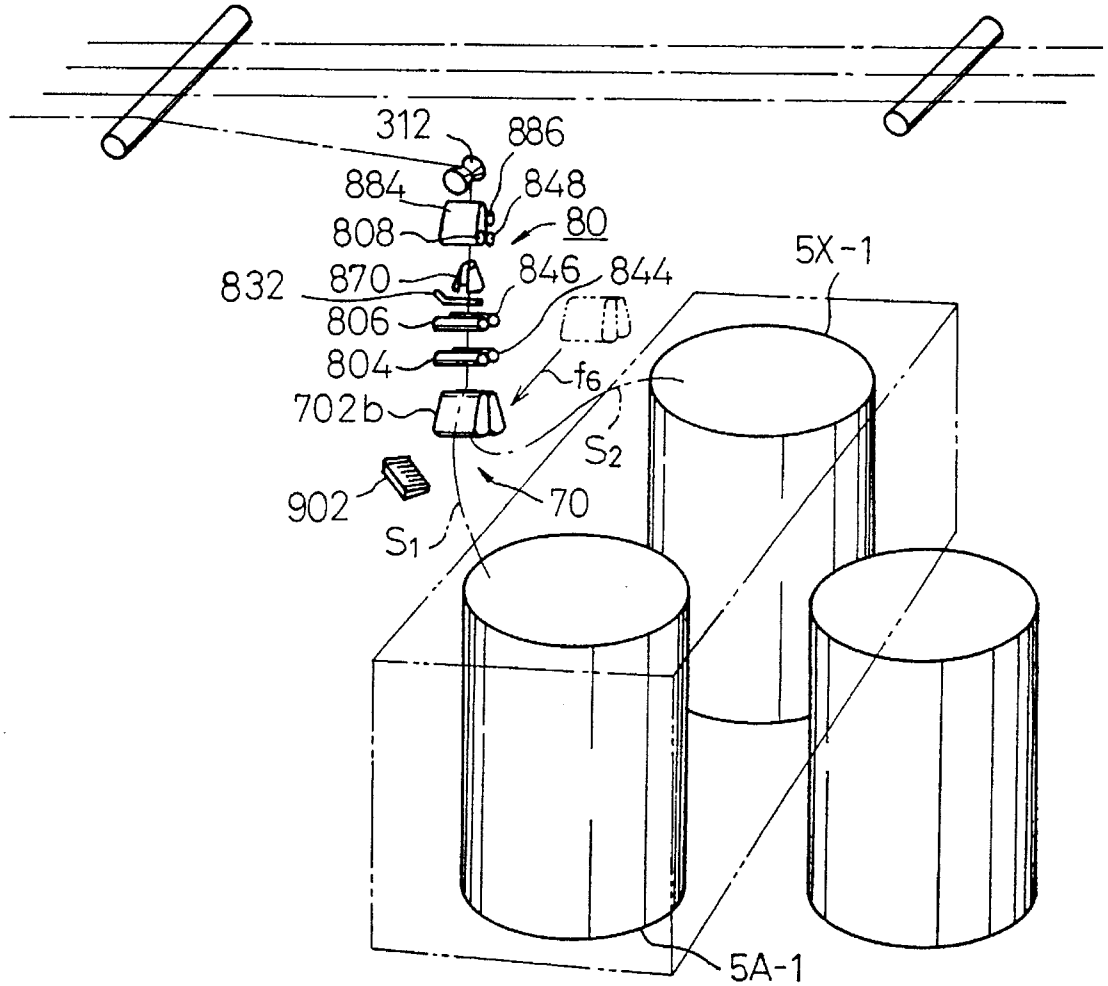

The rod-less cylinder 701 in FIG. 8 is again operated so that the sliver feed unit 70 is, as shown by an arrow $f_6$ in FIG. 34, moved toward the location below the sliver piecing unit 80 to take a condition (5). In this condition (5), as shown in FIG. 23, just below the sliver piecing unit 80 including the opposite sets of the rollers 804 and 846, 806 and 846, and 808 and 848, holding the slivers $S_1$ from the consumed can 5A-1, the sliver feed unit 70 having the first and second rollers 702*a* and 702*b* holding the sliver $S_2$ from the full can 5X-1 is situated. (This position corresponds to FIG. 1-(*d*).) Then, a forward rotating movement of the motor 730 (FIG. 13) is applied to the first roller 702*a*, which cooperates with the second roller 702*b* to move the sliver $S_2$ from the full can 5X-1, so that the end of the sliver $S_2$ is, together with the sliver $S_1$ from the consumed can 5A-1, nipped, first, by the first set of the roller 804 and 846, and by the second set of the rollers 806 and 846, of the piecing unit 80. (This position corresponds to FIG. 1-(*e*).) When the forward end of the sliver $S_2$ from the full can comes roughly to the central position between the first set of the rollers 804 and 844 and the second set of the rollers 806 and 846, a reduction in the speed of the motor 818 for rotating the set of the rollers 804 and 844 is obtained, so that the peripheral speed of the first rollers 804 and 844 becomes ½ of that of the second and third sets of the rollers 806 and 846, and 808 and 848, thereby obtaining a draft of 2.0 for making the thickness of the combined sliver the same as that of a single sliver. Furthermore, at the collecting orifice 870 between the second set of the rollers 806 and 846 and the third set of the rollers 808 and 848, a force is applied to the slivers $S_1$ and $S_2$, which causes the fibers to be laterally interwound between the slivers $S_1$ and $S_2$, causing the combined slivers to become an integrated single sliver. Furthermore, the manual like rubbing movement is applied to the combined slivers between the belt 884 and the roller 886, which assists in obtaining the improved interwound condition of the fibers in the combined sliver. No draft is basically applied to the sliver between the set of the rollers 702*a* and 702*b* of the sliver feed unit 70 and the set of the rollers 804 and 844 of the sliver piecing unit 80. However, when the paintbrush shaped portion $S_2'$ of the sliver $S_2$ comes to the rollers 804 and 844, a reduction in the surface speed of the rollers 702*a* and 702*b* of the sliver feed unit 70 with respect to the surface speed of the rollers 804 and 844 of the sliver piecing unit 80 is obtained, so that a drafting of the pointed paint brush shaped portion occurs, so that the rate of change in the thickness of the sliver end $S_2'$ of the sliver $S_2$ is reduced as shown by the line P when combined with the sliver $S_1$, as explained with reference to FIG. 37-(*b*). Thus, an improved quality of the pieced sliver can be obtained.

Figure 35:
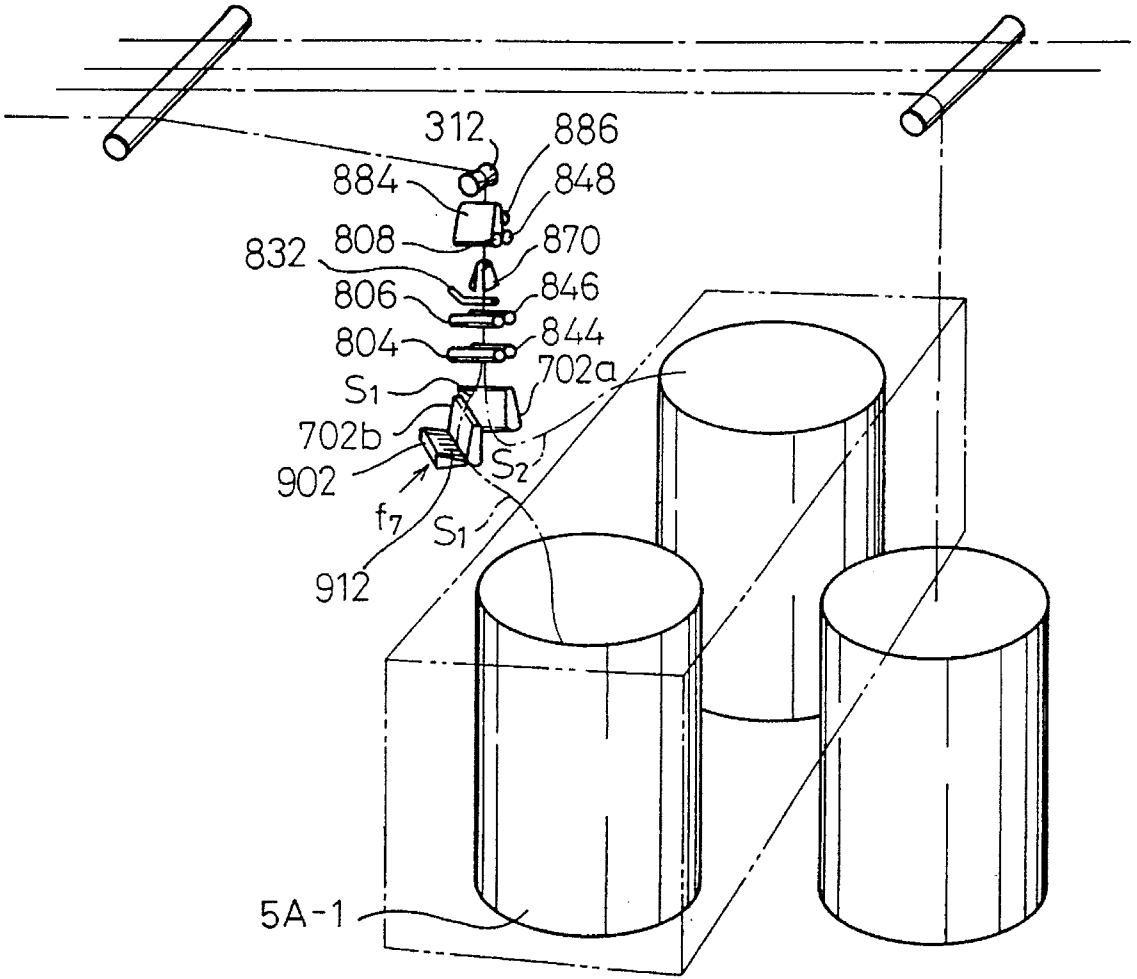

Upon the completion of the sliver piecing operation, the rotary solenoid 740 in FIG. 16 is operated so that the second roller mechanism 702*b* of the sliver feed unit 70 is swung by means of the pin 724 to the half opened position in FIG. 28, and the cylinder 904 is operated so that the sliver breaking member 902 is moved toward the roller 702*b* in as shown by an arrow $f_7$ in FIG. 35, so that the sliver $S_1$ from the consumed can 5A-1 is nipped between the back side of the roller 702*b* (apron 708*b*) and the breaking member 902. As a result, the sliver $S_1$ is broken due to the fact that the fibers constructing the sliver are $S_1$ separated. Furthermore, the separation of the fibers takes place partially along the thickness of the sliver $S_1$, so that an increased length of the broken end portion of the sliver of a decreased number of the fibers is obtained, so that a change in the thickness of the combined portion of the broken end of the sliver $S_1$ with the sliver $S_2$ is reduced, thereby decreasing the unevenness of the combined slivers, thereby increasing the quality of the slivers as obtained. Due to such a breaking operation, the portion of the sliver $S_1$ risen from the consumed can 5A-1 is dropped thereto. See also FIG. 1-(*g*).

When the broken tail end of the sliver $S_1$ comes to the intermediate position between the first set of the rollers 804 and 844 and the second set of the rollers 806 and 846, the speed of the first motor 818 is increased to the initial speed, so that the peripheral speed of the first set of the rollers 804 and 844 is equalized to that of the second and third sets of the rollers 806 and 846, and 808 and 848. Thus, one piecing operation of the slivers is completed.

Figure 36:
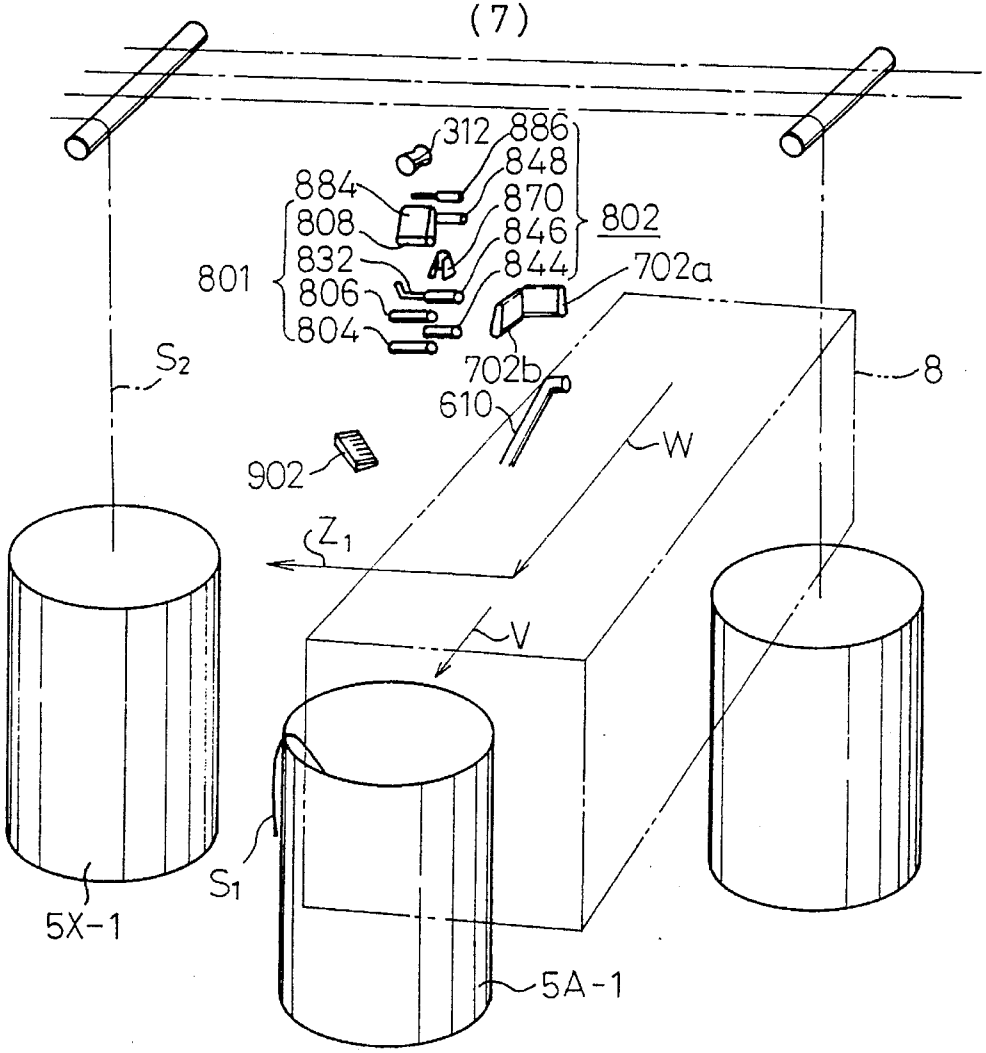

At the phase (7) in FIG. 36, the rotary mechanism in FIG. 16 is operated so that, with respect to the first roller mechanism 702*a*, the second roller mechanism 702*b* is fully opened to the position 702*b*' in FIG. 13, while the rotation of the motor 730 is stopped. The feed unit 70 is retracted to the initial position by retracting the rodless cylinder 701 in FIG. 8. Furthermore, the cylinder 880 in FIG. 22 is operated so that the second roller assembly 802 is retracted from the first roller assembly 801 so that the sliver $S_2$ from the full can 5X-1 is released. Upon the retracting movement of the second roller assembly 802 away from the first roller assembly 801 as shown by Pan arrow U in FIG. 25, the sliver guide 832 engages with the sliver $S_2$ from the full can, which is now supplied to the roving frame, which causes the sliver $S_2$ to be disengaged from the throttling nozzle 870 via the side opening 872 due to the relative movement between the stationary, sliver guide 832 and the nozzle 870 mounted to the moving second roller assembly 802. The consumed can 5A-1 replaced by the full can 5X-1 is moved out of the can exchanger 8, as shown by an arrow V, by the operation of the suitable group of the rollers 61 of the conveyor 6*a* in FIG. 5. The full can 5X-1 being supplied to the roving frame is moved forward in the can exchanger 8 as shown by an arrow W in FIG. 36 to the position previously occupied by the consumed can 5A-1. (See also FIG. 3-(*d*).) Finally, the can exchanger unit 40 in FIG. 7 is operated. Namely, a rotation of the motor 440 in FIG. 11 is obtained so that the holder frame 402 is moved toward the full can until the suckers 408 contact with the side wall of the full can. Then the vacuum is applied to the sucker 408 for holding the can, and the rotation of the motor 440 in the same direction is continued so that the holder 402 is fully extended to the position in FIG. 12, so that the can 5X-1 is moved as shown by an arrow Z in FIG. 36 until the full can 5X-1 is moved to the position previously occupied by the consumed can. (See, also, FIG. 3-(*e*).) The vacuum at the suckers 408 is removed, and the direction of the rotation of the motor 440 in FIG. 12 is reversed, so that the holding frame 402 is returned to the initial position in FIG. 11.

FIGS. 38 and 39 shows a modified embodiment for disposal of the waste portion S" in FIG. 20, which is generated when the pointed paint brush shape of the broken end of the sliver $S_2$ is created by means of the sliver end formation unit 78. In this embodiment, arranged on a wall of the frame 202 of the can exchanger 8 facing a side wall of a full can 5 is a vertical guide 932, to which a cylinder support member 921 is vertically movably mounted. A vertical cylinder 920 and a horizontal cylinder 922 are provided. The horizontal cylinder 222 is mounted to the support member 921. The horizontal cylinder 922 has a cylinder body connected to a piston rod 920*a* of the vertical cylinder 920 and a piston rod 922*a* connected to a nozzle support member 923, to which the sliver end pick-up nozzle 614 is connected. The sliver end pick-up nozzle 614 is connected to a vacuum hose 616 made of a flexible material. At a location above the can 5, a three port switching valve 924 is arranged. The switching valve 924 is provided with a tubular body 924*a*, a spool valve 924*b*, a common port 924*c*, a first switching port 924*d*, a second switching port 924*e* and a spring 924*f*. The first switching port 924*d* is connected to the end of the hose 616 remote from the sliver end pick-up nozzle 614. The spool valve 924*b* is urged by the spring 924*f* to move in the left-handed direction in FIG. 38, so that the spool 924*b* is situated at a first position, where the common port 924*c* is in communication with the first switching port 924*d*. When the spool 924*b* is moved in the right-handed direction in FIG. 38 against the force of the spring 924*f*, the valve 924 takes a second position where the common port 924*c* is in communcation with the second switching port 924*e*. The switching port 924*c* is, via a hose 926, connected to a waste box 927 which is located on a fixed support plate 936 extending at a location above the can 5. The waste box 927 is connected, via a filter plate 937 made as a punched plate, to a hose 928 connected to a sucking blower (not shown). The waste box 927 has a bottom opening which is opened to the can 5, and a closure plate 929 which is horizontally slidable for usually closing the bottom opening. The closure plate 929 is connected to an actuator 930 for moving the closure plate 929 in the right-handed direction in FIG. 38, when the waste in the box 927 to be dropped to the can 5.

Similar to the first embodiment of the sliver end pick up operation as explained with as reference to FIGS. 7 and 21, the piston rod 920*a* of the vertical cylinder 920 is in a retracted condition as shown by a solid line in FIG. 38 when the sliver end pick-up operation is commenced. The piston rod 922*a* of the horizontal cylinder 922 is, then, extended to a position where the sliver end pick-up nozzle 616 closely faces the end of the sliver $S_2$ dangling from the can 5. In this case, the switching valve 924 is in the first position where the common port 924*c* is in communcation with the first switching port 924*d*, so that the sliver end pick-up nozzle is in communication with the sucking blower (not shown) via the hose 616, the first switching port 924*f*, the common switching port 924*c*, the hose 926, the waste box 927, and the hose 927. Thus, the end of the sliver $S_2$ is sucked and held by the nozzle 614.

Then, the piston rod 922*a* of the horizontal cylinder 922 is extracted to a position, where the nozzle 614 is located outside of the sliver guide bar 621 with respect to the can 5. Then, the piston rod 920*a* of the vertical cylinder 920 is vertically extended to a position as shown by a phantom line in FIG. 38, where the sliver end pick-up nozzle 614 is elevated to face the second switching port 924*e* of the switching valve 924, and the nozzle 614 is, as shown in FIG. 39, located slightly above the horizontal pass of the sliver feed unit 70 and the sliver end formation unit 78, as similar to the first embodiment explained with reference, in particular, to FIG. 17. Then, a horizontal movement of the sliver feed unit 70 is executed for nipping the picked up sliver $S_2$ by means of the sliver feed unit 70. Namely, the sliver $S_2$ is nipped between the rollers 702*a* and 702*b* of the unit 70 as explained, in particular, to FIG. 13 for the first embodiment. A horizontal movement of the sliver end formation unit 80 is executed for obtaining the pointed paint brush shape of the broken end of the sliver $S_2$. Namely, the sliver $S_2$ is nipped between the nipping elements 781*a* and 781*b* of the unit 80 as explained, in particular, to FIG. 20 for the first embodiment. Then, a reverse rotation of the rollers 702*a* and 702*b* is executed for breaking the sliver $S_2$ between the units 70 and 78 for creating the pointed brush shape of the broken end of the sliver $S_2$, and this end of the sliver is supplied to the piecing unit 80 as explained, in particular, to FIGS. 29(*a*) and (*b*) for the first embodiment.

The waste portion S" of the sliver $S_2$ created by the sliver end formation operation by the unit 78 in FIG. 20 is held by the sliver end pick-up nozzle 614 in FIG. 38. The piston 922*a* of the horizontal cylinder 922 is moved toward the right-handed direction in FIG. 38 to a position where the body of the nozzle 614 is engaged with an operating rod 935 extending from the spool valve 924*b*. As a result, the spool valve 924*b* is moved in the right-handed direction against the force of the spring 924*f* so that the second position of the switching valve 924 is obtained, where the common port 924*c* which is connected to the vacuum pump (not shown) is, now, in communication with the second switching port 924*e*. As a result, the waste sliver at the nozzle 614 is sucked by the second switching port 924*e*, and is introduced into the waste box 927 via the hose 926. The punched plate 937 prevents the waste in the box 927 from being directed to the vacuum pump.

When a consumed can is replaced by a full can after the sliver piecing operation according to the present invention and is located below the waste box 927 in the can exchanger 8, the cylinder 930 is operated, so that the closure plate 929 is moved away from the box 927 to open the opened bottom thereof, which causes the waste to be dropped to the consumed can. Thus, the waste in the box 927 together with the remaining sliver in the consumed can is simultaneously treated at the disposal process. The discharge operation of the waste from the box 927 may be done every time a consumed can is located below the box 927, during the movement of the empty can in the can exchanger 8 to deliver it to the conveyor 7 in FIG. 2 as explained with reference to FIG. 36.

In the embodiments as explained, the sliver piecing operation is executed while the automatic can exchanging operation is done. The sliver piecing operation is done at the first stage, and the can exchange operation is done at the later stage.

In the above embodiment, a change in the value of the draft ratio between 1.0 and 2.0 in the piecing unit 80 is obtained by a mechanism comprised by the first and second electric motor 818 and 828, and the reduction of the speed of the first motor 818 is obtained when the draft ratio of 2.0 should be obtained. FIG. 40 illustrates a modification for obtaining a change in the value of the draft ratio. Namely, this mechanism includes a differential mechanism 850 for connection of the first and second electric motors 818 and 826 to the sets of the rollers 804 and 844, 806 and 846, and 808 and 848. Namely, the differential mechanism 850 is constructed by a shaft 851 extending to the first roller 804, a first gear 852 to which the shaft 851 is freely inserted, a second shaft 853 connected to the first gear 852, a second gear 854 connected to the shaft 853, a third gear 895 on the shaft 851 and meshing with the second gear 854, and a third gear 856 for engagement with a gear 806-1 on a shaft extending from the second roller 806. The second shaft 853 has a gear 857 at its end which meshes with a gear 858 at the end of the rotating shaft of the second motor 826. The first gear 852 meshes with a gear 859 at the end of the rotating shaft of the first motor 818. The first gear 852 includes a gear portion 852-1 which meshes with the third gear 856. A gear 806-2 on the shaft from the second roller 806 is connected with a gear 808-1 on a shaft from the third roller 808 via a gear 856'.

when the draft ratio of the second and third roller sets 806 and 846, and 808 and 848 over the first roller set 804 and 808 is set to 1.0, the second motor 826 is stopped, so that the rotational movement from the first motor 818 is transmitted to the first roller 804 via the gears 852, 854 and 855 due to the fact that the gear 854 is subjected to an orbital movement about the shaft 851 while obtaining a rotating movement about its own axis 853, which is transmitted to the gear 855 on the shaft 851. The rotational movement from the first motor 818 is, also, transmitted to the second and third rollers 806 and 808 via the gears 852, 856, 806-1, 806-2, 856' and 808-1. In this case, the gearing is such that the surface speed of the first roller 804 is equalized to that of the second and third rollers 806 and 808. Thus, a draft ratio of 1.0 of the second and third roller sets 806 and 846, and 808 and 848 with respect to the first roller set 804 and 808 is obtained.

In order to obtain a draft ratio of 2.0, a rotation of the second motor 826 is commenced, so that a rotational movement from the motor 826 is transmitted to the shaft 851 via the gears 858, 857,854 and 855 in a direction which is opposite to that as obtained at the shaft 851 by the rotation of the first motor 818. The gearing is such that the ½ reduction of the rotational speed of the shaft 851 is obtained. As a result, a draft ratio of 2.0 of the second and third roller sets 806 and 846, and 808 and 848 with respect to the first roller set 804 and 808 is obtained.

In the above embodiment, a collection or throttling of the combined sliver at the piecing unit 80 is done by the nozzle 870 as explained with reference to FIGS. 29-(*a*) and (*b*). FIG. 41 shows a modification of a throttling means. Namely, the throttling means is constructed by a pair of roller-belt assemblies 870*a* and 870*b* arranged to form a V-shape. The assemblies 870*a* and 870*b* are arranged between the second and third rollers 806 and 808. Each of the assemblies 870*a* and 870*b* is constructed by a drive roller 874 of a larger diameter, a driven roller 875 of a smaller diameter, and a belt 876 connecting the rollers 874 and 875 with each other. The drive roller 874 is rotated as shown by an arrow. The driven rollers 875 of the first and second assemblies 870*a* and 870*b* are arranged adjacent the third roller 808 to nip the combined slivers $S_1$ and $S_2$ to create a throttling force therein to cause the fibers to be interwound with each other between the slivers $S_1$ and $S_2$. The nipping point is at a location of a distance from the roller 808 shorter than the average length of fiber of the slivers.

In the first embodiment, two rows of cans (A and B or C and D) for slivers being fed to the roving frame are fed by a full can conveyor (6*a* or 6*b*) arranged between the rows of cans being fed. FIGS. 42-(*a*) to (*f*) show another arrangement of a full can conveyor and rows of cans being fed. Namely, in this embodiment, all of the rows A to D is supplied by a common, single full can conveyor 6. Two rows A and B for cans being fed are arranged on one side of the full can conveyor 6 and two rows C and D for cans being fed are arranged on the other side of the full can conveyor 6. Additional conveyors 9-1 and 9-2 are provided for the rows B and C of the fed cans, respectively, which are adjacent the full can conveyor 6. The construction of the conveyors 9-1 and 9-2 is substantially the same as that of the conveyor 6, and, as explained in the first embodiment, with reference to FIG. 5, it is constructed by a plurality of sets of rollers independently driven.

Now, a can exchanging operation in the embodiment in FIGS. 42-(*a*) to (*f*) will now be explained. FIGS. 42-(*a*) to (*f*) are for illustration of a replacement of consumed cans on the row A adjacent the roving frame 2 by full cans on the full can conveyor 6 by means of a working carriage 8. FIG. 42-(*a*) shows a situation where the working carriage 8 comes to a position $P_0$ which is slightly before the first full can on the row S of full cans which are located on the conveyor 6 for the preparation of the can exchanging operation. The row X of full cans is located offset with respect to the row A of the cans being fed for the length corresponding substantially to a diameter of a can.

In FIG. 42-(*b*), the carriage 8 is moved to a position $P_1$, where the full can 5X-1 at the top of the row X is stored in the front part of the carriage 8. In FIG. 42-(*b*), in synchronism with or prior to or after completion of the operation for taking up the can 5X-1 into the carriage 8, the can 5B-1 at the top of the row B between the row A and x is moved for the length slightly larger than the outer diameter of a can, so that a space 10 is created between the first can 5B-1 and the second can 5B-2 in the row B which allows a can to be transversely moved from the row A to the working carriage 8.

In FIG. 42-(*c*), the top can 5A-1 in the row A is taken into the rear half of the working carriage via the space 10 as shown by an arrow $f_2$, while the supply of the sliver from the can 5A-1 to the corresponding draft part of the roving frame 2 is not interrupted, i.e., the spinning operation is continued. The piecing operation between the sliver from the consumed can 5A-1 and the sliver from the full can 5X-1 is done in similar way to the first embodiment as described with reference, in particular, to FIGS. 29-(*a*) and (*b*), while the spinning operation of the sliver from the can 5A-1 is continued. However, the piecing operation may, also be done by stopping the roving frame.

In FIG. 42-(*d*), the can 5A-1 is delivered to the conveyor 6 from the carriage 8, while the full can 5X-1 which is now fed to the corresponding drafting part of the roving frame 2 is moved to the second half part of the carriage as shown by an arrow $f_3$ In FIG. 42-(*e*), the can 5X-1 is moved laterally from the carriage to the portion of the row A previously occupied by the consumed can 5A-1 via the space 10 as shown by an arrow $f_4$.

FIG. 42-(*f*) shows the commencement of the replacement of the second consumed can 5A-2 in the row A by a second full can 5X-2 in the row E. Namely, the working carriage 8 is moved, for one pitch, to a position $P_2$ for taking the second full can 5X-2 to the first half part of the carriage. The second can 5B-2 is moved for one pitch so that a space 10 of a length larger than the outer diameter of a can is created between the second and third cans 5B-2 and 5B-3. The steps in FIGS. 42-(*c*) to (*e*) are repeated, so that the consumed can 5A-2 after piecing operation is delivered to the conveyor 6, and the full can 5X-2 is introduced into a position in the row A, which the can 5A-2 previously occupied. These operations are repeated until all of the consumed cans in the row A are replaced by full cans in the row X. At the instant of the completion of the all of the cans in the row A, the row A is displaced for one pitch with respect to the desired position, as will be easily understood from FIGS. 42-(*b*) to (*f*). Thus, the conveyor 9-1 is operated for moving the row A for one pitch in the rearwad direction. The replacement of the consumed cans at the row B or C can be done in a similar way to that done for the replacement of the cans at the row A or B by the full can row Xa, or the replacement of the cans at the row C or D by the full can row Xb in the first embodiment in FIG. 2.

We claim:

1. A method for piecing, to a first sliver to a spinning machine, a second sliver, comprising the steps of:

providing spaced sets of opposite rollers;

nipping the first sliver with the sets of the rollers, so that the first sliver is moved by the rollers;

supplying the second sliver to the sets of the rollers so that the second sliver is, from its leading end, combined with the first sliver being moved to form a combined sliver;

throttling, by a nozzle, the fibers in the combined sliver at a location between the sets of rollers, the throttling being such that the combined sliver is pressed laterally at the nozzle, thereby interwinding the fibers between the first and second slivers; and breaking, on an inlet side of the sets of the rollers, the first sliver.

2. A method according to claim 1, wherein the throttling step further includes a step of continuously supplying the first sliver to the spinning machine for executing a spinning operation, while the interwinding of the second sliver to the first sliver is done.

3. A method for piecing, to a first sliver to a spinning machine, a second sliver, comprising the steps of:

providing spaced sets of opposite rollers;

nipping the first sliver with the sets of the rollers, so that the first sliver is moved by the rollers;

supplying the second sliver to the sets of the rollers so that the second sliver is, from its leading end, combined with the first sliver to form a combined sliver, obtaining different surface speeds between the sets of the rollers so that a draft of about 2.0 is generated in the combined sliver for reducing the thickness of the combined sliver to that of a single sliver;

throttling, by a nozzle, the fibers in the combined sliver at a location between the sets of rollers, the throttling being such that the combined sliver is pressed laterally at the nozzle, thereby interwinding the fibers between the first and second slivers;

breaking, on an inlet side of the sets of the rollers, the first sliver, and;

equalizing the surface speeds between the sets of the rollers so that the draft between the opposite sets of the rollers is reduced to 1.0 after the completion of the interwinding operation of the slivers.

4. A method for piecing slivers according to claim 5, further comprising a step of rubbing the combined sliver after the combined sliver is subjected to the throttling.

5. A method for piecing slivers in a spinning machine having at least one can for storing a first sliver, and a part for a treatment of the first sliver from the can, comprising the steps of:

providing spaced sets of opposite rollers;

nipping the first sliver from the can with the sets of the rollers while the feed of the first sliver to the treating part is continued;

providing a second can for storing a second sliver;

supplying the second sliver to the sets of the rollers so that the second sliver is, from its leading end, combined with the first sliver to form a combined sliver;

throttling, by a nozzle, the fibers in the combined sliver at a location between the sets of rollers, the throttling being such that the combined sliver is pressed laterally at the nozzle, thereby interwinding the fibers between the first and second slivers;

breaking, on an inlet side of the sets of the rollers, the first silver, and;

canceling the nipping of the second silver by the set of the rollers after a completion of the interwinding operation.

6. A method for piecing, to a first sliver to a spinning machine, a second sliver, comprising the steps of:

providing spaced sets of opposite rollers;

nipping the first sliver with the sets of the rollers, so that the first sliver is being fed by the rollers;

providing a second set of opposite rollers;

supplying, by said second set of rollers, a second sliver to said spaced sets of the rollers so that the second sliver is, from its leading end, combined with the first sliver to form a combined sliver;

creating a surface speed difference between an inlet side of the spaced sets of the rollers and an outlet side of said second set of the rollers, so that a draft is applied to the leading end of the second sliver of reduced number of fibers, so that fibers, at the end of the sliver, are displaced from each other, so that the rate of change in the thickness of the combined sliver as measured along the length of the combined sliver is reduced;

throttling, by a nozzle, the fibers in the combined sliver at a location between the sets of rollers, the throttling being such that the combined sliver is pressed laterally at the nozzle, thereby interwinding the fibers between the first and second slivers; and breaking, on an inlet side of the sets of the rollers, the first sliver.

7. A method for piecing slivers in a spinning machine having at least one can for storing a first sliver, and a part for a treatment of the first sliver fed from the can, comprising the steps of:

providing spaced sets of opposite rollers;

nipping the first sliver with the sets of the rollers, so that the feed of the first sliver is moved by the rollers;

providing a second can for storing a second sliver;

picking up an end of the second sliver from the second can;

breaking the second sliver at a location adjacent said pick up end for creating a desired shape of broken end of the second sliver from the second can, while holding the waste portion initially picked up;

supplying the second sliver to the sets of the rollers so that the second sliver is, from the broken end portion, combined with the first sliver;

interwinding the fibers between the combined slivers;

breaking, on an inlet side of the sets of the rollers, the first sliver, and;

introducing said waste portion of the sliver into the first can, so that the portion together with sliver remaining in the first can are simultaneously treated at a later stage.

8. A method for piecing, to a first sliver to a spinning machine, a second sliver, comprising the steps of:

providing spaced sets of opposite rollers;

nipping the first sliver with the sets of the rollers, so that the first sliver is moved by the rollers;

supplying the second sliver to the sets of the rollers so that the second sliver is, from its leading end, combined with the first sliver to form a combined sliver;

throttling, by a nozzle, the fibers in the combined sliver at a location between the sets of rollers, the throttling being such that the combined sliver is pressed laterally at the nozzle, thereby interwinding the fibers between the first and second slivers; and breaking, on an inlet side of the sets of the rollers, the first sliver so that a separation of the fibers occurs partially along the width of the first sliver, thereby obtaining an increased length of a portion with a reduced number of fibers at the broken end of the second sliver.

9. A method for working in a spinning machine having a plurality of parallel rows of cans for storing slivers to be fed to the spinning machine, and parts for treatments of the slivers from the respective cans, comprising the steps of:

(a) providing a working machine movable along the rows of the cans and having spaced sets of separable opposite rollers;

(b) providing a row of full cans parallel to the rows of the cans being fed to the spinning machine;

(c) making the working machine to stop at a location adjacent one end of one of the rows of cans as consumed;

(d) replacing a consumed can at the end of the row of consumed cans with a full can at the end of the row of full cans;

(e) piecing the slivers from the consumed can and the full can; the piecing comprising the steps of:

nipping the first sliver from the consumed can with the sets of the rollers of the working machine, while the feed of the first sliver to the treating part is continued;

supplying the second sliver from the full can to the sets of the rollers so that the second sliver is, from its leading end, combined with the first sliver;

throttling, by a nozzle the fibers in the combined sliver at a location between the sets rollers, the throttling being such that the combined silver is pressed laterally at the nozzle, thereby interwinding the fibers between the first and second slivers;

breaking, on an inlet side of the sets of the rollers, the first sliver from the consumed can, and;

canceling the nipping of the second sliver by the set of the rollers, and;

(f) moving the working machine along the row to a position of a next consumed can, and repeating the steps (d) below until replacing all of the consumed cans in the row by the full cans and the interwinding of the slivers are done.

10. A method for working in a spinning machine having a plurality of parallel rows of cans for storing slivers to be fed to the spinning machine, and parts for treatments of the slivers from the respective cans, comprising the steps of:

(a) operating the spinning machine so that the slivers are consumed alternately among the rows of the cans being fed;

(b) providing a working machine movable along the rows of the cans and having spaced sets of separable opposite rollers;

(b) providing a row of full cans parallel to the rows of the cans being fed to the spinning machine, a plurality of rows of the cans being fed being located on at least one side of the row of the full cans;

(c) making the working machine stop at a location adjacent one end of one of the rows of cans as consumed, which is away from the row of the full cans;

(d) moving in the direction of the row a can at the end the row of cans being fed, adjacent the row of the full cans so that a space is created, so that a consumed can in the row spaced from the row of full cans is transversely traveled through the space;

(e) taking a full can from the row of the full cans into a working machine;

(f) piecing the slivers from the consumed can and the full can in the working machine; the piecing comprising the steps of:

nipping the first sliver from the consumed can with the sets of the rollers of the working machine, so that the feed of the first sliver is moved by the rollers;

supplying the second sliver from the full can to the sets of the rollers so that the second sliver is, from its leading end, combined with the first sliver;

interwinding the fibers between the combined slivers;

breaking, on an inlet side of the sets of the rollers, the first sliver from the consumed can, and;

canceling the nipping of the second sliver by the set of the rollers;

(g) moving laterally the full can via said space to the position previously occupied by the consumed can, and;

(h) moving the working machine along the row to a position of a next consumed can, and repeating the steps below (d) until replacing all of the consumed can in the row by the full cans and the piecing of the slivers is done.

11. An apparatus for piecing, to a first sliver to a spinning machine, a second sliver, comprising:

spaced sets of opposite, separable rollers;

the first sliver being nipped between the opposite rollers when they are contacted with each other, so that the first sliver is moved by the rollers;

means for supplying the second sliver to the one of the sets of the rollers so that the second sliver is, from its leading end, introduced into the sets of the rollers and combined with the first sliver to form a combined sliver;

means for throttling the fibers in the combined sliver at a location between the set of rollers so that the combined sliver is pressed laterally, thereby interwinding the fibers between the first and second slivers, and;

means for breaking, on an inlet side of the sets of the rollers, the first sliver.

12. An apparatus for piecing, to a first sliver a spinning machine, a second sliver slivers, comprising:

spaced sets of opposite, separable rollers;

the first sliver being nipped between the opposite rollers when they are contacted with each other, so that the first sliver is moved by the rollers;

means for supplying the second sliver to the one of the sets of the rollers so that the second sliver is, from it leading end, introduced into the sets of the rollers and combine with the first sliver;

means for throttling the fibers in the combined sliver at a location between the set of rollers so that the combined sliver is pressed laterally, thereby interwinding the fibers between the first and second sliver; and means for breaking, on an inlet side of the sets of the rollers, the first sliver.

13. An apparatus for piecing slivers according to claim 12, further comprising means for rubbing the combined sliver arranged at an outlet side of said throttling means.

14. A spinning system comprising:

a spinning machine having at least one row of cans for storing slivers and a part for a treatment of the slivers from the cans;

conveyor means arranged along said row for conveying full cans, and;

a working machine capable of being moved along said row, comprising:

a carriage;

spaced sets of opposite, separable rollers for nipping, therebetween, the first sliver from a consumed can so that the first sliver is moved by the rollers;

means for supplying the second sliver to an inlet side of said spaced sets of the rollers so that the sliver from a full can is, from its leading end, introduced into the spaced sets of the rollers and combined with the first sliver, and;

means for throttling the fibers in the combined sliver at a location between the set of rollers so that the combined sliver is pressed laterally, thereby interwinding the fibers between the combined slivers; and the working machine being capable of being stopped at a desired location along the row, so that the sets of the rollers, said means for supplying, and the means for throttling are located along a feed line of a sliver from a call to a corresponding treating part, the working machine being further provided with means for engaging the first sliver supplied from the consumed can to the treating part and for inserting the first sliver to said line when the sets of the roller are separated, and with a breaking means for breaking on a side of the roller sets adjacent the consumed can the first sliver from the consumed can after the completion of the interwinding operation.

15. An apparatus for piecing, to a first sliver to a spinning machine, a second sliver, said apparatus comprising:

spaced sets of opposite, separable rollers;

the first sliver being nipped between the opposite rollers when they are contacted with each other, so that the first sliver is moved by the rollers;

a second set of reversible rollers for supplying the second sliver to the one of the sets of the rollers so that the second sliver is, from its leading end, introduced into the sets of the rollers and combined with the first sliver;

said rollers in the second set being capable of being opened so that the second sliver is sliver is introduced into rollers;

a sliver end pick-up means for introduction of the second sliver into the second set of the rollers when they are opened;

means for nipping the second sliver between the second set of the rollers and the sliver end pick-up means;

means for breaking the second sliver between the second set of the rollers and the sliver end pick-up means;

the second set of the rollers being forwardly rotated when the second sliver is fed, from said broken end, to the spaced sets of the rollers for causing the first and second slivers to be combined;

means for inter-winding the fibers between the combined slivers; and means for breaking, on an inlet side of the sets of the rollers, the first sliver.

16. An apparatus according to claim 15, further comprising means for detecting the length of the second sliver projected from the second set of the roller during their reverse rotation, and means for controlling the reverse rotation such that a predetermined value of the projected length of the second sliver is obtained.

17. An apparatus according to claim 15, wherein each of the rollers in said second set form a plane for nipping the second sliver, and wherein said nipping means comprises a pair of spaced apart nipping members, and means for moving the spaced apart nipping member so that they are contacted with each other for nipping the second sliver therebetween, each of the nipping members defining a nipping plane which is substantially 90 degree with respect to the plane of the rollers of the second set.

18. An apparatus according to claim 17, wherein said nipping means further comprise a pair of spaced apart throttling members which are fixedly connected to the nipping members, respectively, each of the throttling members form a throttling plane which is substantially 90 degree with respect to the plane of the rollers of the second set, a small spacing being created between the throttling members when the nipping members are contacted with each other, so that a pointed-brush shape at the broken end of the second sliver is obtained.

19. A spinning system comprising:

a spinning machine having at least a can for storing a sliver and a part for a treatment of the slivers from the cans;

means for locating at least one full can adjacent the can being supplied to the spinning machine;

spaced sets of opposite, separable rollers;

a first sliver from the can to the spinning machine being nipped between the opposite rollers when they are contacted with each other;

a second set of rollers for supplying the second sliver from a full can to the one of the sets of the rollers so that the second sliver is, from its leading end, introduced into the sets of the rollers and combined with the first sliver;

said rollers in the second set being capable of being opened so that the second sliver is introduced into the rollers;

a sliver end pick-up means for introduction of the second sliver into the second set of the rollers when they are opened;

means for interwinding the fibers between the combined slivers;

means for breaking the second sliver from the full can between the second set of the roller and the sliver end pick-up means, while the waste broken from the second sliver is being held by the pick-up means, and;

means for introducing the waste sliver held at the pick-up means into consumed can.

20. An apparatus for piecing, to a first sliver to a spinning machine, a second sliver, comprising:

spaced sets of opposite, separable rollers;

the first sliver being nipped between the opposite rollers when they are contacted with each other, so that the first sliver is moved by the rollers;

the second set of rollers for supplying the second sliver to the one of the sets of the rollers so that the second sliver is, from its leading end, introduced into the sets of the rollers and combined with the first sliver;

means for throttling the fibers in the combined sliver at a location between the set of rollers so that the combined sliver is pressed laterally, thereby interwinding the fibers between the combined sliver;

means for obtaining a variable speed of, among the spaced sets of rollers, at least the set thereof located at the inlet side;

means for obtaining a variable speed of the second set of the rollers, and;

means for breaking, on an inlet side of the sets of the rollers, the first sliver.

21. An apparatus for piecing, to a first sliver to a spinning machine, a second sliver, comprising:

spaced sets of opposite, separable rollers;

the first sliver being nipped between the opposite rollers when they are contacted with each other, so that the first sliver is moved by the rollers;

a second set of rollers for supplying the second sliver to the one of the sets of the rollers so that the second sliver is, from its leading end, introduced into the sets of rollers and combined with the first sliver;

means for throttling the fibers in the combined sliver at a location between the set of rollers so that the combined sliver is pressed laterally, thereby interwinding the fibers between the combined sliver; and means for breaking, on an inlet side of the sets of the rollers, the first sliver after a predetermined length of the combined slivers is obtained, said breaking means holding partially the first sliver along its width, so that a separation of the fibers occurs partially along the width of the first sliver.

22. An apparatus according to claim 21, wherein said breaking means comprise a nipping surface formed at the second set of the rollers, and a comb shaped nipping member contacted with the nipping surface via the first sliver.

23. A spinning system comprising:

a spinning machine having at least one row of cans for storing a sliver and a part for the treatment of the slivers from the cans;

conveyor means arranged along said row for conveying full cans and for conveying consumed cans;

a working machine capable of being moved along said conveyor means, said working machine having a carriage leaving a first and second storing sections along the length thereof, each section being of a dimension capable of receiving a can;

means for taking, into the first section of the carriage, a consumed can from the treatment part in said row;

means for taking, into the second section of the carriage, a full can on the conveyor on one side of the working machine in the direction of the movement thereof;

means for moving the full can in the second section to the first section;

means for discharging the consumed can to the conveyor part from first section of the working machine at the other side thereof; and means for delivering the full can at the first section into a portion of the row previously occupied by the consumed can;

said working machine further comprising:

spaced sets of opposite, separable rollers for nipping, therebetween, a first sliver from the consumed can in the second section, the first sliver being fed to the treatment part;

means for introducing the first sliver from the consumed can at the first section to the spaced sets of rollers for causing the sliver to be nipped by the sets of the roller;

means for supplying the second sliver from the full can at the second section to an inlet side of said spaced sets of the rollers so that the second sliver from the full can is, from its leading end, introduced into the spaced sets of the rollers and combined with the first sliver to form a combined sliver;

means for throttling the fibers in the combined sliver at a location between the set of rollers so that the combined sliver is pressed laterally, thereby interwinding the fibers of the combined sliver; and a break means for breaking the sliver from the consumed can at the first section of the carriage after the completion of the interwinding operation.

* * * * *